US008297276B2

(12) United States Patent
McCarthy

(10) Patent No.: US 8,297,276 B2
(45) Date of Patent: Oct. 30, 2012

(54) DRY SNORKELS AND METHODS

(76) Inventor: Peter T. McCarthy, Oxnard, CA (US)

( * ) Notice: Subject to any disclaimer, the term of this patent is extended or adjusted under 35 U.S.C. 154(b) by 1462 days.

(21) Appl. No.: 11/880,534

(22) Filed: Jul. 20, 2007

(65) Prior Publication Data

US 2008/0047552 A1 Feb. 28, 2008

Related U.S. Application Data

(60) Provisional application No. 60/848,911, filed on Oct. 2, 2006, provisional application No. 60/832,072, filed on Jul. 20, 2006, provisional application No. 60/833,728, filed on Jul. 26, 2006, provisional application No. 60/844,937, filed on Sep. 16, 2006.

(51) Int. Cl.
*B63C 11/16* (2006.01)
*B63C 11/02* (2006.01)

(52) U.S. Cl. ..... 128/201.11; 128/200.29

(58) Field of Classification Search ..... 128/200.24, 128/200.29, 201.11, 201.26–201.29, 202.13, 128/202.14, 206.29; 137/39, 445, 448, 409, 137/410, 421, 431, 434
See application file for complete search history.

(56) References Cited

U.S. PATENT DOCUMENTS 2,815,751 A * 12/1957 Ferraro ..... 137/410
5,524,611 A * 6/1996 Fu ..... 128/201.11
5,960,791 A * 10/1999 Winefordner et al. ... 128/201.11
6,371,108 B1 4/2002 Christianson
6,655,378 B2 12/2003 Swetish
6,679,253 B1 1/2004 Feng
6,843,246 B2 1/2005 Shiue
6,904,910 B2 6/2005 Christianson
6,994,085 B2 * 2/2006 Shiue ..... 128/201.11
6,994,124 B2 2/2006 Feng
7,069,927 B1 * 7/2006 Pan ..... 128/201.11
7,165,545 B1 1/2007 Shiue
2006/0254582 A1 * 11/2006 Christianson ..... 128/201.11

* cited by examiner

*Primary Examiner* — Justine Yu
*Assistant Examiner* — Valerie L Skorupa

(57) ABSTRACT

Methods are disclosed for improving the performance and design of snorkels (20) that are arranged to reduce splashes of water from entering the snorkel (20) during use. Methods including providing a non-floating active portion (72) and a spring member (54) to move active portion (72) to a closed position (68). Methods are provided for using weighted members (94) and, or floats (44) in conjunction with biasing members (54) exerted with torque across pivoting arms (42) and along longitudinal directions of motion (100). Methods are provided for enabling dry top snorkel devices (38) to automatically achieve, maintain or reestablish a closed position (68) at depth even if little or no pressure differential exists between the inside and outside of the snorkel (20) or if the sealed connection is disengaged at depth, such as can occur during a firm exhale at depth. Other methods are providing for moving the sealing member (46) to a closed position (68) even if no float (44) is used or if no spring member (54) is used.

24 Claims, 16 Drawing Sheets

Fib 6d

Fig 27
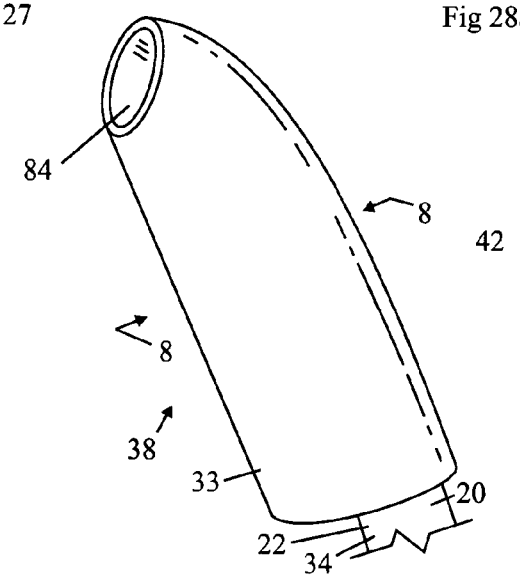
Fig 28a
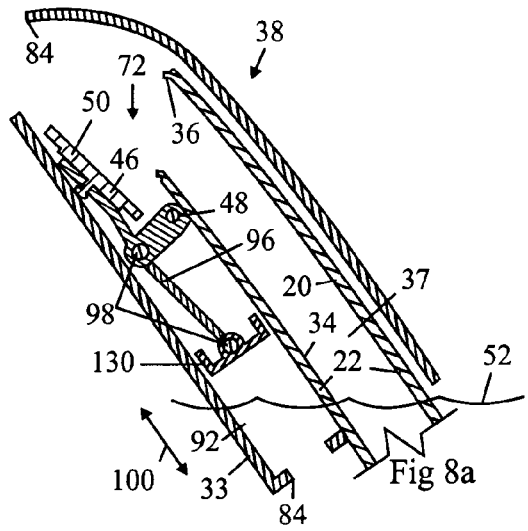
Fig 8a
Fig 28b
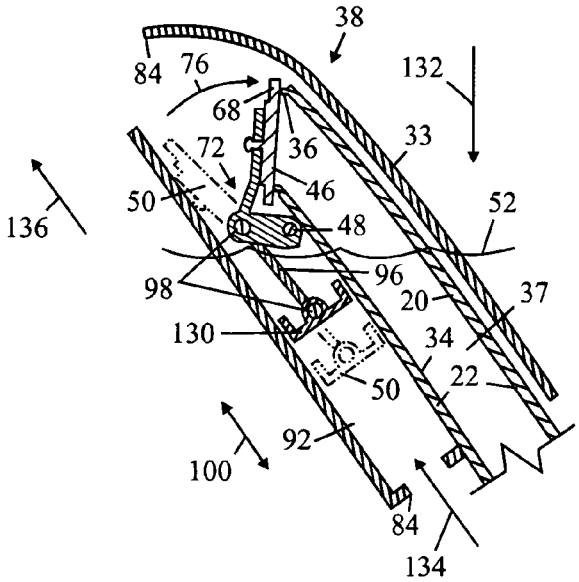
Fig 28c
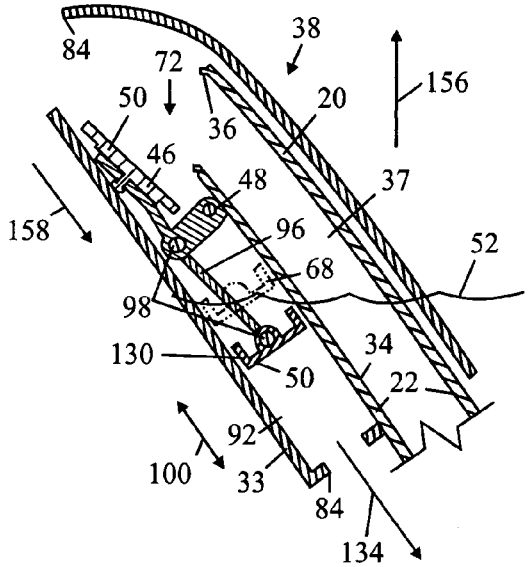

DRY SNORKELS AND METHODS

This application claims the benefit under 34 U.S.C. §119 (e) of the following U.S. Provisional applications: U.S. Provisional Application No. 60/848,911 filed Oct. 2, 2006, titled Snorkel Top; U.S. Provisional Application No. 60/832,072, filed Jul. 20, 2006, titled Dry Snorkels; U.S. Provisional Application No. 60/833,728, filed Jul. 26, 2006, titled Dry Snorkel Methods; and U.S. Provisional Application No. 60/844,937, filed Sep. 16, 2006, titled Dry Snorkels And Methods. The entire contents of these provisional applications are hereby incorporated by reference herein and made part of this specification

BACKGROUND

1. Field of Invention

This invention relates to snorkels, specifically to such snorkels that use a dry top device for sealing the air inlet opening of the snorkel when diving beneath the surface of the water.

2. Description of Prior Art

Prior art snorkels are vulnerable to opening underwater when the swimmer orients the snorkel in directions other than vertical, especially if the swimmer exhales slightly, purges the snorkel underwater or if the pressure differential between the inside and outside of the submerged snorkel is reduced or eliminated. During such occurrences, prior art dry top devices for snorkels can become unsealed and then not automatically return to a sealed position when the snorkel is oriented in number of potential directions. This can cause the dry top to fail and the snorkel to flood.

OBJECTS AND ADVANTAGES

Accordingly, several objects and advantages of the present invention are:

(a) to provide methods and designs for dry tops for snorkels that can maintain a sealed condition in numerous underwater orientations;

(b) to provide methods and designs for dry tops for snorkels that can regain a sealed position in numerous underwater orientations after the swimmer exhales or if the suction force within the snorkel at depth is reduced or eliminated;

(c) to provide methods and designs for dry tops for snorkels that can have an improved sealing force for sealing the snorkel during at least one or more orientations underwater;

(d) to provide methods and designs for snorkels splash protectors that can provide improved ability to prevent splashes of water from entering the air intake opening of a snorkel;

(e) to provide methods and designs for splash protectors for snorkels that can provided significantly low levels of flow resistance or work of breathing;

(f) to provide methods and designs for splash protectors for snorkels that can prevent splashes of water from entering the air intake of the snorkel from an increased number of directions;

(g) to provide methods and designs for splash protectors for snorkels with improved streamlined shape and, or reduced overall size and drag;

(h) to provide methods and designs for splash protectors for snorkels that can provide improved performance.

(i) to provide methods and designs for dry tops for snorkels that can achieve, maintain or reestablish a sealed position in numerous underwater orientations after the swimmer exhales or if the suction force within the snorkel at depth is reduced or eliminated; and, or (j) to provide methods and designs for dry tops for snorkels that can provide improved performance.

Still further objects and objectives will become apparent from a consideration of the ensuing description and drawings.

DRAWING FIGURES

Figure 5:
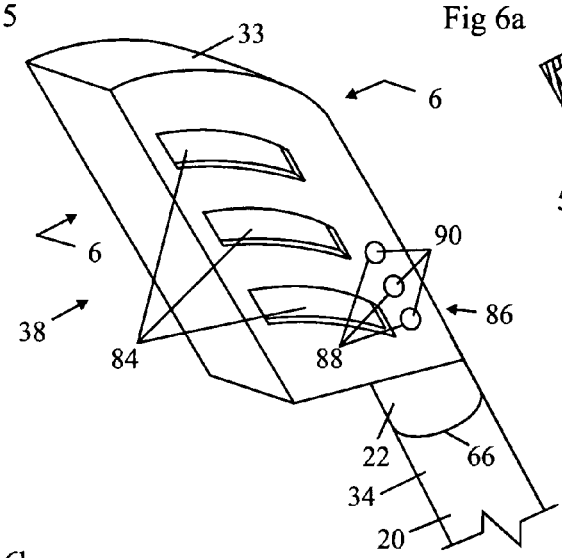
FIG. 5 shows a perspective side view of a dry top connected to the upper portion of a snorkel.

FIGS. 6*a* to 6*e* show alternate embodiments of a cross section view taken along the line 6-6 in FIG. 5.

Figures 7, 8A, 8B, 8C, 8D, 8E, 8F:
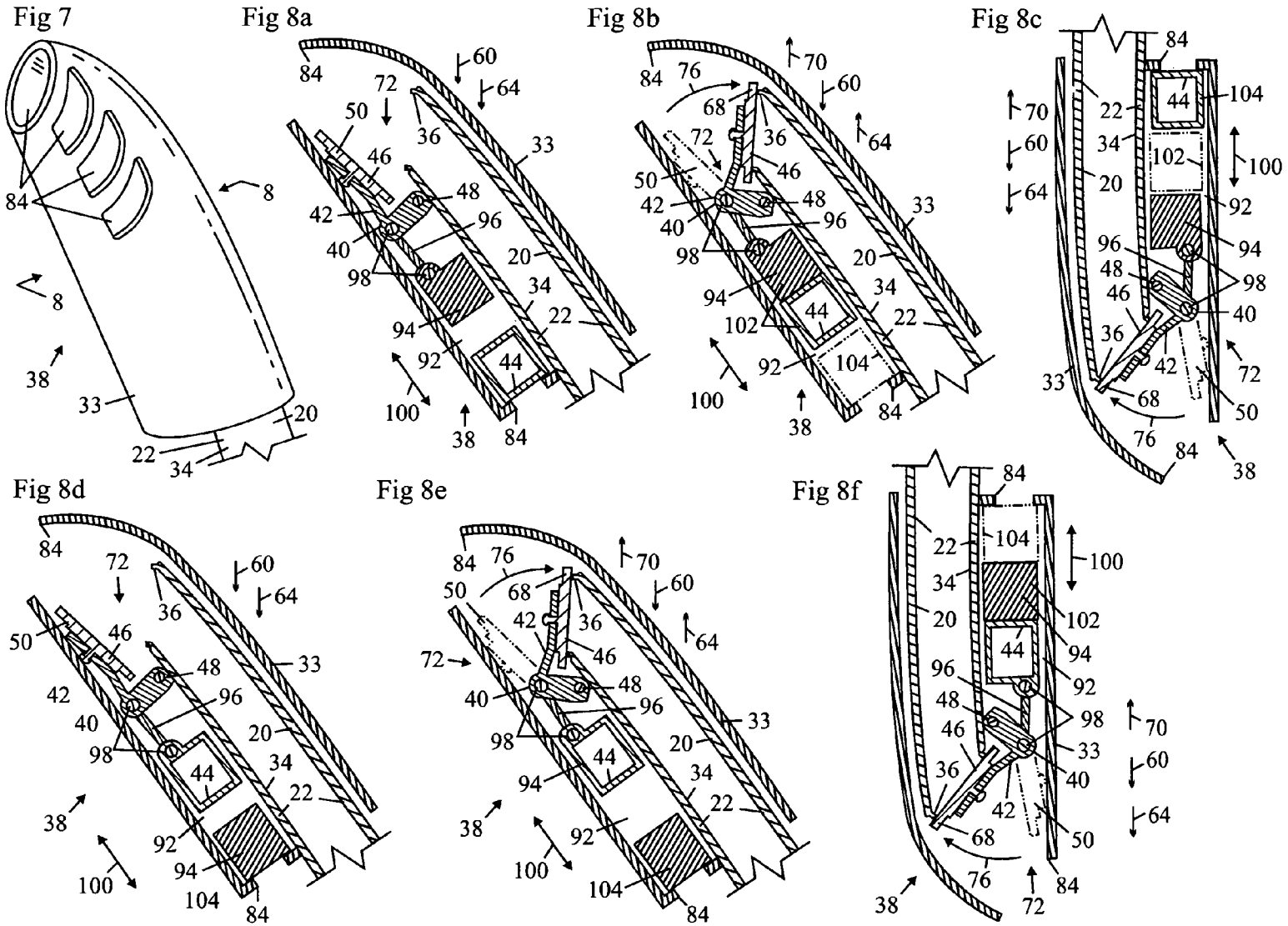

FIG. 7 shows a perspective side view of an alternate embodiment dry top connected to the upper portion of a snorkel.

Figure 8I:
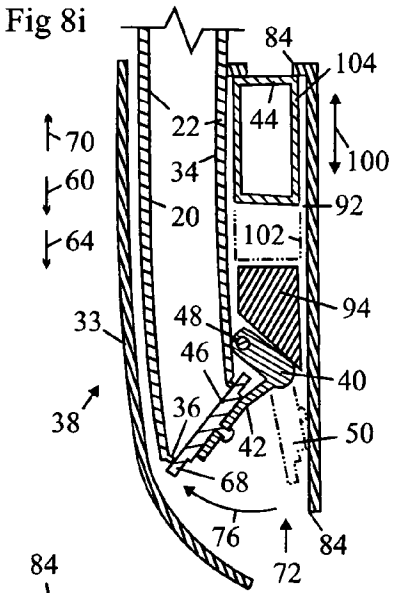
Figure 8L:
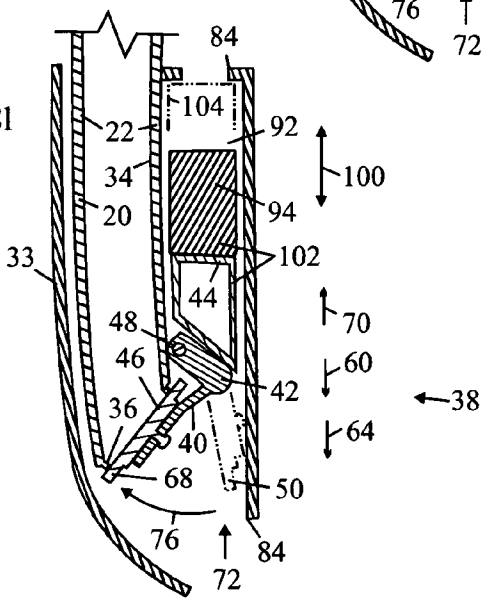
Figure 8H:
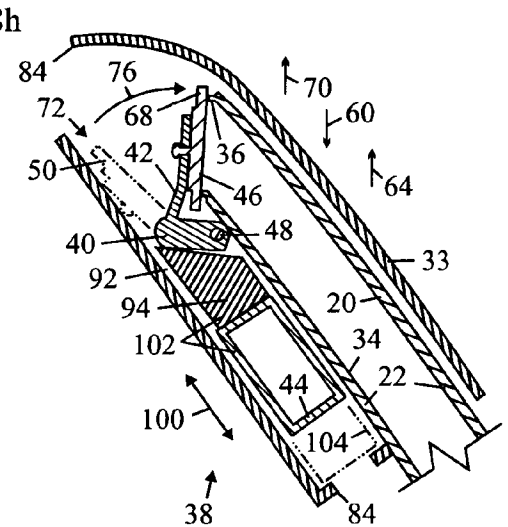
Figure 8K:
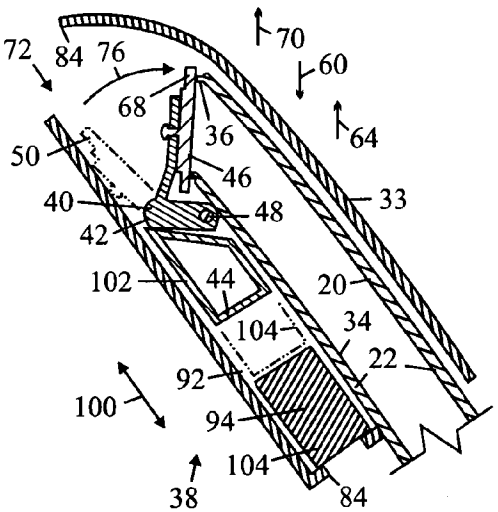
Figure 8G:
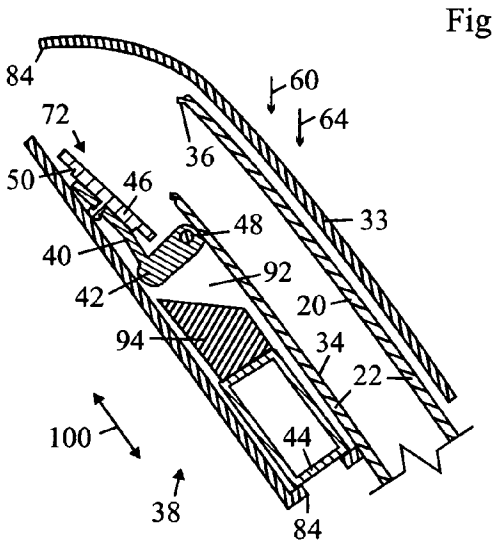
Figure 8J:
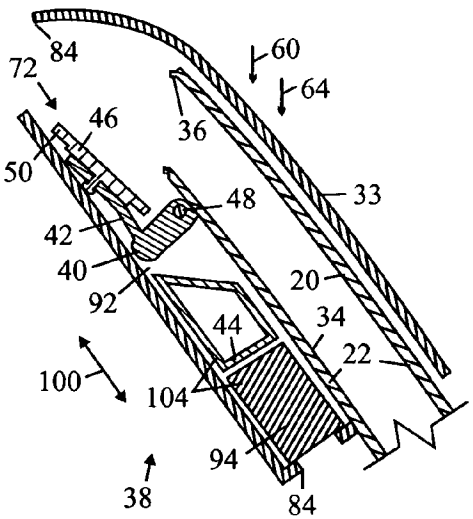
Figure 8M:
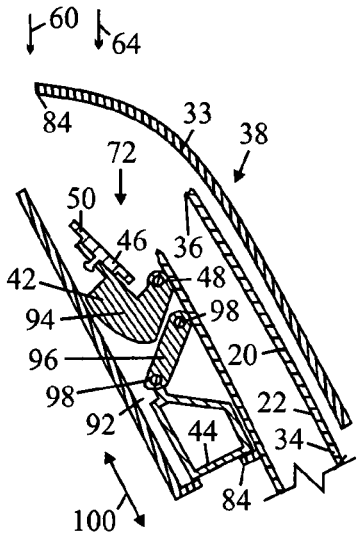
Figure 8N:
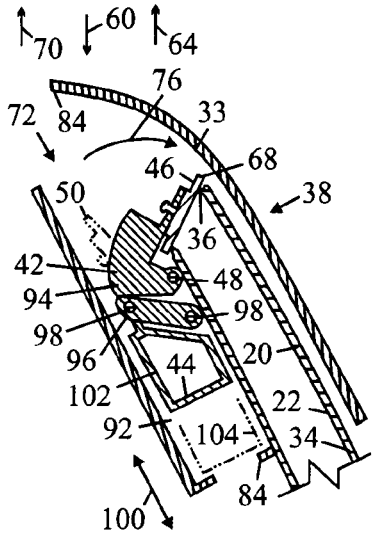
Figure 8O:
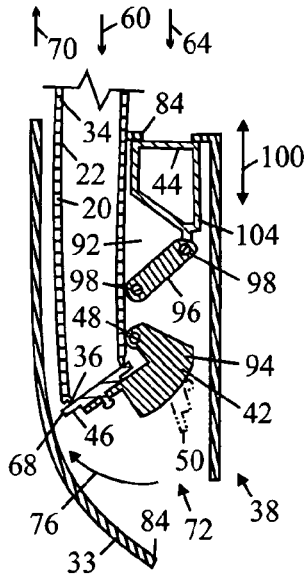
Figure 8P:
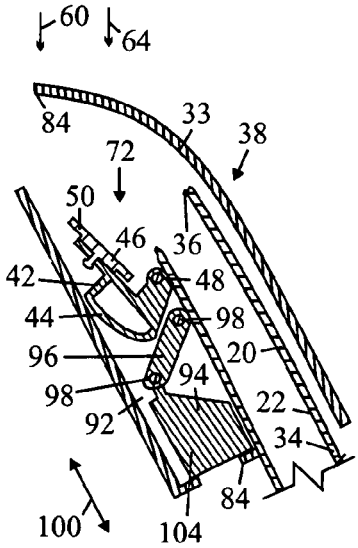
Figure 8Q:
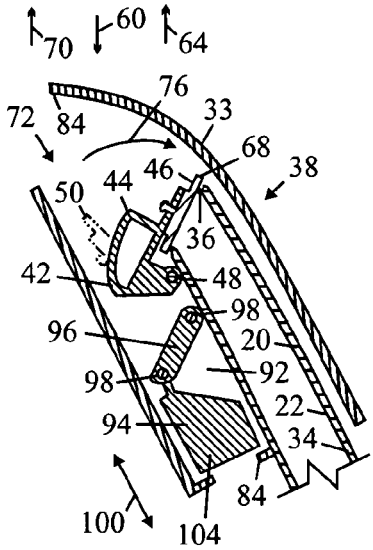
Figure 8R:
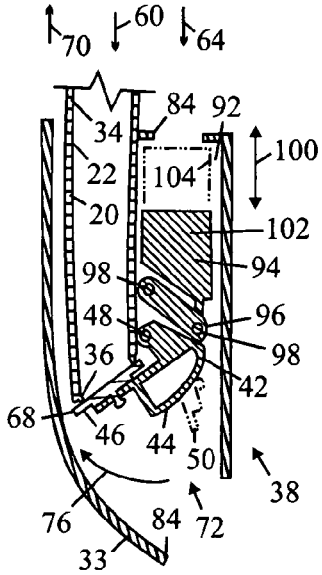

FIGS. 8*a* to 8*r* show alternate embodiments of a cross section view taken along the line 8-8 in FIG. 7.

Figure 9:
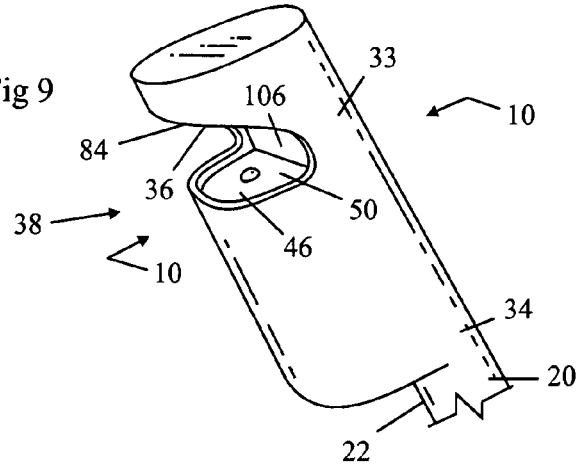

FIG. 9 shows a perspective side view of an alternate embodiment dry top connected to the upper portion of a snorkel.

FIGS. 10*a* to 10*j* show alternate embodiments of a cross section view taken along the line 10-10 in FIG. 9.

Figures 11, 12A, 12B, 12C, 12D, 12E, 13, 14:
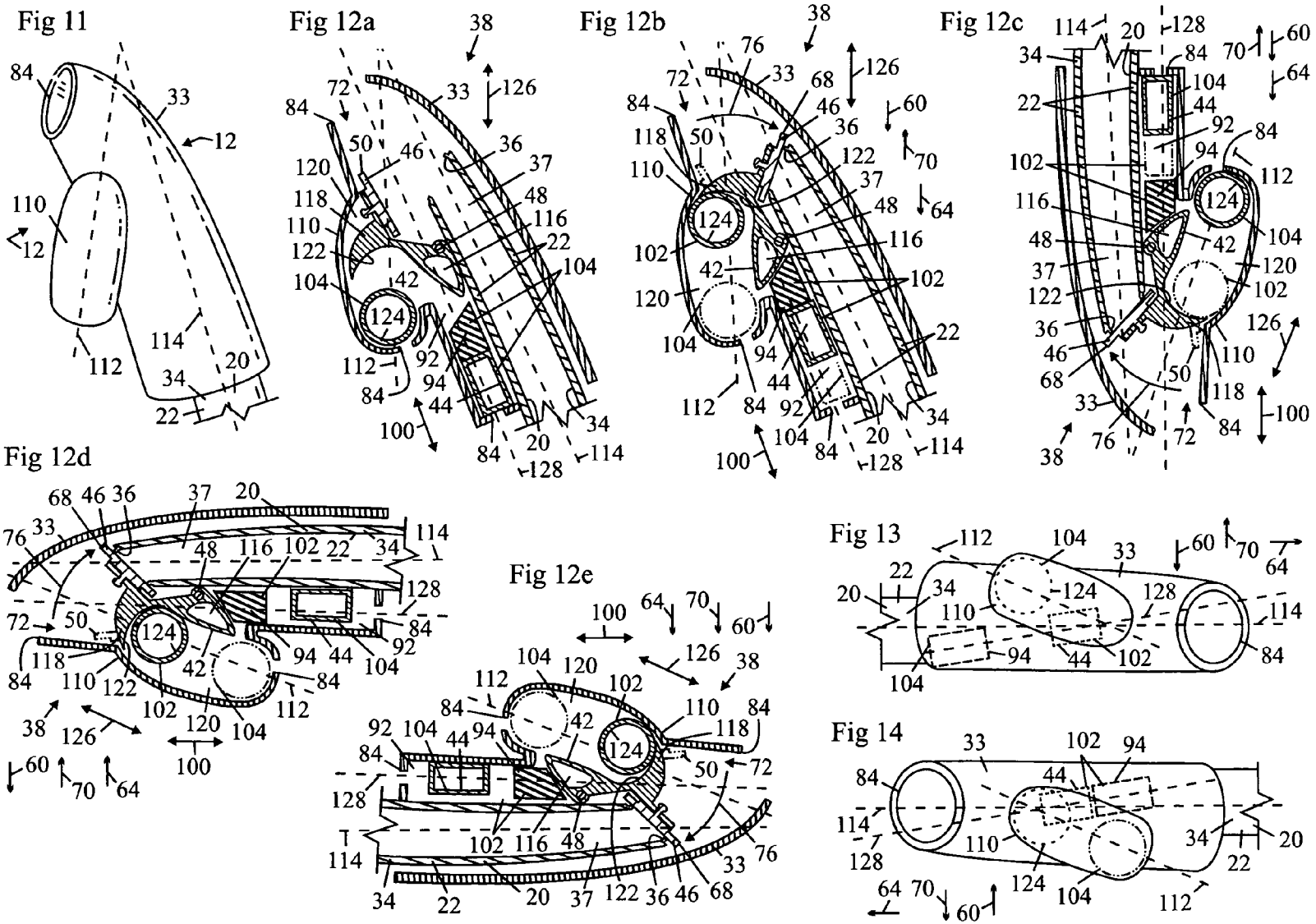

FIG. 11 shows a perspective side view of an alternate embodiment dry top connected to the upper portion of a snorkel.

FIGS. 12*a* to 12*e* show alternate embodiments of a cross section view taken along the line 12-12 in FIG. 11.

FIG. 13 shows a side view of the embodiment shown in FIGS. 11 to 12*e* in which the dry top is oriented in a substantially horizontal position.

FIG. 14 shows a side view of the embodiment shown in FIG. 13 in which the dry top is oriented in a substantially horizontal position that is substantially opposite to the horizontal orientation shown in FIG. 13.

Figure 15:
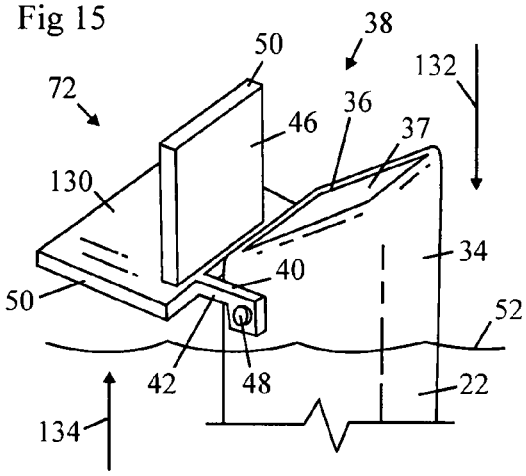

FIG. 15 shows a perspective view of an alternate embodiment.

Figure 16:
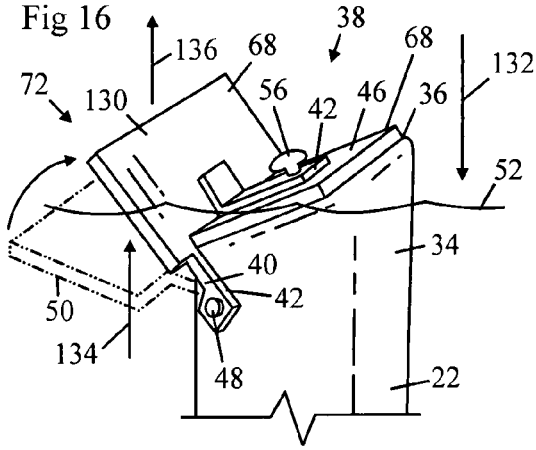

FIG. 16 shows a perspective view of the embodiment of FIG. 15 in a closed position.

Figure 17:
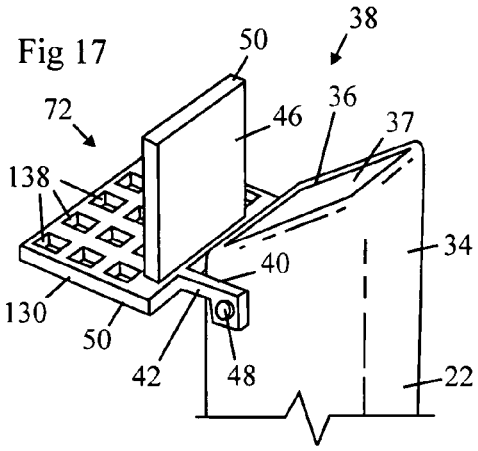

FIG. 17 shows a perspective view of an alternate embodiment.

Figure 18:
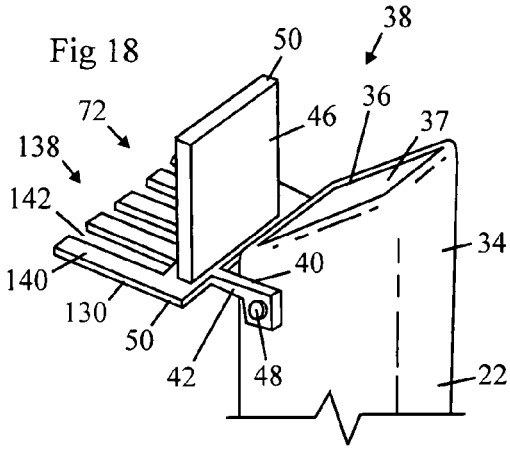

FIG. 18 shows a perspective view of an alternate embodiment.

Figure 19:
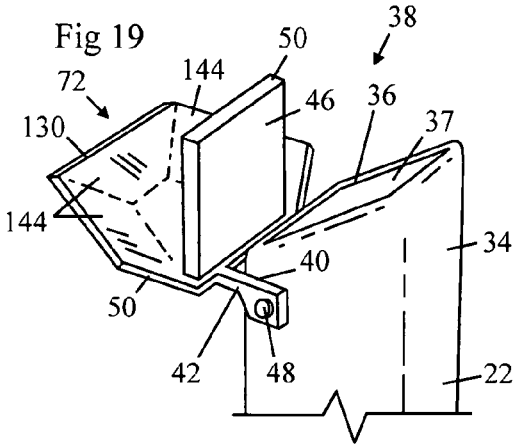

FIG. 19 shows a perspective view of an alternate embodiment.

Figure 20:
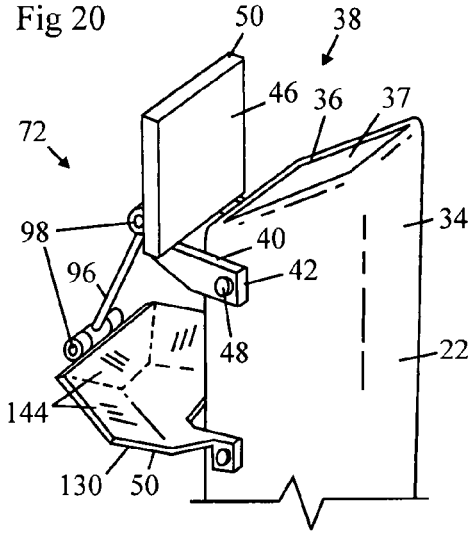

FIG. 20 shows a perspective view of an alternate embodiment.

Figure 21:
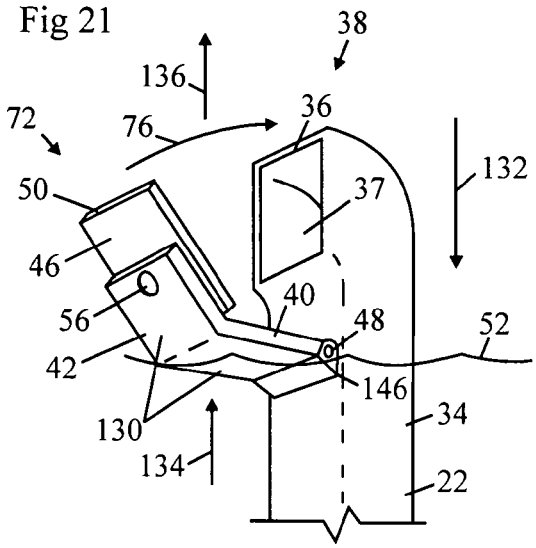

FIG. 21 shows a perspective view of an alternate embodiment.

Figure 22:
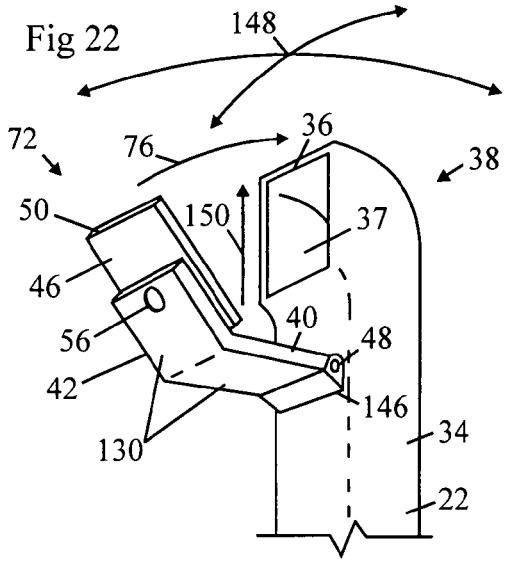

FIG. 22 shows a perspective view the embodiment shown in FIG. 21 with an alternative method of closing the valve by use of centrifugal force.

Figure 23:
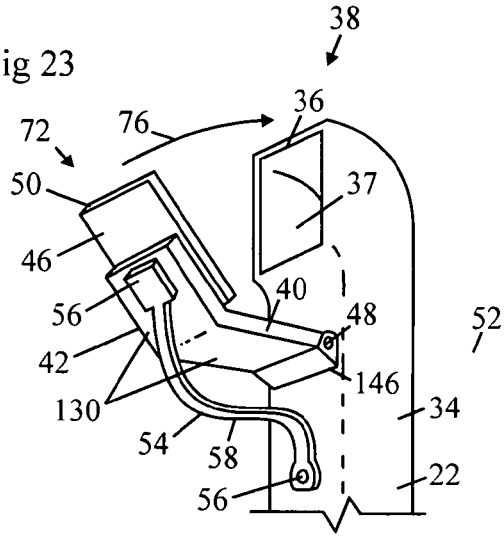

FIG. 23 shows a perspective view of an alternate embodiment.

Figure 24:
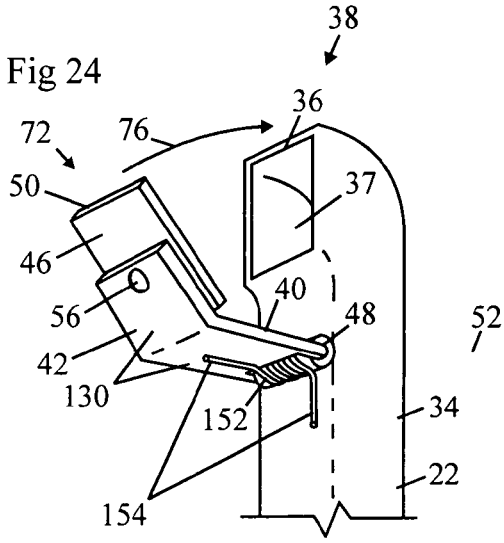

FIG. 24 shows a perspective view of an alternate embodiment.

Figure 25:
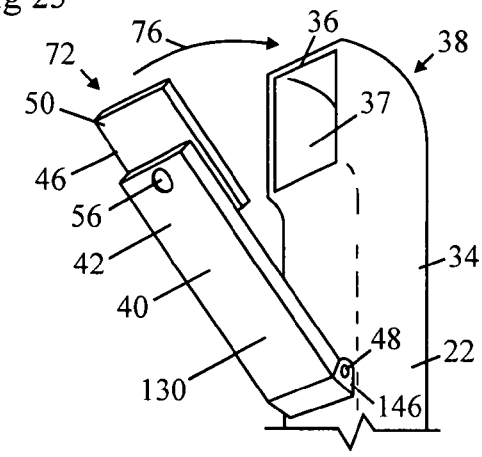

FIG. 25 shows a perspective view of an alternate embodiment.

Figure 26:
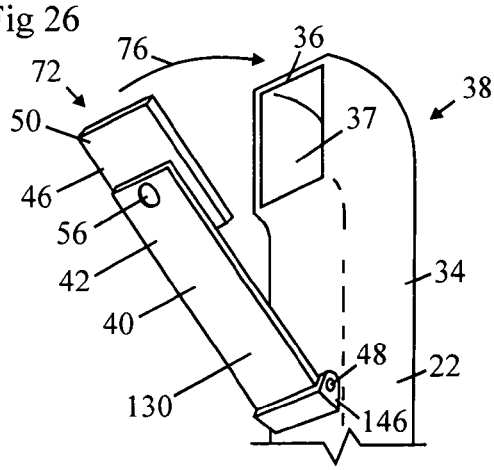

FIG. 26 shows a perspective view of an alternate embodiment.

FIG. 27 shows a perspective view of an alternate embodiment.

FIGS. 28*a*, 28*b* and 28*c* show cross section views taken along the line 28-28 in FIG. 27.

Figure 29:
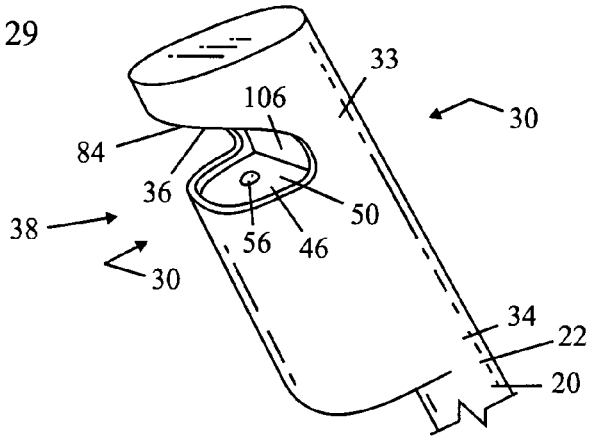

FIG. 29 shows a perspective view of an alternate embodiment.

Figure 30A:
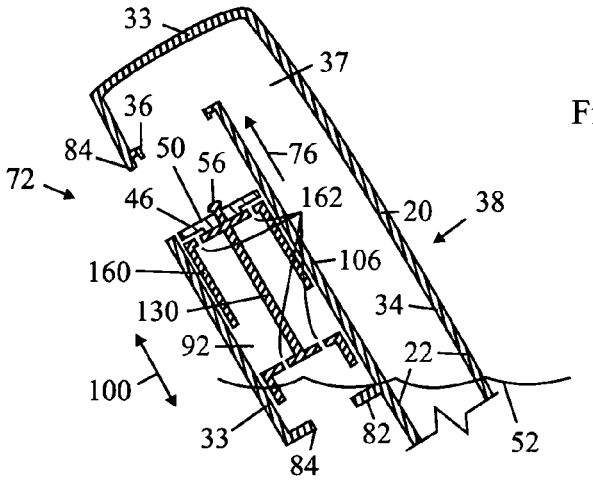
Figure 30B:
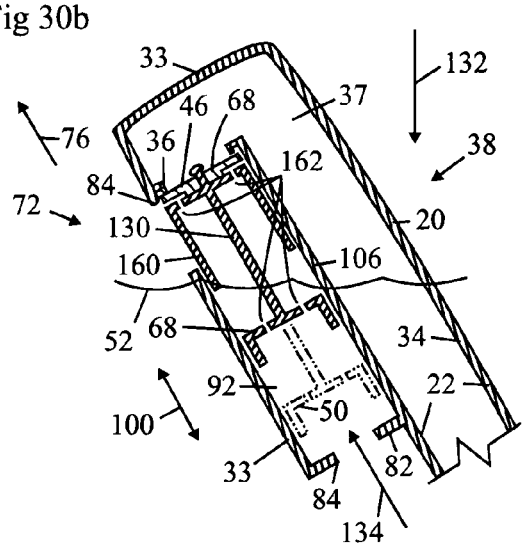

FIGS. 30*a* and 30*b* show cross section views taken along the line 30-30 in FIG. 29.

FIGS. 31 to 36 show perspective side views of alternate embodiments.

Figure 37:
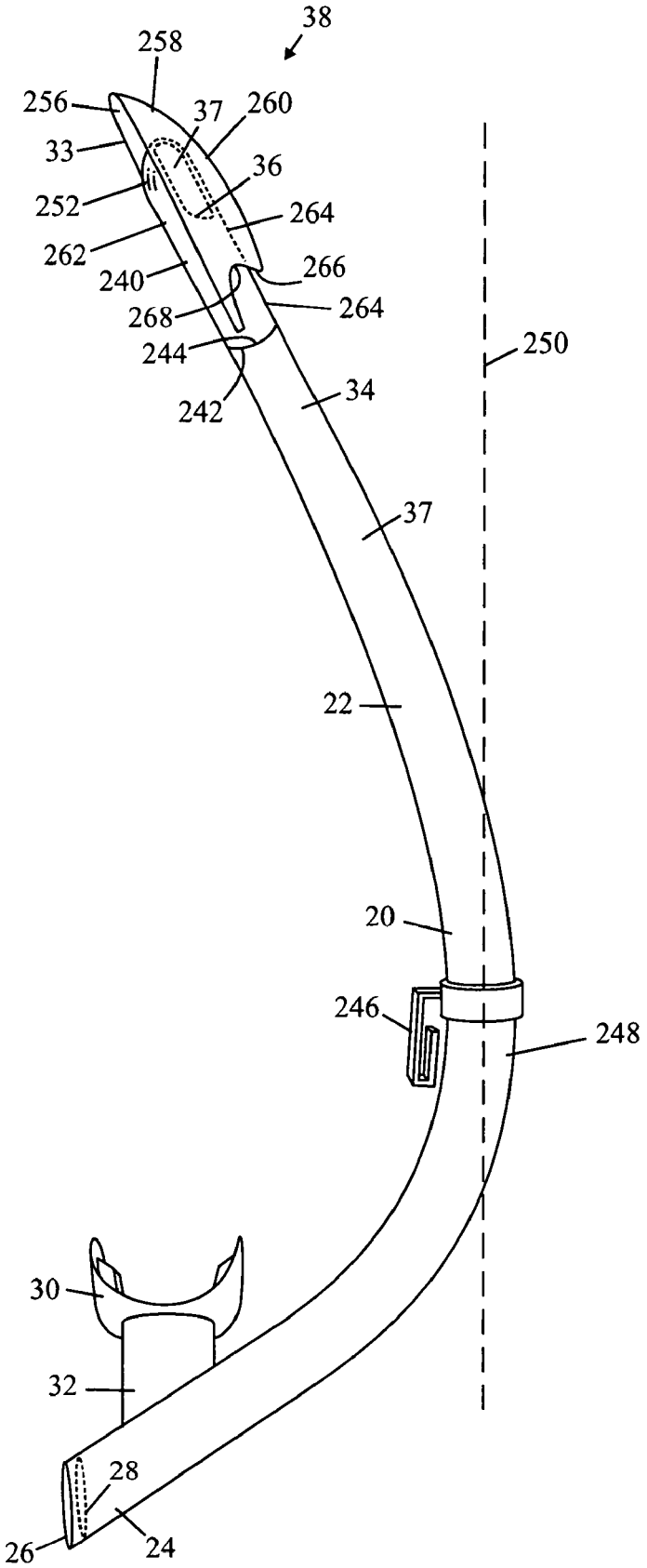

FIG. 37 shows a perspective view of a snorkel having a splash protector dry top.

Figures 38, 39A, 39B, 39C, 40, 41, 42, 43, 44, 45:
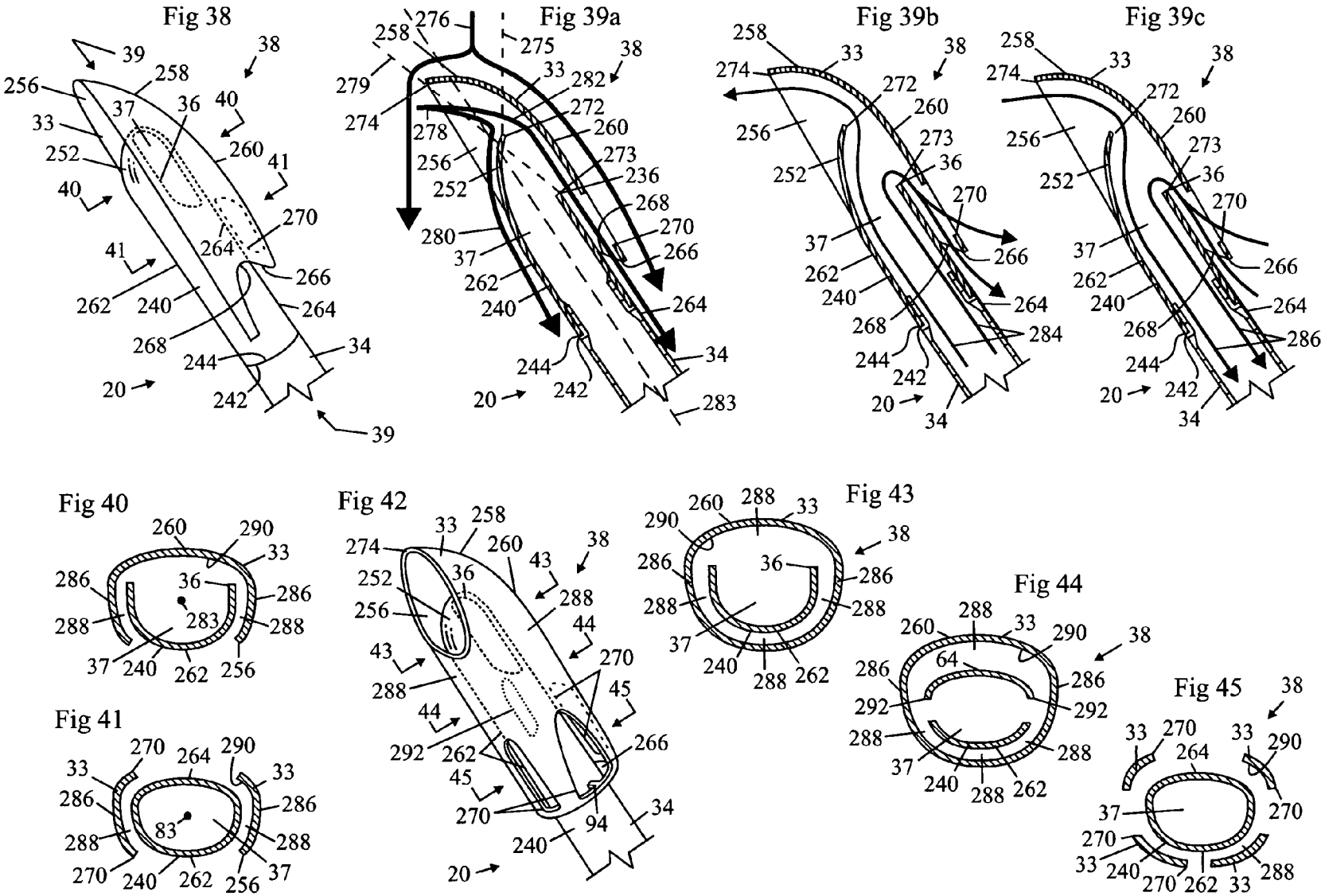

FIG. 38 shows a close up perspective view of the dry top portion of the snorkel shown in FIG. 37.

FIGS. 39*a* to 39*c* show cross section views taken along the line 39-39 in FIG. 38.

FIG. 40 shows a cross section view taken along the line 40-40 in FIG. 38.

FIG. 41 shows a cross section view taken along the line 41-41 in FIG. 38.

FIG. 42 shows a perspective view of an alternate embodiment dry top.

FIG. 43 shows a cross section view taken along the line 43-43 in FIG. 42.

FIG. 44 shows a cross section view taken along the line 44-44 in FIG. 42.

FIG. 45 shows a cross section view taken along the line 45-45 in FIG. 42.

DESCRIPTION AND OPERATION

Figure 1:
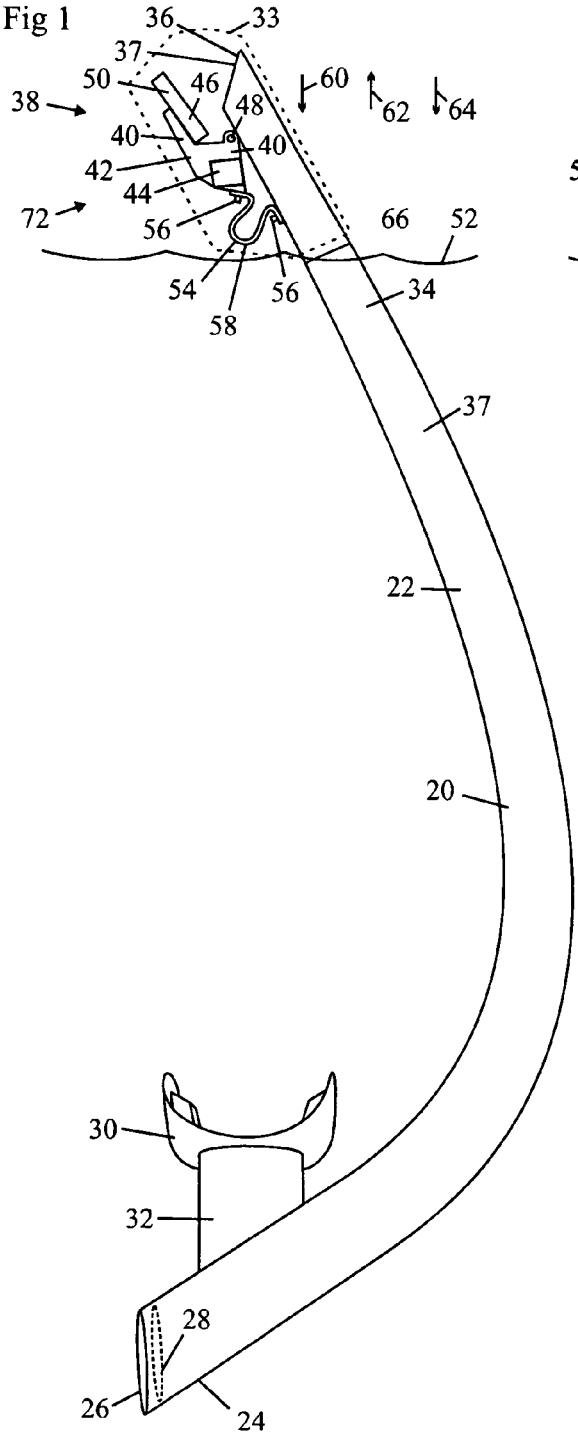
FIG. 1 shows a front view of a snorkel having a dry top that is open.

FIG. 1 shows a front view of a snorkel 20 with a conduit 22 that has a lower portion 24, a lower end 26 and a purge valve 28. Purge valve 28 is preferably a one-way valve that permits water, saliva and, or air to be expelled from snorkel 20 through purge valve 28. Purge valve 28 may have any form and may include a well known form of resilient membrane that covers an exterior portion of an opening or vent within purge valve 28 so that the resilient membrane flexes open to permit water, saliva and, or air to be expelled through such opening or vents under the creation of relatively positive pressure where the internal air pressure exceeds ambient pressure outside of snorkel 20 by a predetermined amount, and then flexes back to a closed position when internal pressure no longer exceeds ambient pressure by such a predetermined amount so that external water cannot enter snorkel 20. A mouthpiece 30 is connected to conduit 22 with a breathing tube 32. Snorkel 20 has an upper portion 34 having an upper opening 36. Snorkel 20 has an internal passageway 37 that is in fluid flow communication between mouthpiece 30 and upper portion 34. A dry top member 38 is connected to upper portion 34, which may be any type of member that is arranged to prevent water from entering upper opening 36 when upper portion 34 is submerged or partially submerged. A cover member 33 is displayed by broken lines near upper opening 36 and may have any desired form that preferably protects the moveable parts of dry top 28 and, or reduces splashing water from entering upper opening 36 when dry top 38 is being used to provide breathable air to a swimmer who is inhaling and, or exhaling through snorkel 20. Dry top member 38 is seen to include a guiding member 40, which in this embodiment is a pivoting arm 42. Dry top member 38 has a float 44 connected to movable member 40 and a sealing member 46 is connected to guiding member 40. In alternate embodiments, guiding member 40 may have any form, arrangement, configuration, shape, variation in parts or number of parts that can permit float 44 to have a predetermined path of movement in any desired direction relative to upper end 36 and, or upper portion 34. In alternate embodiments, float 44 may be directly connected to sealing member 46 with or without any intermediate portion. Sealing member 36 is preferably made with a relatively resilient material such as silicone rubber, thermoplastic rubber, thermoplastic elastomer or any suitable material that can create a substantially water tight seal with opening 36 when sealing member 46 achieves a closed position that contacts opening 36. Float 44 is preferably made with a relatively stiff thermoplastic material that is arranged to have an enclosed air cell, a hollow portion, a enclosed hollow portion or a closed cell foam; however, in alternate embodiments float 44 may be made with any material and, or configuration that permits float 44 to be preferably less dense than water. Float 44 may be arranged to have any suitable material, shape, contour, size, dimension, density, specific gravity, buoyancy, constancy, or form. In this embodiment, pivoting arm 42 of guiding member 40 is connected to upper portion 34 with a hinge member 48 that is arranged to permit movable member 40 to pivot around a substantially transverse axis relative to the longitudinal alignment of upper portion 34. Hinge member 48 may be connected to upper portion 34 in any suitable manner. In alternate embodiments, hinge 46 may be connected in any suitable manner to cover 33 and not directly connected to conduit 22.

In FIG. 1, sealing member 46 is in an open position 50 due to at least a portion of sealing member 46, pivoting arm 42 and, or float 44 being above a surface 52 of the surrounding water. A bias member 54 is attached to pivoting arm 42 and snorkel 20 with connection members 56. In this embodiment, connection members 56 include mechanical interlocking features such as pin with a widened head for providing a mechanical bond; however, in alternate embodiments, bias member 54 may be connected to any portion of snorkel 20 and, or dry top 38 in any suitable manner including any suitable mechanical and, or chemical bond. Bias member 54 is seen to be in a contracted condition 58, which in this example causes bias member 54 to be bent; however, contracted condition 58 may have any suitable alternate form. In this embodiment, bias member 54 is preferably made with a resilient material such as a silicone, rubber, thermoplastic elastomer or any other suitable material. In this embodiment, bias member 54 is in the form of a strip, chord, membrane, or elongated resilient member.

Preferably, pivoting arm 42, float 44 and, or sealing member 46 and, or bias member 54 is arranged to have sufficient weight out of water to create a predetermined net gravitational force 60 to be exerted on sealing member 46 about hinge 48 that results from the combined weights of such parts having a connection to sealing member 46. Preferably, bias member 54 is preferably arranged to have sufficient elastic memory to create a predetermined bias force 62 when bias member 54 is in contracted position 58. Preferably, bias force 60 is arranged to counter gravitational force 60 while also preferably being weaker than gravitational force 60 so that gravitational force 60 causes sealing member 46, pivoting arm 42 and float 44 to pivot to open position 50 and causes bias member 54 to flex to contracted condition 58 when at least a portion of portion of sealing member 46, pivoting arm 42 and, or float 44 are at a predetermined position and, or a predetermined orientation above surface 52 of the water, such as a substantially vertical orientation such as used by a swimmer breathing through snorkel 20 during surface swimmer and, or floating. Bias force 62 is shown to be directed in the opposite direction of gravitational force 60 because at least a vector component of bias force 62 and, or a resultant vector due to the rotation of arm 42 around hinge 48 is directed in the opposite direction of gravitational force 60 due to contracted condition 58 of bias member 54.

Sealing member 46 is pivoted to open position 50 because a net force 64 is acting on sealing member 46 to move sealing member 46 toward open position 50. In this example, net force 64 is a net combination of gravitational force 60 and bias force 62. Because gravitational force 60 exceeds bias force 62, net force 64 is directed downward in this example.

Preferably, sealing member 46 and, or conduit 22 and, or opening 36 and, or cover 33 are arranged to not significantly obstruct or adversely reduce the flow of breathable air into and out of opening 36 when sealing member 46 is in open position 50. Preferably, at least one or more of these portions are arranged to permit sufficient flow rates and flow volumes to permit efficient inhalation and exhalation with relatively low work of breathing. Preferably, such work of breathing is arranged to be sufficiently low enough to permit efficient and comfortable inhaling and exhaling as well as sufficient supply of breathable air during high ventilation rates such as occurring during high levels of exertion such as when swimming at high rates of speed, swimming against a strong current or breathing strongly for fresh air after a surfacing from relatively long breath hold subsurface dive. In this example, conduit 22 near and at opening 36 is preferably relatively aligned with the longitudinal alignment of conduit 22 and preferably avoids and preferably avoids excessive bending in conduit 22 that could result in increased breathing resistance and flow efficiency. Preferably, sealing member 46 in open position 50 is displaced laterally from the longitudinal axis of conduit 22 so as to provide reduced interference or obstruction, or even eliminated interference or obstruction with the flow of air through opening 36 while sealing member 46 is in open position 50.

However, in alternate embodiments, conduit 22 near opening 36 may have any orientation or degree of bend and, or sealing member 46 may have any positioning, proximity and or orientation relative to opening 36 during open position 50.

Dry top 38 is seen to have a lower end 66 that is preferably arranged to be removably attachable to snorkel 20 in any suitable manner and preferably forms an extension of conduit 22; however, in alternative embodiments, lower end 66 may be permanently attached to conduit 22, molded integrally with conduit 22, may have any positioning on or off of conduit 22, may be the lower end of cover 33, or may be any lower region of any suitable configuration or form of dry top 38. Lower end 66 may be connected to snorkel 20 in any suitable manner using any suitable mechanical and, or chemical bond.

Figure 2:
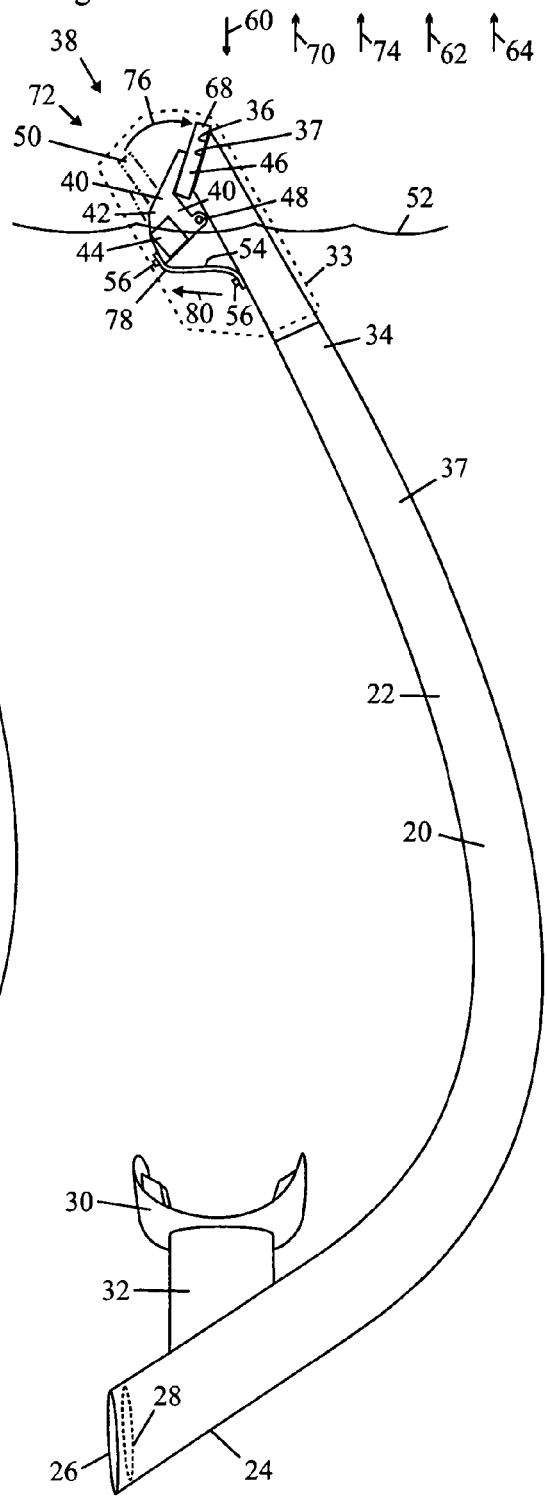
FIG. 2 shows a front view of the same snorkel in FIG. 1, except that in FIG. 2 the dry top is closed.

FIG. 2 shows a front view of the same snorkel in FIG. 1, except that in FIG. 2 dry top 38 is in a closed position 68 in which sealing member 46 contacts and seals opening 36. Because at least a portion of float 44 is below surface 52 of the water, a predetermined net buoyancy force 70 is exerted upon sealing member 46 to the predetermined buoyancy of float 44, pivoting arm 42, sealing member 46 and bias member 54. Preferably, pivoting arm 42, float 44 and, or sealing member 46 and, or bias member 54 is (or are) arranged to cause predetermined net buoyancy 70 to oppose net gravitational force 60 in an amount sufficient to permit the combination of buoyancy force 70 and bias force 62 to exceed gravitational force 60 in an amount effective to cause net force 64 (which now also includes buoyancy force 70) to push sealing member 46 toward closed position 68 when at least a portion of sealing member 46, arm 42, float 44 or bias member 54 experiences a predetermined amount of submersion below surface 52 of the water.

Any portion of dry top 38 or snorkel 20 that contributes toward net force 64 exerted upon sealing member 46 shall be referred to as an active portion 72. For example, in the embodiments of FIGS. 1 and 2, sealing member 46, arm 42, guiding member 40, float 44, bias member 54 and connection members 56 are included in active portion 72 because all these parts are connected in an active manner to sealing member 46 so as to contribute to the vector addition that creates net force 64. Buoyancy force 70 is created by a combination of the combined specific gravity of all parts within active portion 72, which is equivalent to the non-buoyed weight of active portion 72 and the overall amount of water displaced by active portion 72 as active portion 72 is submerged below surface 52 of the water. Similarly, net gravitation force 60 upon active portion 72 is the sum of the gravitational forces of all parts of active portion 72.

The combination of net gravitational force 60 and net buoyancy force 70 creates a net weighted force 74 on active portion 72. In this example, net weighted force 74 is arranged to be directed upward to assist in moving sealing member 46 from open position 50 (shown by broken lines) to closed position 68. Net weighted force 74 combines with bias force 62 to create overall net force 64. In this example, both net weighted force 74 and bias force 62 are seen to be directed upward to cause net force 64 to be directed upward. In alternate embodiments, net weighted force 74 can be arranged to be upwardly directed while net bias force 62 is directed upward with maximized force (that has a vertical component that is still preferably less than gravitational force 60 in a vertical direction) directed upward with reduced or minimized force, directed substantially sideways to urge sealing member 46 toward closed position 68 with a reduced or even eliminated vertical vector component, eliminated entirely or even directed to reduce net weighted force 74 provided that preferably net weighted force 74 dominates over bias force 62 to cause net force 64 to urge sealing member 46 from opening position 50 toward closed position 68 along a closing direction 76 when at least a portion of active portion 72 is submerged below surface 52 of the water.

In still other embodiments, bias force 62 can be arranged to be sufficiently strong in an upward direction so that net weighted force 74 is downwardly directed to oppose bias force 62 while bias force 62 is arranged to exceed net weighted force 74 so that net force 64 remains upwardly directed so that sealing member 46 is urged toward closed position 68 when at least a portion of active portion 72 is submerged below surface 52 of the water. In some embodiments, bias force 62 can be arranged to be sufficiently strong enough to permit net buoyancy force 70 on active portion 72 be arranged to be reduced, only slightly positive, neutral, slightly negative or even significantly negative. Preferably, if buoyancy force 70 on active portion 72 is arranged to be negative or downwardly directed, then bias force 62 is arranged to be stronger than such a negative buoyancy force 70 to cause net force 64 to be upwardly directed so as to urge sealing member toward closed position 68 during submersion. Consequently, if net weighted force 74 is arranged to have a reduced directed upward magnitude, substantially neutral, or directed downward to oppose bias force 62, then bias force 62 can be proportionally increased. This can permit bias force 62 to move sealing member 46 to closed position 68 during submersion and, or when upper portion 34 of snorkel 20 is oriented in non-vertical directions where gravitational force 60 and buoyancy force 70 produce net weighted force 74 having a vector component that has a reduced magnitude in closing direction 76, a substantially neutralized magnitude toward closing direction 76 or is oppositely directed to closing direction 76.

In addition, biasing force 62 and, or net force 64 that may include bias force 64 can be arranged to allow sealing member 46 to better maintain a sealed connection with opening 36 and, or re-establish a sealed connection with opening 36 if the swimmer exhales and causes sealing member 46 to move away from opening 36 and, or the relative suction force within snorkel 20 is reduced or eliminated at depth. As the snorkel is submerged below surface 52 of the water, the air trapped within snorkel 20 by sealing member 46 can remain substantially near the atmospheric pressure at surface 52 while the ambient pressure in the surrounding water increases greatly with depth. This creates a pressure differential which creates a perceived suction force inside of snorkel 20 which can hold sealing member 46 in a sealed condition in many underwater orientations as long as net weighted force 74 does not oppose and exceed such suction force. Consequently, net force 64 can also include the vector addition of such a suction force, which can be substantially perpendicular to the plane of opening 36 and, or sealing member 46. However, such a suction force can be reduced or eliminated at depth by a variety of circumstances including an exhalation by the diver at depth; and therefore, while the methods of the present invention can use such a suction force to assist in keeping sealing member 46 in closed position 68 at depth, the methods of the present invention also provide additional methods for reinforcing, maintaining, or reestablishing closed position 68 even if such a suction force is not present or has been eliminated and snorkel 20 is in an orientation underwater in which net weighted force 74 is exerted on sealing member 46 in a direction does not urge sealing member 46 toward closed position 68 in closing direction 76 or opposes closing direction 76.

Furthermore, bias force 62 and, or net force 64 that may include bias force 62 can be arranged to permit sealing member 46 to maintain a sealed connection with opening 36 when the swimmer purges internal water and, or saliva from snorkel 20 through purge valve 28 under light positive internal air pressure relative to the ambient pressure of the surrounding water. Positive pressure created within snorkel 20 at depth can be created by an exhaling force from the swimmer to purge water and, or saliva through purge valve 28. Also, positive pressure within snorkel 20 at depth can be created by reducing or eliminating the suction force within snorkel 20 at depth and then ascending from such depth toward surface 53 so that the internal air pressure within snorkel 20 exceeds the external ambient pressure within the surrounding water. During such an ascent from reduced or eliminated internal suction force at depth, the internal air that has become pressurized at depth will expand upon ascending and if purge valve 28 is arranged to open with less resistance than net force 64 during such ascent, then water and, or saliva within snorkel 20 can be automatically expelled from snorkel 20 out purge valve 28 during such ascent without exhaling through such ascent. If positive pressure within snorkel 20 increases faster than water, saliva and, or air is expelled through purge valve 28 when purge valve 28 has less opening resistance than sealing member 46 under net force 64 in such a situation, then net force 64 can be arranged if desired to be sufficiently light to permit air to be automatically expelled through opening 36 during such ascent and then preferably permitting sealing member 46 to become automatically resealed against opening 36 after such excessive positive pressure is reduced to be below a predetermined level.

One of the benefits of the current embodiment is that biasing force 62 can be applied to pivoting arm 42 or any portion of active portion 24 at various distances from hinge member 48 and, or at different directions relative to the movement of various portions of active portion 72 to permit biasing force 62 to be exerted upon sealing member 46 at various levels of leverage or torque. Biasing force can be applied at a position along active portion 72 that is at a greater distance from hinge 48 and, or at a predetermined steeper angle to the movement of active portion 72 to create an increase in the resultant magnitude of biasing force 22 that is exerted upon sealing member 46. Similarly, biasing force can be applied at a predetermined position along active portion 72 that is at a reduced distance from hinge 48 and, or at a reduced predetermined angle relative to the movement of active portion 72 to create an reduction in the resultant magnitude of biasing force 72 that is exerted upon sealing member 46. This can permit the effect of biasing force 62 to be increased or decreased for a given configuration, arrangement or strength of bias member 54. In addition, the moment and magnitude of bias force 62 can be arranged to change significantly between open position 50 and closed position 68, change minimally or not change significantly or noticeably throughout this range of motion as desired. In addition, biasing member 54 can be arranged to have variable, changeable or multiple connection positions along active portion 72 that can be selected to increase or decrease biasing force 62 as desired by the manufacturer and, or consumer, or different models can be arranged to have different degrees of biasing force 62 for a given biasing member 54 and, or a given active portion 72. Also, the relative torques of gravitational force 60 and buoyancy force 70 can also be arranged to be applied at distances from hinge 48 relative to the torque of bias force 62 to permit a variety of vector additions in both magnitude and direction for adjusting and, or selecting the magnitude and, or direction of net force 64 during ordinary use or while snorkel 20 is oriented in different directions and orientations when submerged.

Preferably, active portion 72 is connected to snorkel 20 in an area that is outside of internal passageway 37 and, or separated from internal passageway 37 so as to not obstruct, create resistance or interfere with the flow of air into and, or out of opening 36. Preferably bias member 54 is connected to snorkel 20 in an area that is outside of internal passageway 37 and, or separated from internal passageway 37 so as to not be affected, or at least less affected by the flow of air into and, or out of opening 30 and, or the difference in pressure existing between internal passageway and the outside of snorkel 20 when snorkel 20 is submerged. However, in alternate embodiments, any portion of active portion 72 can be positioned inside of internal passageway 37 and, or opening 36 if desired.

In FIG. 2, bias member 54 is seen to be extended to an extended condition 78. This occurs as bias force 62 contributes toward net force 64 as active portion submerges below surface 52 of the water and causes active portion 72 to move toward closed position 68. Preferably, bias member 54 is arranged to store elastic tension while in contracted condition 58 as shown in FIG. 1 and such elastic tension causes bias member 54 to extend to extended condition 78 and push active portion 72 toward closed position 68 when net weighted force 74 is reduced by the submersion of active portion 74 below surface 52 of the water.

Preferably, biasing force 62 is arranged to permit sealing member 46 to press against and seal against opening 36 when snorkel 20 is in orientations in which net weighted force 74 is insufficient to move sealing member 46 to closed position 68 or when net weighted force 74 opposes closing direction 76.

When comparing contracted condition 58 in FIG. 1 to extended condition 78 in FIG. 2, FIG. 2 shows bias member 54 moves in an extended direction 80 and that bias force is exerted on pivoting arm 42 in extended direction 80. As stated previously, bias force 62 is shown as being directed vertically to illustrate the vertical component of bias force 62 created by pivotal motion around hinge 48 so that vector addition in a vertical direction can be illustrated. Bias force 62 shown in a vertical direction can also created by the vertical component of extended direction 80 as well as any bends within bias member 54 that can apply elastic tension along the length or at an angle to the alignment of bias member 54. The examples in FIGS. 1 and 2 show bias member 54 to have at least one bend; however, in alternate embodiments, bias member 54 can be arranged to have any number of bends, a single bend or no bend at all during at least one position between open position 50 and closed position 68.

In this embodiment, extended direction 80 of bias member 54 is seen to be at an angle to the longitudinal axis of conduit 22. In this embodiment, extended direction 80 of bias member 54 is seen to be at an angle to closing direction 76. In this example, extended direction 80 of bias member 54 is arranged to have a substantially opposite to closing direction 76 of sealing member 46 toward closed position 68. In alternate embodiments, extended direction 80 and, or bias force 62 may occur in any suitable direction relative to conduit 22, opening 36, closing direction 76 and, or snorkel 20.

Figure 3:
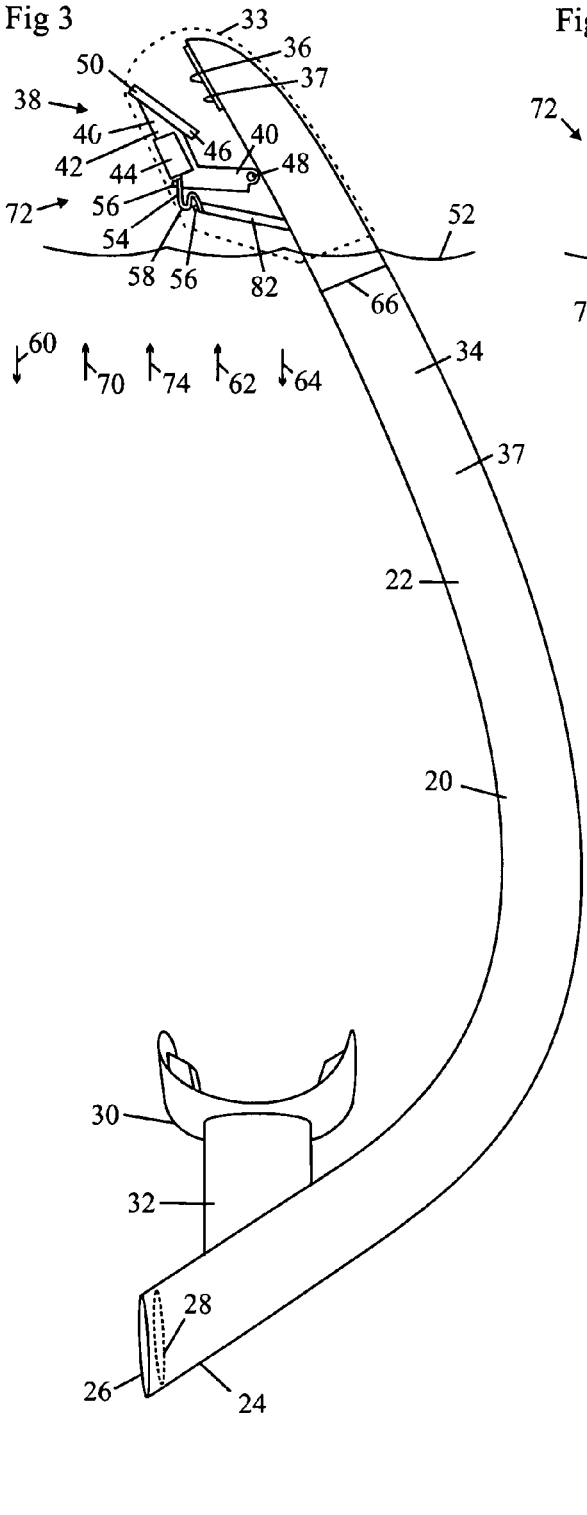
FIG. 3 shows a front view of a snorkel having a dry top that is open.
Figure 4:
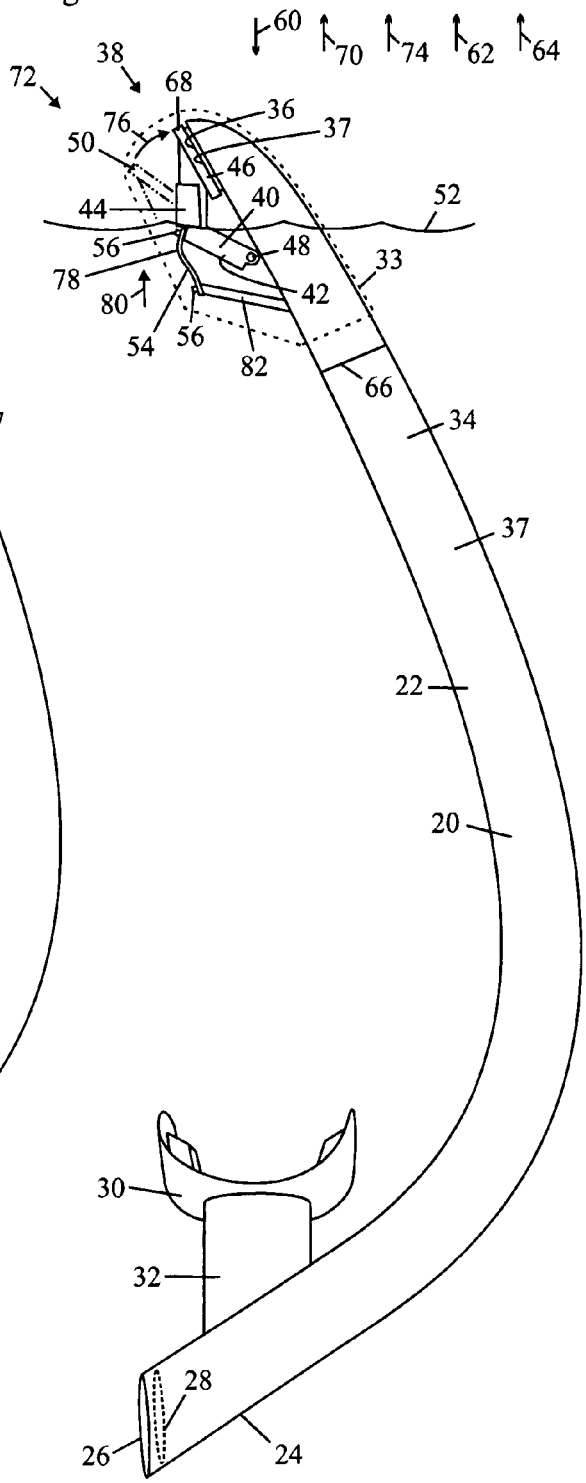
FIG. 4 shows a front view of the same snorkel in FIG. 3, except that in FIG. 4 the dry top is closed.

FIG. 3 shows a front view of alternate embodiment of snorkel 20 with dry top 38 in open position 50. This embodiment is similar to the embodiment shown in FIGS. 1 and 2 with alterations. In FIG. 3, the plane of opening 36 is seen to be at a substantially perpendicular angle to the longitudinal direction of conduit 22. In alternate embodiments, the plane of opening 36 can be at any desired angle relative to the longitudinal direction of conduit 22 near opening 36. Conduit 22 is seen to curve in a substantially lateral direction near the upper portion of opening 36. Bias member 54 is seen to be connected to a support member 82, which in this example extends laterally from conduit 22. In alternate embodiments, support member 82 may be connected to any portion of snorkel 20 or dry top 38 and may be a portion of cover 33 rather than a direct connection to conduit 22. In this embodiment, contracted condition 58 of bias member 54 is seen to have an S-shaped form; however, in alternate embodiments, contracted condition 58 of bias member 54 may occur in any shape, arrangement, configuration or form. In this example, the S-shaped configuration is created by horizontally offsetting the alignments of connection member 56 on pivoting arm 42 and connection member 56 on support member 56 while also arranging the alignments of the opposing ends of bias member 54 to be substantially parallel. Such a configuration can focus the elastic tension within bias member 54 so that biasing force 62 is exerted in a substantially consistent manner as bias member 54 extends in extended direction 80 as shown in FIG. 4. In FIG. 4, support member 82 is seen to be arranged to permit bias member 54 to extend in extended direction 80 that is vertically oriented.

FIG. 5 shows a perspective side view of an alternate embodiment dry top 38 connected to upper portion 34 of snorkel 20. Cover 33 of dry top 38 is seen to have a series of vents 84 for ventilating dry top 38 during inhaling, exhaling or clearing water from snorkel 20. Vents 84 are arranged to be on the lateral sides of cover 33 to provide splash protection so as to deflect splashing water away from opening 36 (not shown) inside of cover 33; however, in alternate embodiments, vents 84 can have any positioning, location, shape, size, number, arrangement, configuration, alignment or form. Cover 33 is preferably connected to snorkel 20 with a connection 86, which in this example includes at least one recess 88 in cover 33 and at least one pin 90 that extends outward from conduit 22 and inserts into at least one recess 88 to lock in place and preferably provide a removable attachment. In alternate embodiments, connection 86 can be any suitable mechanical and, or chemical bond that is either removable or substantially permanent.

Figure 6A:
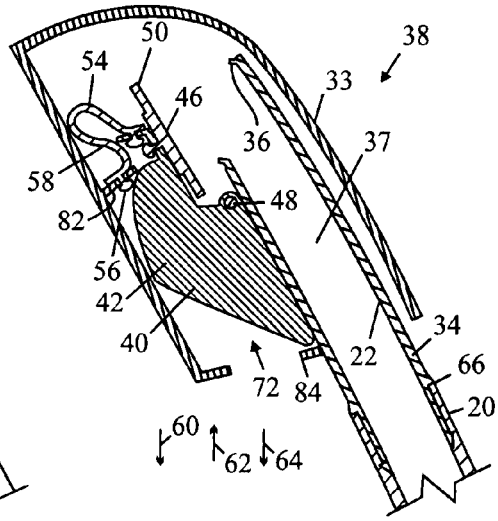

FIGS. 6*a* to 6*d* show cross section view taken along the line 6-6 in FIG. 5 under varying conditions. FIG. 6*a* shows a cross section view of dry top 38 when dry top 38 is above the surface (not shown) of the water and in open position 50. Preferably, at least one vent 84 is arranged to be positioned at the lower end of cover 33 as shown or at least near such lower end in order to permit water to enter dry top 38 as soon as possible when becoming at least partially submerged or when struck by waves. In this embodiment, pivoting arm 42 is preferably relatively thick, elongated and, or large to increase its mass and is preferably made with a material that is sufficiently more dense than water to permit gravitational force 60 on active portion 72 to exceed bias force 62 and to permit bias force 62 to be relatively stronger than would occur if pivoting arm 42 were made with a smaller volume of material and, or a material having a lower specific gravity. In addition, the preferred increased specific gravity and, or increased volume and, or increased mass of pivoting arm 42 can permit dry top 38 to have a narrower and more streamlined lateral profile. This is because such increased mass can permit a similar or increased gravitational force 60 about hinge 48 to be created with a reduced distance from hinge 48 and such a reduced distance can allow the overall lateral dimensions of dry top 38 to be significantly reduced to provide a more hydrodynamic and efficient shape for swimming. Consequently, it is preferred that pivoting arm 42 (which is a movable member) or any alternate embodiment of a movable member and, or any embodiment of active portion 72 as a whole can be arranged to have a specific gravity that is denser than water and can be made with a relatively dense thermoplastic material, a corrosion resistant metal, a combination of both, or any other suitable material or combinations of material. In other embodiments, any portion of active portion 72 and or active portion 72 as a whole can be arranged to have a specific gravity that is equal to water so as to be non-buoyant in water. In other embodiments, any portion of active portion 72 and or active portion 72 as a whole can be arranged to have a specific gravity that is slightly less than water or significantly less than water to create buoyancy force 70. Preferably, any portion of active portion 72 and or active portion 72 as a whole can be arranged to have a density that is substantially equal to 1 gram per cubic centimeter, 1.01 grams per cubic centimeter, 1.02 grams per cubic centimeter, 1.03 grams per cubic centimeter, 1.04 grams per cubic centimeter or 1.05 grams per cubic centimeter.

In FIG. 6*a*, lower end 66 of dry top 38 is seen to mate with conduit 22 below lower end with a mechanical connection in which lower end 66 is inserted into conduit 22; however, in alternate embodiments, any portion of dry top 38 can be connected to any portion of snorkel 20 in any suitable manner. In this embodiment, bias member 54 is seen to be directly connected to sealing member 46 and is also connected to an upper portion of cover 33; however, in alternate embodiments bias member 54 can be connected to any portion of active portion 72 and any portion of dry top 38 and, or snorkel 20. In this embodiment, bias force 62 can be applied directly to sealing member 46 and bias member 54 can be positioned above a major portion of active portion 72.

Figure 6B:
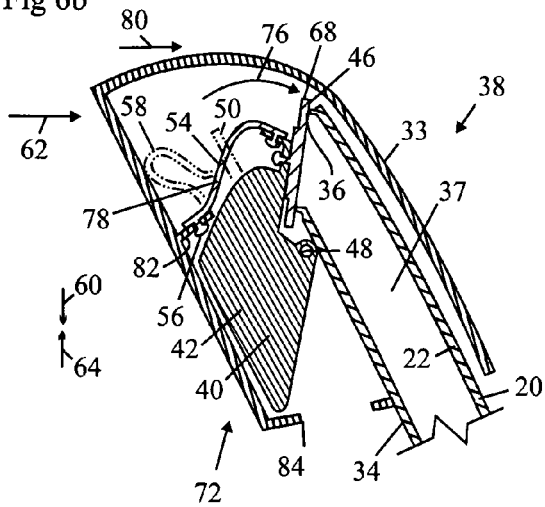

In FIG. 6*b*, dry top 38 is in the same orientation as in FIG. 6*a*, except that in FIG. 6*b* at least a portion of active portion 72 is submerged. In this embodiment, no float is necessary and pivoting arm 42 and, or active portion 72 cumulatively, is preferably arranged to have an overall specific gravity that is relatively equal to or greater than the specific gravity of water rather than being buoyant. In versions in which the specific gravity of active portion 72 is equal to water and not buoyant, active portion would be relatively weightless in water and would not be able to push up on arm 42 to close sealing member 46 to closed position 68 on its own; however, bias force 62 from bias member 54 would urge sealing member 46 to closed position 68 without the need for a an upward floating force to achieve closed position 68. Because pivoting arm 42 and, or active portion 72 would be relatively weightless, bias force 62 applied by bias member 54 will urge sealing member 46 to closed position 68 in absolutely any orientation under water even if there is littler or no pressure difference between the inside and outside of snorkel 20, such as if the swimmer exhaled at depth. Furthermore, sealing member 46 will automatically reestablish closed position 68 even if the swimmer exhales firmly to cause sealing member 46 to move away from opening 36 and temporarily lose closed position 68, regardless of the orientation of the swimmer, including any inverted, inclined or angled orientation.

In version in which the specific gravity of active portion 72 is cumulatively greater than the specific gravity of water, active portion 72 is preferably arranged to be heavier than water to create a downward force on sealing member 46 while in the orientation shown in FIG. 6*b*; however, it is preferred that higher specific gravity is arranged to create a downward force while submerged that is less than the downward force when out of the water. This can allow bias force 62 to be arranged to exceed any downward force created by active portion 72 while submerged while bias force 62 is also arranged to be less than any downward force created by active portion 72 when active portion is out of the water and substantially upright in orientation for providing comfortable and efficient breathing above water. Because the specific gravity of active portion 72 is arranged to create a downward force while submerged that is less than bias force 62, bias force 62 will override such downward force and close sealing member 46 to closed position 68 regardless of the orientation underwater. In alternate embodiments, the specific gravity of active portion 72 and bias force 62 can be arranged to permit sealing member 46 to be urged toward closed position 68 with a greater net force in some orientations that others or may be arranged to move toward open position 50 in certain swimming orientations underwater in the absence of a significant suction force within snorkel 20 and still provide significant improvements in overall performance. However, it is preferred that the specific gravity and mass of active portion 72 and bias force 62 be arranged to urge sealing member 46 to closed position 68 regardless of the underwater orientation and without a need for a pressure difference between the inside and outside of snorkel 20 in order to achieve closed position 68. It is also preferred that active portion 72 be arranged to be significantly heavy out of the water so that the downward component of the weight of active portion 72 out of the water exceeds bias force 62 but allows bias force 62 to be sufficiently high in comparison to such downward component of weight generated by active portion 72 out of the water so that bias force 62 can be arranged to be sufficiently strong enough to close sealing member 46 to closed position 68 with significant efficiency when active portion 72 is submerged and then significantly controlled by bias member 54 and bias force 62.

FIG. 6*b* also shows that bias member 54 extends in extended direction 80, which has an alignment that is at a significant angle to the lengthwise alignment of conduit 22.

Figure 6C:
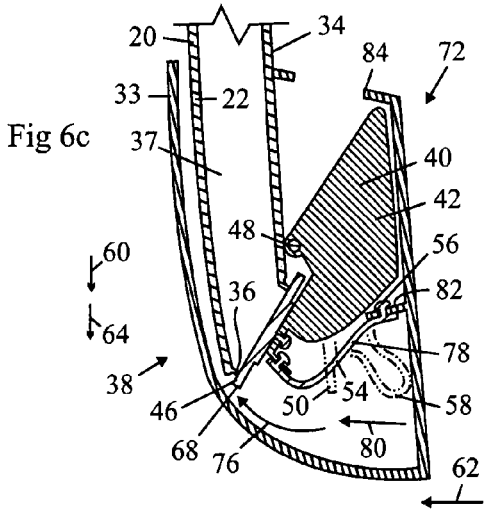
Figure 6C:
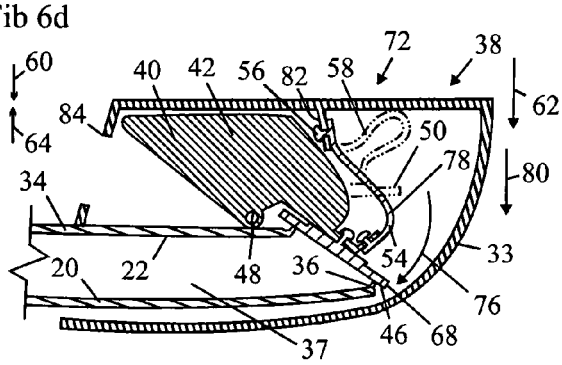

FIG. 6*c* shows the same dry top 38 as shown in FIGS. 5 to 6*b* except that in FIG. 6*c* dry top 38 is inverted under water to show that sealing member 46 is urged to closed position 68 in this orientation.

FIG. 6*d* shows the same embodiment as shown in FIG. 6*c* except that dry top 38 is oriented in a substantially horizontal position and sealing member 46 is urged toward closed position 68 by bias member 54 in this orientation even if there is no relative suction force inside of snorkel 20. Even if closed position 68 is temporarily lost, bias force 62 can be arranged to automatically reestablish closed position 68.

Figure 6E:
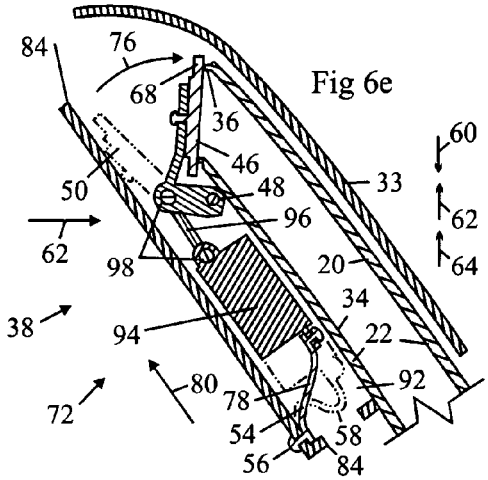

In the embodiment shown in FIG. 6*e*, a guiding portion 92 is arranged to permit portions of active portion 72 to be slidably supported in a direction that is substantially parallel to the alignment of conduit 22. In this embodiment, guiding portion 92 is positioned in an area that is outside of passageway 37 and separated from passageway 37. In this embodiment, guiding portion 92 is an interior portion of dry top 38 in which portions of active portion 72 can slide between cover 33 and conduit 22, and is positioned outside of internal passageway. However, in alternate embodiments guiding portion 92 can be any interior and, or exterior portion of conduit 22, dry top 38, cover 33, snorkel 20 or any structure or region connected to snorkel 22 and, or dry top 38. In alternate embodiments, guiding portion 92 many have any desired alignment and, or any suitable path of movement including relatively straight paths of movement, relatively curved paths of movement or pivotal paths of movement. Guiding portion 92 which can also be referred to as guiding member 92, may include any member, members, structures, contours, supporting structures or guiding structures used to guide any portion of active portion 72 in any embodiment or suitable variation.

Pivoting arm 42 is seen to extend a relatively small lateral distance from hinge 48 and is pivotally connected to a weighted member 94 with a linkage member 96. Preferably, linkage member 96 is connected to pivoting arm 42 and, or weighted member 94 with at least one pivotal connection 98. The relatively small lateral length of pivotal arm 42 from hinge 48 in this embodiment permits dry top 38 to have a significantly narrow and slender lateral profile for increased hydrodynamic efficiency and reduced drag during underwater diving. Because weighted member 94 and linkage member 96 are arranged to apply force vectors on pivotal arm 42 at least when a portion of active portion 72 is out of the water, weighted arm 94 and linkage member 96 are included as participating portions of active portion 72 and can cause pivoting arm 42 and sealing member to pivot to open position 50 when dry top 38 is substantially upright and out of the water. Weighted member 94 is preferably arranged to exert an equivalent or increased amount of weight on arm 42 with a reduced lateral profile. Weighted member 94 can be made with any suitable material that is preferably denser than water, or similar in specific gravity in water to have no positive buoyancy, to be non-buoyant, to be weightless in water, to have neutral buoyancy, or to be negatively buoyant. In alternate embodiments, weighted member 94 can be arranged to be slightly positively buoyant in water or significantly buoyant in water. Examples of some preferred suitable materials can include any suitable thermoplastic material or metal or any combination of such materials.

In this embodiment, bias member 54 is connected between arm 42 and conduit 22 and is shown in contracted condition 58; however, in alternate embodiments bias member 54 can be connected between any portion of active portion 72 and snorkel 20 in any manner or may be not used at all if desired.

The methods of the present invention for arranging the strength and direction of bias member 54 can permit sealing member 46 to automatically move to closed position 68 when dry top 38 is tilted significantly away from an upright orientation and, or at least partially submerged under water, without the need for a float, a hollow member or a buoyant upward force. However, in alternate embodiments, weighted member 94 can have a hollow portion, an attached float or buoyant member arranged to adjust and select the cumulative specific gravity of weighted member 94 and, or active portion 72. For example, a combination of heavy material such as a dense thermoplastic or metal can have a hollow portion or an attached float to cause active portion 72 to have a cumulative specific gravity that is arranged to be significantly greater than, slightly greater than or substantially equal to the specific gravity of water so that such hollow portions do not cause active portion 72 to float or ascent when submerged in water, but cause active portion 72 to sink quickly, slowly, slightly or be substantially weightless in water. In other embodiments in which active portion 72 is arranged to have a cumulative specific gravity that is less than water, bias member 54 and bias force 62 can be used to significantly improve the performance of such embodiments, increase the number of orientations that can achieve, maintain or reestablish a water tight seal at depth.

In any of the embodiments of this specification or any other alternate embodiments, the methods of the present invention can be arranged to close sealing member 46 to closed position 68 when dry top 38 is at any orientation other than a substantially vertical orientation whether dry top 38 is being submerged underwater or not, if desired. This is because the vertical component of gravitational force 60 (not shown) is reduced, eliminated or even reversed when dry top 38 is tilted significantly away from a substantially upright orientation to a substantially inclined orientation, a substantially horizontal orientation or a substantially inverted orientation. Preferably, bias force 62 is arranged to be relatively small in comparison to gravitational force 60 exerted on active portion 72 so that substantially upright orientations including significantly inclined orientations above a horizontal orientation cause the vertical component of gravitational force 60 to keep sealing member in open position 50 so that the swimmer can breath easily at the surface when snorkel 20 and, or dry top 38 are in a substantially wide variety of orientations above the surface of the water. This is one reason why the methods of the present invention include providing increased weight and, or leverage to active portion 72 while also providing sufficient bias force 62 to close sealing member 46 to closed position 68 when snorkel 20 and, or dry top 38 are placed in orientations or inclinations vulnerable to water entry, not best suited for normal breathing or when at least a portion of active portion 72 is submerged. In alternate embodiments, a float may be used to provide a positive upward floatation force in addition to bias force 62 or instead of bias force 62 if desired.

FIG. 6*e* shows alternate embodiments of a cross section view taken along the line 6-6 in FIG. 5 to show additional potential variations. In the embodiment shown in FIG. 6*e*, pivoting arm 42 is seen to extend a relatively small lateral distance from hinge 48 and is pivotally connected to a weighted member 94 with a linkage member 96. Preferably, linkage member 96 is connected to pivoting arm 42 and, or weighted member 94 with at least one pivotal connection 98. The relatively small lateral length of pivotal arm 42 from hinge 48 in this embodiment permits dry top 38 to have a significantly narrow and slender lateral profile for increased hydrodynamic efficiency and reduced drag during underwater diving. Because weighted member 94 and linkage member 96 are arranged to apply force vectors on pivotal arm 42 at least when a portion of active portion 72 is out of the water, weighted arm 94 and linkage member 96 are included as participating portions of active portion 72 and can cause pivoting arm 42 and sealing member to pivot to open position 50 when dry top 38 is substantially upright and out of the water. Weighted member 94 is preferably arranged to exert an equivalent or increased amount of weight on arm 42 with a reduced lateral profile. Weighted member 94 can be made with any suitable material that is preferably denser than water, or similar in specific gravity in water so as to be non-buoyant, weightless in water, or arranged to sink when submerged. In alternate embodiments, weighted member 94 can be arranged to be slightly positively buoyant in water or significantly buoyant in water. Examples of some preferred suitable materials can include any suitable thermoplastic material such as ABS, PVC, polypropylene or other suitable thermoplastic or any suitable metal such as stainless steel or aluminum, or any combination of different materials and, or different parts. The overall function is similar to the other embodiments of FIGS. 6*a* to 6*d*.

In this embodiment, bias member 54 is connected between arm 42 and conduit 22 and is shown in contracted condition 58; however, in alternate embodiments bias member 54 can be connected between any portion of active portion 72 and snorkel 20 in any manner or may be not used at all if desired.

In FIG. 6*e*, cover 33 has vents 84 in both the upper portion and lower portion of dry top 38. Vent 84 at the upper portion of cover 33 and the position of sealing member 46 in open position 68 is arranged to provide substantially unobstructed airflow into and out of opening 36 of snorkel 20. Also, a gap is seen to exist between the lateral sides of cover 22 and conduit 22 and this can permit splashing water or droplets of water to run down the interior walls of cover 33 in between cover 33 and conduit 22 and drain out the bottom of cover 22 so as to prevent such splashing water from entering opening 36 when sealing member 46 is in open position 68.

FIG. 7 shows a perspective side view of an alternate embodiment dry top connected to the upper portion of a snorkel.

FIGS. 8*a* to 8*r* show alternate embodiments of a cross section view taken along the line 8-8 in FIG. 7. The embodiments in FIGS. 8*a* to 8*f* are seen to be similar to the embodiment in FIG. 6*e*, except that in FIGS. 8*a* to 8*f* no bias member or bias force is used. In this the embodiments in FIGS. 8*a* to 8*f* float 44 is added.

In FIG. 8*a*, dry top 38 is substantially upright and out of the water (not shown) so that sealing member 46 is in open position 50. Float 44 is at the lower portion of guiding portion 92 as it is above the water (not shown) and float 44 is seen to be separate from weighted member 94 and is not an active part of active portion 72 in this situation. The weight from active portion 72 urges sealing member 46 to open position 50. Guiding portion 92 is arranged to slidably support weighted member 94 and, or float 44 in a guided direction 100. In this embodiment, guided direction 100 is substantially aligned with the longitudinal alignment of conduit 22 and is seen to be oriented at an angle to closing direction 76; however, in alternate embodiments, guided direction 100 may be aligned at any angle relative to the alignment of conduit 22, dry top 39, opening 36, closing direction 76 or any other portion of snorkel 20.

FIG. 8*b* shows the same view as in FIG. 8*a* except that in FIG. 8*b* at least a portion of active portion 72 has been submerged and float 44 has moved up against weighted member 94 to an active position 102 and moved away from an inactive position 104 at the lower portion of guiding portion 92. Float 44 has become an active part of active portion 72 as buoyancy force 70 presses upward on active portion 72 to move sealing member 46 from open position 50 to closed position 68. In this embodiment, it is preferred that buoyancy force 70 of float 44 sufficiently exceeds gravitational force 60 of active portion 72 so that net force 64 moves float 44 and active portion 72 toward closed position 76 when at least a portion of active portion 72 is submerged. In this embodiment, linkage member 96 is arranged to be made with a relatively stiff material with pivoting connections 98; however, in alternate embodiments, linkage member 96 may have any type of connection, form, shape, flexibility, material or combinations of material, or configuration, and may also be a relatively flexible strip, string or chord or any other suitable form.

In FIG. 8*c*, dry top 38 is inverted underwater with opening 36 oriented below conduit 22. Float 44 is seen to have moved upward and away from weighted member 94 from active position 102 (shown by broken lines) to inactive position 104 that is not an active part of active portion 72 in this view. Buoyancy force 70 is not exerted on active portion 72 and gravitational force 60 closes sealing member 46 to closed position 68 without opposition from buoyancy force 70. If the relative suction force within snorkel 20 were to be reduced or eliminated or if sealing member 46 were moved away from closed position 68, gravitational force 60 would allow sealing member 46 to maintain or reestablish closed position 60.

FIGS. 8*d* to 8*f* show the same views as FIGS. 8*a* to 8*c*, respectively, except that the relative positions of float 44 and weighted member 94 are reversed in the alternate embodiment shown in FIGS. 8*d* to 8*f*.

In FIG. 8*d*, float 44 is seen to be connected to linkage member 96 and linkage member 96 is pivotally connected to pivoting arm 42 so that float 44 is always an active part of active portion 72. Float 44 is not submerged in this view and gravitational force 60 of active portion 72 urges sealing member 46 to open position 50. Weighted member 94 is seen to be in inactive position 104 in this embodiment and in this situation.

In FIG. 8*e*, at least a portion of active portion 72 has been submerged under water (not shown) to cause buoyancy force 70 to be generated by float 44 to push active portion 72 toward closed position 68. Because weighted portion 94 is not connected to active portion 72 and is in inactive position 104, gravitational force 60 from weighted member 94 is not exerted on active portion 72. In this embodiment, it is preferred that buoyancy force 70 from float 44 exceeds gravitational force 60 generated by active portion 72 so that net force 64 closes sealing member 46 to closed position 68 during submersion.

In FIG. 8*f*, dry top 38 is in an inverted orientation underwater in which opening 36 is substantially below conduit 22. Gravitation force 60 on weighted member 94 causes weighted member 94 to move downward along guided portion 92 from inactive position 104 to active position 102 and contacts float 44 to become an active part of active portion 72. Gravitational force 60 on active portion 72 (including weighted member 94 in this orientation) is preferably arranged to be greater than buoyancy force 70 exerted on float 44 and, or active portion 72 so that gravitational force 60 on active portion 72 urges sealing member 46 to closed position 68. This can permit sealing member 46 to maintain or reestablish closed position 68 if the relative internal suction force is reduced, eliminated or if sealing member 46 is moved away from closed position 68.

FIGS. 8*g* to 8*i* are show alternate embodiment cross section views along the line 8-8 in FIG. 7 and are similar to those shown in FIGS. 8*a* to 8*f*, except that in FIGS. 8*g* to 8*i* weighted member 94 and float member 44 are seen to be separated from pivoting arm 42.

In FIG. 8*g*, at least a portion of dry top 38 is substantially above the surface of the water (not shown). This prevents float 44 from being buoyed up against pivoting arm 42. Float 44 and weighted member 94 are in inactive position 104 and are not an active part of active portion 72 in this situation as neither of these parts are arranged to exert a force upon active portion 72. Both Gravitational force 60 on active portion 72, which includes pivoting arm 42 and sealing member 46 in this embodiment, urges sealing member 46 to open position 50.

In FIG. 8*g*, the upper portion of weighted member 94 is seen to be oriented at an angle the lower portion of weighted member 94. This can be used as a method to increase torque and apply leverage to the outer region of pivoting arm 42 as weighted member 94 contacts such outer portion of pivoting arm 42. If such an arrangement is used, it is preferred that weighted member 94 is arranged to not twist substantially around a longitudinal axis relative to guiding portion 92 and direction 100 so that such weighted member 94 can substantially maintain a desired orientation. In alternate embodiments, arm 42 can be arranged to have an extended region that extends downward from an outer portion of arm 42 to contact weighted member 94 when weighted member is arranged to have a relatively flat or symmetrical upper portion. Any suitable variation may be used. In alternate embodiments, any portion of weighted member 94 can be arranged to contact any portion of pivoting arm 42, any portion of active portion 72 or any other suitable structure.

In FIG. 8*h*, float 44 is seen to be positioned below weighted member 94 from this view and is sent to push upward against weighted member 94 so as to move both float 44 and weighted member 94 from inactive position 104 to active position 102 to become an active part of active portion 72 in which weighted member 94 contacts pivoting arm 42 and pivots active portion 72 to closed position 68. In this embodiment, it is preferred that buoyancy force 70 from float 44 is arranged to exceed gravitational force 60 of active portion 72, which now includes float 44 and weighted member 94 in this position.

In FIG. 8*i*, dry top 38 is seen to be in a substantially inverted orientation while submerged so that float 44 moves from active position 102 to inactive position 104 along direction 100 and away from active portion 72 so that float 44 is not an active part of active portion 72 in this orientation. This can prevent buoyancy force 70 on float 44 from being exerted on active portion 72 in this orientation so that buoyancy force 70 does not pull sealing member 46 toward open position 50 (shown by broken lines). Gravitational force 60 on weighted member 94 pushes weighted member 94 down against arm 42 so that weighted member 94 is an active part of active portion 72 and gravitational force 60 of the entire active portion 72 urges active portion 72 toward closed position 68. This can permit sealing member 46 to maintain or reestablish closed position 68 if the internal relative suction force is reduced or eliminated or if sealing member 46 is temporarily moved away from closed position 68, such as from an exhale of the diver or another force.

FIGS. 8*j* to 8*l* are similar to the views and embodiments shown in FIGS. 8*g* to 8*i*, respectively, except that the relative positions of float 44 and weighted member 94 are reversed. In FIGS. 8*j* to 8*l*, float 44 is positioned above weighted member 94 relative to an upright orientation of dry top 38.

In FIG. 8*j*, float 44 is above weighted member 94 and both of these parts are in inactive position 104 along guiding portion 92 and are not an active part of active portion 72 as they are separated from active portion 72 while dry top 38 is substantially upright and out of the water. Gravitational force 60 on active portion 72 urges active portion 72 to open position 50 in this substantially upright orientation in which at least a significant portion of dry top 38 is above the surface of the water (not shown).

In FIG. 8*j*, the upper portion of float 44 is seen to be oriented at an angle the lower portion of float 44. This can be used as a method to increase torque and apply leverage to the outer region of pivoting arm 42 as float 44 contacts such outer portion of pivoting arm 42. If such an arrangement is used, it is preferred that float 44 is arranged to not twist substantially around a longitudinal axis relative to guiding portion 92 and direction 100 so that such float 44 can substantially maintain a desired orientation during use. In alternate embodiments, arm 42 can be arranged to have an extended region that extends downward from an outer portion of arm 42 to contact float 44 when float 44 is arranged to have a relatively flat or symmetrical upper portion. Any suitable variation may be used. In alternate embodiments, any portion of float 44 can be arranged to contact any portion of pivoting arm 42, any portion of active portion 72 or any other suitable structure.

In FIG. 8*k*, at least a portion of dry top 38 is submerged and buoyancy force 70 on float 44 and float 44 is arranged to move float 44 from inactive position 104 to active position 102 in which float 44 is an active part of active portion 72. It is preferred that buoyancy force 70 on float 44 is arranged to exceed gravitational force 60 on active portion 72 so as to move active portion 72 from open position 50 (shown by broken lines) to closed position 68 when at least a portion of active portion 72 is submerged. Weighted member 94 is not attached to active portion 72 in this orientation and is in inactive position 104 and is not an active part of active portion 72 in this orientation. Gravitational force 60 on weighted member 94 is not exerted on active portion 72 and does not act to pull sealing member 46 away from closed position 68.

In FIG. 8*l*, dry top 38 is seen to be in a substantially inverted orientation. Gravitational force 60 on weighted member 94 moves weighted member 94 downward in this view along direction 100 from inactive position 104 to active position 102 and pushes downward on float 44. This causes float 44 to be pushed downward against arm 42 so that weighted member 94 and float 44 become an active part in active portion 72 to urge active portion 72 toward closed position 68. Preferably, gravitational force 60 on weighted member 94 is arranged to exceed buoyancy force 70 on float 44 so that float 44 and weighted member 94 move to active position 102 and urge active portion toward closed position 68. In alternate embodiments, gravitational force 60 on weighted member 94 can be sufficiently close to or equal to buoyancy force 70 on float 44 so that gravitational force 60 on arm 42 and sealing member 46 can close active portion 42 to closed position 68 without the need of any additional forces or participation of float 44 and, or weighted member 84. In other embodiments, gravitational force 60 on weighted member 94 can be arranged to be less that buoyancy force 70 on float 44 so as to permit float 44 to move away from active portion 72 in at least one inverted orientation. In other embodiments, weighted member 94 can be eliminated entirely and pivoting arm 42 and, or sealing member 46 can be arranged to generate gravitational force 60 sufficient to permit net force 64 on active portion 72 to urge sealing member 46 toward closed position 68 as float 44 moves away from arm 42 and active portion 72 so that float 44 does not exert buoyancy force 70 on active portion 72 in at least one substantially inverted orientation.

FIGS. 8*m* to 8*r* show alternative embodiment cross section views taken along the line 8-8 in FIG. 7. FIGS. 8*m* to 8*r* are similar to the embodiments and views in FIGS. 8*g* to 8*l*, respectively, except that float 44 and weighted member 94 are arranged to be pivotally connected to snorkel 22. In alternate embodiments, any portion of float 44 and, or weighted member 94 and, or pivoting arm 42 and, or linkage member 96 can be connected in any suitable manner to any portion of conduit 22 and, or snorkel 20 and, or dry top 38 and, or cover 33 and, or any other suitable structure or area.

In FIG. 8*m*, pivoting arm 42 is arranged to also be weighted member 94; however, in alternate embodiments, weighted member 94 can have a separate pivotal or slidable connection to any suitable portion of dry top 38 and, or snorkel 20. In FIG. 8*m*, float 44 is connected to conduit 22 with linkage member 96 having pivotal connections 98; however, linkage member 96 can have any suitable form and can be connected in any suitable manner to any portion of dry top 38 and, or snorkel 20. Float 44 is seen to be in inactive position 104 along guiding portion 92 and is not an active part of active portion 72 because dry top 38 is arranged to be substantially upright and out of the water (not shown) in this view and both float 44 and linkage member 96 are seen to be separate from pivoting arm 42 and active portion 72. This causes gravitational force 60 an active portion 72 to pull sealing member to open position 50.

In FIG. 8*n*, a sufficient amount of dry top 38 is submerged to permit buoyancy force 70 on float 44 to move from inactive position 104 to active position 102 and push upward on linkage member 96 to cause both linkage member 96 and float 44 to become an active part of active portion 72 as linkage member 96 contacts and pushes upward on arm 42 so that active portion 72 is moved from open position 50 (shown by broken lines) to closed position 68. It is preferred that buoyancy force 70 of float 44 is arranged to exceed gravitational force 60 on active portion 72 in this orientation sufficiently to close sealing member 46 to closed position 68.

In alternate embodiments, float 44 can be separate from linkage member 96 so that linkage member 96 is a pivoting member that is separate from and, or substantially disconnected from float 44.

In FIG. 8*o*, dry top 38 is seen to be substantially in an inverted orientation and this causes buoyancy force 70 on float 44 to move float 44 and linkage member 96 from active position 102 to inactive position 104 so that these parts are not active parts of active portion 72. In this embodiment, float 44 and, or linkage member 96 is arranged to not pull sealing member 46 away from closed position 68 in this orientation. In the embodiment of FIG. 8*o*, gravitational force 60 on of active portion 72, which includes weighted member 94, urges sealing member 46 toward closed position 68 in this inverted orientation.

FIGS. 8*p* to 8*r* are similar to the embodiments and views in FIGS. 8*m* to 8*o*, respectively, except that the embodiments in FIGS. 8*p* to 8*r* have the relative positions of float 44 and weighted member 94 substantially reversed.

In FIG. 8*p*, weighted member 94 is connected to snorkel 20 with linkage member 96, which is not directly connected to pivoting arm 42 in this particular embodiment; however, any suitable alternate connection or combinations of connections may be used in alternate embodiments. In this embodiment FIG. 8*p*, float 44 is directly connected to and part of pivoting arm 42 and is positioned above weighted member 94 in this view; however, in alternate embodiments, float 44 can be separated from or connected to pivoting arm 42 and, or any portion of dry top 38 and, or snorkel 20 in any suitable manner. In alternate embodiments and methods, float 44 can be connected to any portion of dry top 38 and, or snorkel 20, including with the use of an additional linkage member 96 that is separate from that connected to weighted member 94 shown in FIG. 8*p*. In FIG. 8*p*, dry top 38 is sufficiently out of the water (not shown) to cause gravitational force 60 to control net force 64 so that sealing member 46 is urged toward open position 50.

In FIG. 8*q*, dry top 38 is sufficiently submerged to cause buoyancy force 70 on float 44 to pivot sealing member 46 to closed position 68. Gravitational force 60 on weighted member 94 and, or linkage member 96 urges weighted member 94 to inactive position so that these parts are not active parts of active portion 72 and do not pull sealing member 46 toward open position 50.

In FIG. 8*r*, dry top 38 is in a substantially inverted orientation while submerged. Gravitational force 60 on weighted member 94 and, or linkage member 96 causes these parts to move from inactive position 104 to active position 104 in which weighted member 94 and linkage member 96 are active parts of active portion 72 and push downward on pivoting arm 42 to urge active portion 72 toward closed position 68. Preferably, gravitational force 64 on active portion 72 is arranged to exceed buoyancy force 70 on float 44 so that sealing member 46 is urged toward closed position 68 if the relative suction force inside of snorkel 20 is reduced or eliminated or if closed position is temporarily lost in this position, such as from a strong exhale from the diver or any other cause.

In alternate embodiments of the embodiments shown in FIGS. 7 to 8*r* (or any other embodiments), any form, configuration or arrangement of bias force or bias member can be added to any portion of dry top 38, any portion or portions of active portion 72, any portion of float 44 and, or any portion of weighted member 94.

FIG. 9 shows a perspective side view of an alternate embodiment dry top connected to the upper portion of a snorkel. Inside vent 84 in cover 33, sealing member 46 can be seen with an interior wall 106 behind sealing member 46 while sealing member 46 is in open position 50 due to being substantially upright and significantly out of the water. In this embodiment, sealing member 46 is seen to be relatively asymmetrical rather than round; however sealing member 46 can have any desired shape.

Figure 10A:
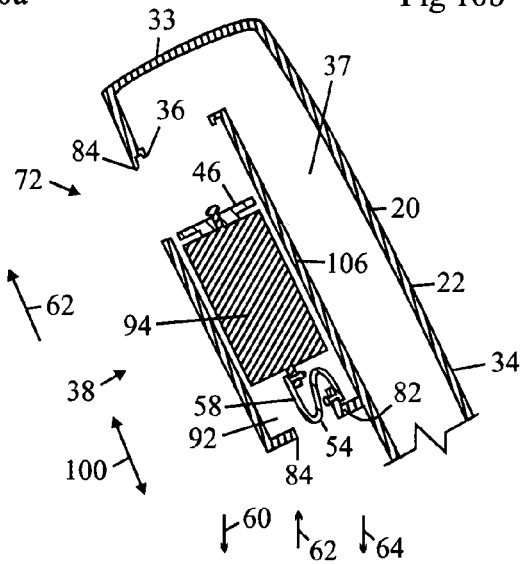

FIGS. 10*a* to 10*j* show alternate embodiments of a cross section view taken along the line 10-10 in FIG. 9. FIG. 10*a* shows that active portion 72 includes weighted member 94 and bias member 54 is positioned below weighted member 94 and attached to it. Weighted member 94 is seen to be solid; however, in alternate embodiments any portion of weighted member and, or active portion 72 can be hollow, partially hollow, or can be a combination of any number of parts having any desired amount of specific gravity for adjusting the overall specific gravity of weighted member 94 and, or active portion 72. As previously described, sealing member 46 is in open position 50 in FIG. 8*a* due to the downward component of the weight of weighted member 94 being arranged to be greater than bias force 62.

Figure 10B:
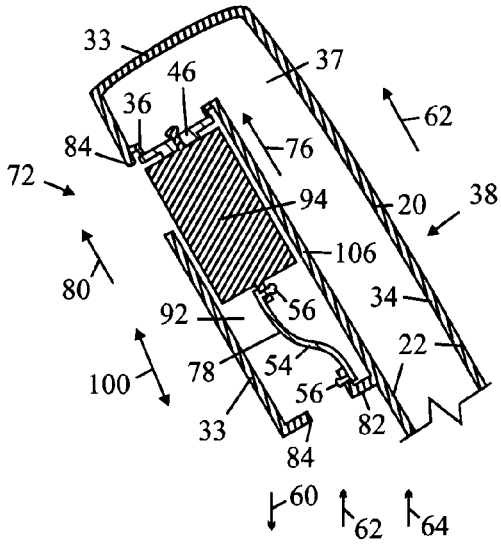

In FIG. 10*b*, at least a portion of active portion 72 is sufficiently submerged to permit bias force 62 to control the movement of sealing member 46 and achieve closed position 68 as previously described. Extended direction 80 shows that bias member 54 extends in the same direction as closing direction 76 in this embodiment. While sealing member 54 is preferably a relatively flexible diaphragm or membrane made of a resilient material such as a thermoplastic silicone or rubber-like material, sealing member 46 can also just be the upper surface or region of weighted member 94 in this embodiment or any part of active portion 72 in any embodiment. In this embodiment, extended direction 80 is seen to be substantially parallel to guided direction 100; however, in alternate embodiments, bias member 54 can be arranged to extend in any manner or direction so that extended direction 80 can be arranged to occur in any suitable direction.

Figure 10C:
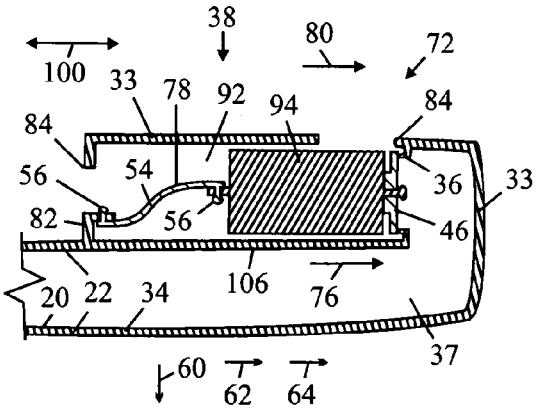

FIG. 10*c* shows a cross section view of the same embodiment shown in FIG. 10*b* except that in FIG. 10*c* dry top 38 is oriented in a substantially horizontal direction to show that active portion 72 is preferably arranged to automatically close sealing member 46 to closed position 68 when submerged in any orientation as previously described even if there is little or no pressure difference between the inside and outside of snorkel 20 at depth or if sealing member 46 is forced temporarily away from closed position 68 for any reason including a strong exhale from the swimmer at depth.

Figure 10D:
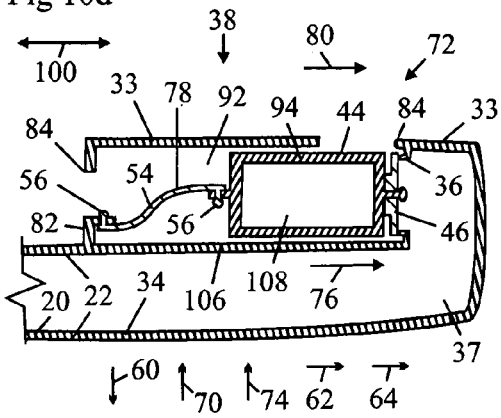

FIG. 10*d* shows the same cross section view and orientation shown in FIG. 10*c* except that in this alternate embodiment, weighted member 94 is seen to have an enclosed air chamber 108 which can be used to reduce the overall specific gravity of weighted member 94 when significantly dense materials are used to make weighted member 94. This can permit weighted member to either sink, be weightless in water, or to have at least a portion of weighted member 94 also be float 44 if an upward floatation force is desired.

Figures 10E, 10F, 10G, 10H, 10I, 10J:
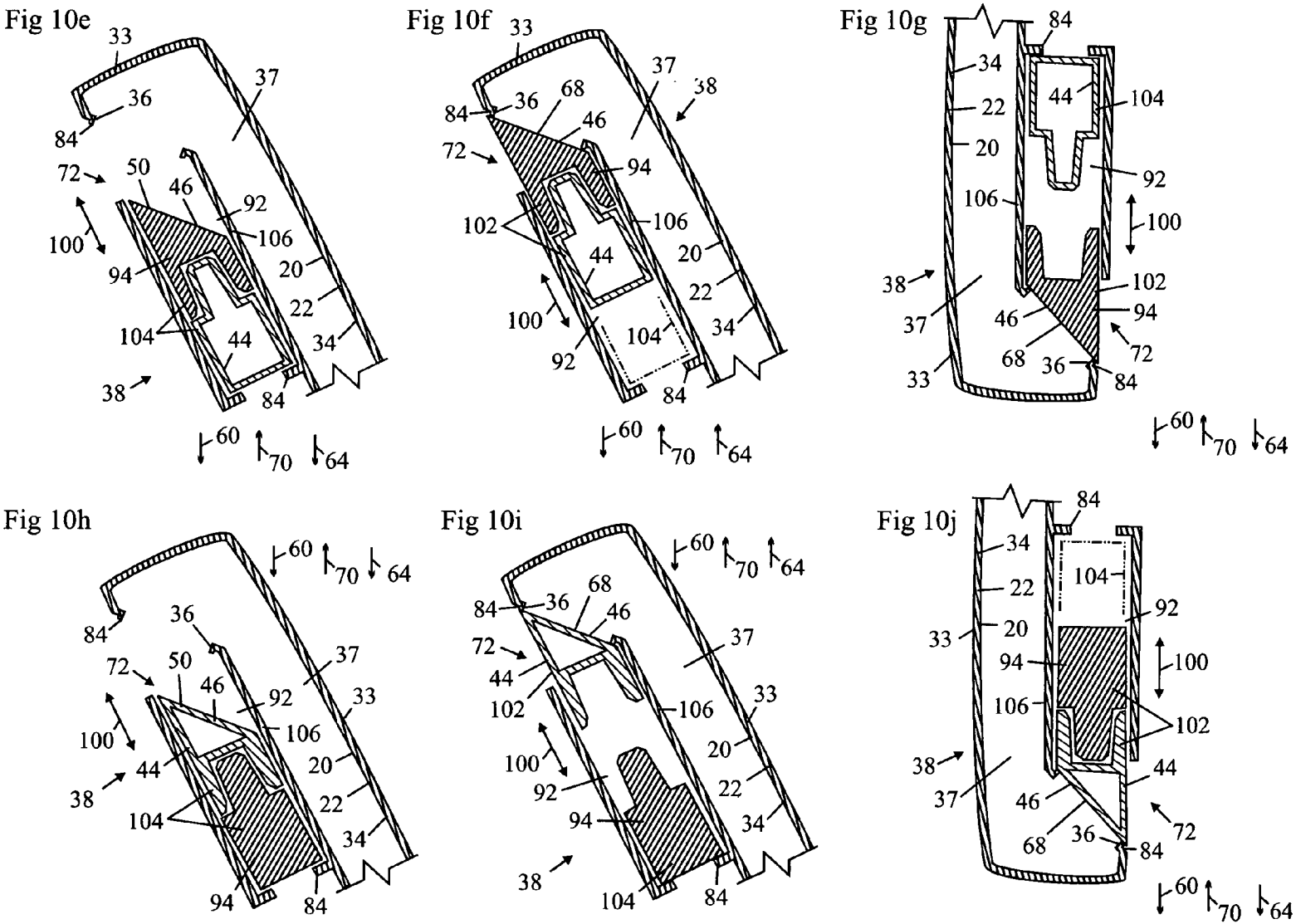

FIGS. 10*e* to 10*j* show alternate embodiment cross section views taken along the line 10-10 in FIG. 9. In the embodiments in FIGS. 10*e* to 10*g*, the lower portion of weighted member 94 is seen to be recessed and the upper portion of float 44 is seen to protrude into the recess under weighted member 94. This arrangement can be used as a method to reduce the overall length of guided region 92 along direction 100 while also providing the sides of weighted member 94 and, or float 44 to have sufficient tracking against at least one portion of guided region 92 to substantially prevent such parts from having excessive wobbling off axis pivoting while moving back and forth within guided region 92 along direction 100. In FIGS. 10*h* to 10*j*, the same method is used; however, the relative positioning of float 44 and weighted member 94 are substantially reversed. In alternate embodiments, any portion of active portion 72 can fit within, fit against, fit on, or be guided by any interior or exterior portion of any other portion of active portion 72 and or guided region 92 and, or dry top 38 and, or snorkel 20. In other alternate embodiments, weighted member 94 and, or float 44 can be arranged to extend into one another in any manner or may be arranged to not extend into any portion of active portion 72.

In FIG. 10*e*, dry top 38 is arranged to be substantially upright and out of the water (not shown) so that sealing member 46 is in open position 50. In this embodiment, sealing member 46 is an upper portion of weighted member 94; however, in alternate embodiments, sealing member 46 can be made with any suitable material and connected to weighted member 94 in any suitable manner. Gravitational force 60 pulls sealing member 46 to open position 50.

In FIG. 10*f*, at least a significant portion of dry top 38 is submerged so that buoyancy force 70 on float 44 is arranged to exceed gravitational force 60 on weighted member 94 and sealing member 46 so that net force 64 pushes float 44 from inactive position 104 to active position 102 so that flat 44, weighted member 94 and sealing member 46 are all active parts of active portion 72 which are moved to closed position 68. In this embodiment, it is preferred that buoyancy force 70 of float 44 is arranged to exceed gravitational force on active portion 72.

In FIG. 10*f*, the plane of opening 36 is seen to have an inclined orientation relative to the orientation of internal wall 106. This method of alignment can be used to permit air to enter and exit opening 36 with a substantially right angle turn. In alternate embodiments, the plane or orientation of opening 36 can be arranged to have any alignment or inclination and conduit 22 and, or dry top 38 can be arranged to permit air to flow in and, or out of opening 36 at any desired angle relative to the longitudinal alignment of conduit 22 below dry top 38. In alternate embodiments, conduit 22 can bend to an acute angle, a right angle, an obtuse angle and, or can form any desired shape such as an L-shaped turn, a T-shaped configuration in a linear or circular or dome-like form, a U-shaped turn, or any suitable shape or arrangement.

In FIG. 10*f*, the upper region of weighted member 94 and sealing member 46 are seen to be inclined to seal against the inclined orientation of opening 36. In embodiments in which the upper region of weighted member 94 and, or sealing member 46 are asymmetrically inclined, it is preferred that at least a portion of active portion 72 and, or guiding portion 92 be arranged to substantially prevent sealing member 46 from twisting around a substantially longitudinal axis relative to direction 100 so that sealing member 46 is able to maintain orientations relative to opening 36 capable of creating a substantially water tight seal against opening 36.

In FIG. 10*g*, dry top 38 is substantially inverted while submerged so that buoyancy force 70 on float 44 moves float 44 to inactive position 104 that is separated and away from weighted member 94 so that float 44 is not an active part of active portion 72. Because float 44 is arranged to separate and move away from active portion 72 in this orientation, buoyancy force 70 on float 44 does not pull sealing member 46 away from closed position 68. Gravitational force 60 on weighted member 94 and sealing member 46 urge sealing member 46 to closed position 68. This permits sealing member 46 to achieve, maintain and, or reestablish closed position 68 while inverted even if the relative suction force inside of snorkel 20 is reduced or eliminated, or if sealing member 46 is moved away from closed position 68 as gravitational force 60 is preferably arranged to dominate net force 64 in this orientation even without a relative internal suction force being present.

FIGS. 10*h* to 10*j* show alternate cross section views that are similar to those shown FIGS. 10*e* to 10*g*, except that in FIGS. 10*h* to 10*j*, the relative positions of float 44 and weighted member 94 are substantially reversed.

In FIG. 10*h*, dry top 38 is arranged to be substantially upright and out of the water (not shown) so that sealing member 46 is in open position 50. In this embodiment, sealing member 46 is an upper portion of float 44; however, in alternate embodiments, sealing member 46 can be made with any suitable material and connected to float 44 in any suitable manner. Gravitational force 60 pulls sealing member 46 to open position 50.

In FIG. 10*i*, at least a significant portion of dry top 38 is submerged so that buoyancy force 70 on float 44 pushes float 44 to active position 102 so that sealing member 46 and float 44 are moved to closed position 68. Because weighted member 94 is arranged to be below float 44 in this orientation, gravitational force 60 on weighted member 94 urges weighted member 94 to inactive position 104, so that weighted member 94 is not an active part of active portion 72 in this orientation and does not pull sealing member 46 away from closed position 68.

In FIG. 10*i*, the upper region of float 44 and sealing member 46 are seen to be inclined to seal against the inclined orientation of opening 36. In embodiments in which the upper region of float 44 and, or sealing member 46 are asymmetrically inclined, it is preferred that at least a portion of active portion 72 and, or guiding portion 92 be arranged to substantially prevent sealing member 46 from twisting around a substantially longitudinal axis relative to direction 100 so that sealing member 46 is able to maintain orientations relative to opening 36 capable of creating a substantially water tight seal against opening 36.

In FIG. 10*j*, dry top 38 is substantially inverted while submerged so gravitational force 60 on weighted member 94 moves weighted member 94 from inactive position 104 (shown by broken lines) to active position 102 so that weighted member 94 becomes an active part of active portion 72 in this inverted orientation. Gravitational force 60 on active portion 72 is preferably arranged to exceed buoyancy force 70 on float 44 in this orientation so that net force 64 on active portion 72 urges weighted member 94, float 44 and sealing member 46 toward closed position 68. Because buoyancy force 70 on float 44 is arranged to be less than gravitational force 60 of active portion 72, float 44 does not move sealing member 46 away from closed position 68. Preferably, gravitational force 60 on active portion 72 is arranged to dominate net force 64 in this inverted orientation even if the relative suction force inside of snorkel 20 is reduced or eliminated, or if sealing member 46 is moved away from closed position 68 such as during an firm exhale by the diver at depth.

In FIGS. 6*e* to 10*j*, active portion 72 is arranged to be slidably supported with guiding portion 92. In this embodiment, guiding portion 102 is an interior compartment within dry top 38 and cover 33. However, in alternate embodiments, active portion can be arranged to be slidably supported and, or pivotally supported along any internal or external portion of snorkel 20, conduit 22, dry top 38, cover 33, or any other structure that is connected to snorkel 20. This can also be the case with any of the other embodiments described as well as any other suitable variation. Furthermore, in alternate embodiments guiding portion 92 can have any alignment and can provide a relatively straight, angled, curved or pivotal path arranged to provide at least some control over the movement of sealing member 46.

FIG. 11 shows a perspective side view of an alternate embodiment dry top 38 connected to upper portion 34 of snorkel 20. In FIG. 11, vent 84 is seen to be positioned at the outer end of dry top 38; however, in alternate embodiments any form or number of forms of vents 84 or any type of openings may be used in any positions or combinations of positions along cover 33. Dry top 38 is seen to have an angled member 110 that extends from the outer surface of cover 33; however, in alternate embodiments angled member 110 can be positioned inside of cover 33 with or without angled member 110 protruding or only slightly protruding from the outer surface of cover 33. Angled chamber 33 has an angled axis 112 that is arranged to be oriented at an angle to a conduit longitudinal axis 114 that is substantially parallel to at least one portion of conduit 22 within or near dry top 38. In this example, conduit axis 114 is substantially parallel to the longitudinal axis of conduit 22 near upper portion 34 of conduit 22; however, conduit axis 114 can be arranged to be parallel to the longitudinal alignment of conduit 22 near opening 36 (not shown) of conduit 22.

FIGS. 12*a* to 12*e* show alternate embodiments of a cross section view taken along the line 12-12 in FIG. 11.

In FIG. 12*a*, at least a significant portion of dry top 38 is arranged to be substantially upright and out of the water (not shown) so that gravitational force 60 moves pivoting arm 42 and sealing member 46 to open position 50. In this embodiment, pivoting arm 42 is arranged to have a lightened portion 116, which in this example includes an open void that is arranged to lighten at least a portion of the weight of arm 42. In this example, pivoting arm 42 is seen to have an extended portion 118 that extends into guided region 120 of angled member 110. Extended portion 118 of pivoting arm 42 is seen to have contact region 122 that is arranged to contact a transversely moveable float 124 during at least one predetermined orientation of dry top 38. In alternate embodiments, guiding portion 120 of angled member 110 may be arranged to slidably or pivotally support any form or order of placement of float 44 and, or float 124 and, or weighted member 94 (not shown in this chamber) and or bias member 54 (not shown) as is shown and, or described in the methods of present inventions provided in this disclosure. This may occur with out an additional guided region such as guided region 92 having an additional float 124 or 44 and, or weighted member 94 and, or bias member 54 (not shown) or with any number of such additional guided regions components or angled member 110. Preferably, float 124 is arranged to move substantially along angled axis 112 of angled member 110 in a direction 126 that is at least partially traverse or transverse or at an angle to the alignment of conduit axis 114. In this example, angled member 110 and guided region 120 include a compartment in which float 124 is able to move; however, in alternate embodiments, angled member 110 and, or guided region 120 may include any suitable method of guiding the movement of float 124 and, or weighted member 94 (not shown in member 110) and, or bias member 54 (not shown) along or relative to any internal or external portion of conduit 22, snorkel 20, dry top 38, cover 33 or any other structure or pathway or guiding member in any suitable manner, arrangement, configuration, direction, alignment or alignments of movement including slidably supported movement or pivotally supported movement.

In the example of FIG. 12*a*, float 124 is at the lower portion of guided region 120 because float 124 is not sufficiently submerged or not submerged at all to cause it to become buoyed up. Float 124 is not connected to or in contact with pivoting arm 42 in this example and this causes float 124 to be in inactive position 104 as it exerts no force against arm 42 in this orientation. Below arm 42 is seen guiding portion 92 with weighted member 94 positioned above float 44 and both weighted member 94 and float 44 are in inactive position 104 as they are not active parts of active portion 72 due to not exerting any force against arm 42 in this example. In alternate embodiments, any form, arrangement, configuration, positioning, or order of positioning of float 44 and, or weighted member 94 and, or bias member 54 (not shown) may be used to provide at least some control over the movement of sealing member 46 when dry top 38 is in at least one orientation and, or at least partially submerged under water.

In FIG. 12*a*, float 44 and weighted member 94 are arranged to move substantially along a predetermined axis 128 that is provided by guided portion 92. In this embodiment, it is preferred that axis 112 is at a predetermined angle to axis 128.

In FIG. 12*b*, dry top 38 is arranged to be substantially upright and substantially submerged so that buoyancy force 70 on float 124 moves float 124 from inactive position 104 to active position 102 within guided region 120 so that float 124 pushes against contact region 12 of arm 42 and becomes an active part of active portion 72. Submersion of this embodiment also causes buoyancy force 70 on float 44 to move float 44 and weighted member 94 from inactive position 104 to active position 102 within guided region 92 so that both of these parts become active parts in active portion 72. It is preferred that in this orientation of dry top 38, buoyancy force 70 of float 124 and, or float 44 exceeds gravitational force 60 on active portion 72 so that net force 64 moves sealing member 46 from open position 50 to closed position 68.

In FIG. 12*b*, float 124 is seen to be able to move substantially in direction 126, which can permit float 124 to move closer to or further away from conduit 22 in at least a partially sideways or transverse direction relative to conduit axis 114 and, or conduit 22. In alternate embodiments, axis 112 can be arranged to be substantially parallel to axis 114 while arranging guiding portion 120 to permit float 124 to move away from or closer to conduit 22 and, or pivoting arm 42 (or any other portion of any form of active portion 72) in a direction that is substantially traverse, transverse or at an angle to the longitudinal alignment of conduit 22 and, or axis 114. This can be achieved by permitting float 124 to have a sufficiently loose connection to any portion of snorkel 20 and, or dry top 38 to permit float 124 to move transversely away from pivoting arm 42 so that float 124 and, or weighted member 94 (not shown along guided region 120) can move transversely toward arm 42 to actively push against arm 42 (or alternatively to not pull arm 42 toward open position when submerged and, or inverted and or significantly inclined near or below a substantially horizontal orientation), or to move transversely away from arm 42 so as to not push against arm 42 (or alternatively not pull arm 42 away from closed position 68 when submerged, inverted and, or significantly inclined). This can permit the benefits and methods used in other embodiments disclosed in this specification to be arranged to act on active portion 72 at an angle to conduit 22 and, or axis 114. Preferably, such transverse arrangements of movement can be used as a method for improving the ability for sealing member 46 to achieve, maintain and, or reestablish closed position 68 when submerged and, or while dry top 38 is in at least one or more under water orientations.

In FIG. 12*c*, dry top 38 is in a substantially inverted orientation while submerged. In this orientation, buoyancy force 70 on float 124 causes float 124 to move from active position 102 to inactive position 104 along guided region 120 of angled member 110 so that float 124 is not an active part of active portion 72 in this orientation. Because float 124 is not exerting its buoyancy force 70 on arm 42, float 124 does not pull arm 42 away from closed position 68 in this orientation. In this example, gravitational force 60 of pivoting arm 42 can be arranged to be sufficient to urge sealing member 46 to closed position 46 with or without an internal suction force within snorkel 20. In this example, gravitational force 60 on weighted member 94 pulls weighted member 94 downward to active position 102 within guided region 92 to be applied against pivoting arm 42 to further urge sealing member 46 toward closed position 68. It is preferred that gravitational force 60 of arm 42 and, or weighted member 94 are arranged to urge sealing member 46 toward closed position 46 in this orientation. However, in alternate embodiments, the methods of the present invention can be used to provide increased performance even if sealing member 46 is not urged toward closed position 68 in this orientation and an internal suction force is relied upon to maintain closed position 68 in this orientation or any other orientation. This can also be the case with any alternate embodiment shown and, or described in this description as well as with any other suitable variation of the methods of the present invention when a greater reliance is placed on an internal relative suction force to maintain closed position 68 in at least one or more orientations with or without submersion.

In FIG. 12*c*, float 44 is seen to have moved to inactive position 104 in guided region 92 and does not pull upon sealing member 46 in the opposite direction as closing direction 76.

In FIG. 12*d*, dry top 38 is oriented in a substantially horizontal position with pivoting arm 42 positioned below conduit 22. In this example, weighted member 94 in guided region 92 is seen to be in contact with arm 42 and in active position 102, and this can happen if weighted member 92 was previously in active position 102 prior to dry top 38 being oriented in this substantially horizontal alignment and this can allow the angled upper portion of weighted member 94 to contact the lower region of arm 42 so that gravitational force 60 on weighted member 94 urges sealing member 46 toward closed position 68. In situations where weighted member was not previously at or near active position 102, weighted member 94 and float 44 will be arranged to not exert any substantial forces on arm 46 or active portion 72 due to gravitational force 60 on weighted member 94 and buoyancy force 70 on float 44 within guided region 92 being substantially perpendicular to the substantially horizontal alignment of guided region 92. In alternate embodiments, guided region 92 can be arranged to be oriented at any suitable angle to axis 114 and, or conduit 22 so that when conduit 22 and or axis 114 is oriented in a substantially horizontal alignment, so that the orientation of axis 128 and, or guided region 92 can be arranged to permit a sufficiently strong horizontal component of buoyancy force 70 on float 44 and, or gravitational force 60 on weighted member 94 to be exerted along guided region 92 in a manner arranged to cause such forces to urge sealing member 46 toward closed position 68.

In FIG. 12*d*, the angled alignment of axis 112 along guided region 120 relative to the substantially horizontal alignment of dry top 38 and, or upper portion 34 and, or axis 114 and, or conduit 22, permits a horizontal component of buoyancy force 70 on float 124 to move flat 124 from inactive position 104 (shown by broken lines) to active position 102 that pushes upward against contact region 122 of pivoting arm 42 to urge sealing member toward closed position 42. When comparing the relative positions of float 124 in FIG. 12*b* to FIG. 12*d*, it can be seen that in FIG. 12*b* float 124 is in contact with the outer portion of contact region 122 of extended portion 118 and is spaced in a substantially sideways or transverse manner away from the inward portions and lateral side portions of pivoting arm 42, while in FIG. 12*d* float 124 is seen to be pressing against the inward lateral portions of pivoting arm 43 nearer to conduit 22 rather than spaced from this region as shown in FIG. 12*b*. This comparison of FIGS. 12*b* and 12*d* shows that float 124 is arranged to move in a sideways, traverse, transverse or lateral direction toward or away from arm 42, active portion 72, opening 36 and, or conduit 22 while being supported by guiding portion 120. In the embodiment in FIG. 12*d*, it is preferred that buoyancy force 70 of float 124 exceeds gravitational force 60 of active portion 72 so that float 124 moves sealing member 46 to closed position 68 even if the relative internal suction force within snorkel 20 is reduced or lost at depth or if sealing member is moved away from closed position 68 at depth.

In FIG. 12*e*, dry top 38 is oriented in an substantially horizontal direction that is substantially opposite to the horizontal orientation shown in FIG. 12*d*. In FIG. 12*e*, pivoting arm 42 is positioned above conduit 22 so that gravitational force 60 on pivoting arm 42 is directed downward and is concentrated to the right of hinge 48 so as to urge sealing member 46 toward closed position 68. Float 124 is seen to have moved from active position 102 to inactive position 104 that is spaced from arm 42 and does not act to pull sealing member 46 away from closed position 68. In an alternate embodiment, a weighted member 94 such as used in guided region 92 can also be used in guided region 120. In such a situation, such a weighted member 94 could be arranged to move downward and to the right substantially along axis 112 so as to press downward against pivoting arm 42 at or near contact region 122 to further urge pivoting arm 42, active portion 72 and sealing member 46 toward closed position 68 while dry top 38 is in this substantially horizontal orientation.

FIG. 13 shows an alternate embodiment side view of the embodiment shown in FIGS. 11 to 12*e* in which the dry top is oriented in a substantially horizontal position and viewed from the side that angled member 110 is connected to. In the embodiment in FIG. 13, axis 128 is oriented at a predetermined angle to axis 114 in this view and axis 112 is oriented at a different predetermined angle to axis 114 which is also at a predetermined angle to axis 112. Dotted lines show one example for the internal (hidden) positions of float 124, float 44 and weighted member 94. Float 124 is seen to be in inactive position 104 along axis 112, float 44 is seen to be in active position 102 along axis 128 and weighted member 94 is seen to be in inactive position 104 along axis 128 so that float 44 can urge sealing member 46 (not shown) toward closed position 68 (not shown) while float 124 and weighted member 94 are passive in this orientation. In an alternate embodiment, an additional weighted member 94 can be added to angled member 110 so that in this orientation, such weighted member 94 (not shown on axis 112) can move to the left and downward along axis 112 to an active position 102 (not shown) if positioned to the right of float 124 or below float 124 from this view, or can move float 124 downward and to the right in this view to active position 102 (not shown) if positioned to the left of float 124 from this view or above float 124 from this view so as to urge sealing member 46 (not shown) toward closed position 68 (not shown). In other embodiments, any form of bias member 54 (not shown) may be connected to any portion of such an additional weighted member 94 (not shown) and, or float 124 and, or float 44 and, or weighted member 94 and, or any portion of active portion 72 (not shown) in any combination, arrangement or configuration. In other embodiments, the relative positions of weighted member 94 and float 44 may be reversed or either or both of these parts may be modified in any suitable manner or eliminated if desired.

FIG. 14 shows a side view of the embodiment shown in FIG. 13 in which the dry top is oriented in a substantially horizontal position that is substantially opposite to the horizontal orientation shown in FIG. 13. In this example, dotted lines show weighted member 94 has moved to active position 102 along axis 128 in a leftward and downward direction from this view and has pushed float 44 in an leftward and downward direction to active position 102 along axis 128, while float 124 has moved from inactive position 104 to active position 102 along axis 112.

Angled member 110 can be a separate part that is connected to cover 33 in any suitable manner during assembly or can be molded integrally with cover 33 with one or more steps of an injection molding process using one or more thermoplastic materials.

In alternate embodiments of the embodiments shown in FIGS. 11 to 14 (or of any other embodiments), any form, configuration or arrangement of bias force or bias member can be added to any portion of dry top 38, any portion or portions of active portion 72, any portion of float 44 and, or any portion of weighted member 94.

FIG. 15 shows a perspective view of an alternate embodiment. In FIG. 15, active portion 72 of dry top 38 is seen to include a passive member 130 that is connected to arm 42 and sealing member 46. In this embodiment, passive member 130 is arranged to substantially be a paddle member, deflector member, drag inducing member, or panel member that is arranged to create drag and, or create an impact force during submersion to passively close sealing member 46 against opening 36. In FIG. 15, conduit 22 is moving in a downward direction 132 toward surface 52 of the water so that the water experiences a relative movement 134 in relation to dry top 38. In FIG. 15, downward movement 132 causes relative movement 134 to be directed upward toward passive member 130 as surface 52 approaches passive member 130. Because surface 52 and, or relative movement 134 has not yet impacted passive member 130, sealing member 46 and passive member 130 are in open position 50 under the force of gravity exerted on active portion 72 due to dry top 38 being substantially upright and substantially above surface 52.

FIG. 16 shows a perspective view of the embodiment of FIG. 15 in which active portion 72 has moved from open position 50 (shown by broken lines) to closed position 68. In FIG. 16, downward movement 132 has caused passive member 130 to impact surface 52 of the water and experience an upward force 136 that is created by the relative upward impact of surface 52 against passive member 130 and, or drag forces created on passive member 130 as relative movement 134 pushes against passive member in an upward direction. Upward force 136, which is created by such impact forces and, or drag forces, is applied as a torque or moment force about axis 48 to cause active portion 72 to move in closing direction 76 from open position 50 (shown by broken lines) to closed position 68 as dry top 38 is submerged during downward movement 132. In this embodiment, no float or floatation force is required to move sealing member 38 to closed position 68 during submersion. In some preferred embodiments, active portion 72 can be arranged to be denser than water so that active portion sinks when submerged. In other embodiments, active portion 72 can be arranged to have a specific gravity that is substantially between 0.85 and 1.05 grams per cubic centimeter, or approximately between 1 and 1.02 grams per cubic centimeter, or greater than 1 gram per cubic centimeter, or any other desired density. In other alternate embodiments, any portion of active portion 72, or active portion 72 as a whole, can be arranged to be less dense than water so that active portion 72 floats when submerged. In embodiments in which active portion is more dense than the surrounding water, passive member 130 can provide some or all of the closing force to closed position 68. Passive member 130 can be arranged to create a predetermined amount of drag and, or impact resistance upon submersion at a predetermined rate of submersion in order to achieve closed position 68. The minimum predetermined rate of submersion required to achieve closed position 68 can be arranged to be a rate that is significantly fast such as used when a diver takes a full inhalation of air at the surface and then quickly dives under the surface, any comfortable rate of submersion or any desired rate of submersion.

Once passive member 130 forces active portion 72 into closed position 68 during submersion, the relative Suction force within internal passageway 37 (not shown) can keep sealing member 46 sealed against opening 36 in many, or all orientations underwater. In embodiments in which active portion 72 is arranged to have a predetermined density that is greater than the surrounding water, gravitational forces from such greater density will assist in keeping sealing member 46 sealed in closed position 68 when dry top 38 is in substantially inverted orientations during submersion.

FIG. 17 shows a perspective view of an alternate embodiment. In this embodiment, passive member 130 is in open position 50 and is seen to have predetermined surface features 138, which in this example, are in the form of holes, passageways, perforations, vents, pores, dimples, pits, depressions, crevices, cutouts, impressions, hollow areas or recesses; however, in alternate embodiments, the methods of the present invention can permit predetermined surface features 138 to include one or more ridges, protrusions, bumps, flanges, ribs, bristles, or any combination of protrusions and, or recesses. In FIG. 17, predetermined surface features 138 are seen to be holes or perforations that can increase drag exerted on passive member 130 by the surrounding water. Holes and openings can also reduce the overall mass or inertia of passive member 130 to increase its response to changes in forces and changes in movement or position. Reducing the thickness of passive member 130 can also be used to reduce its inertial resistance to changes in motion so that it can react more quickly to impacts with the surface and, or upward flowing water. In addition, the methods of the present invention can include providing predetermined surface features 138 to increase drag, surface area and, or to permit miniature bubbles to temporarily adhere to the surface or surface features 138 upon impact with surface 52 of the water so that such bubbles or surface aerations temporarily create an upward force upon passive member 130 to increase movement to closed position 68 during submersion, even when passive member 130 and, or active portion 72 is arranged to have a density that is greater than water.

FIG. 18 shows a perspective view of an alternate embodiment. In this embodiment, passive member 130 is in open position 50 and predetermined surface features 138 include protruding members 140 and recesses 142. In alternate embodiments, any combinations, arrangements, sizes, shapes, contours, alignments, and configurations of any suitable alternative forms of protruding members 140 and, or recesses 142 may be used in any manner along with any suitable shape of passive member 130 or any other portion of active portion 72.

FIG. 19 shows a perspective view of an alternate embodiment. In this example, passive member 130 is seen to have at least one angled member 144, which in this embodiment, permits passive member 130 to be substantially dish shaped, bowl shaped, shovel shaped, bowed, angled, cup shaped, or contoured. In alternate embodiments, one or more angled members 144 can be angled upward, downward, sideways, or at any angle or combinations of angles.

Angled members 144 can permit increased displacement and, or deflection of water during submersion to help active portion 72 to move toward closed position 68 (not shown) during submersion. In this example, angled members 144 are on 3 sides of passive member 130; however, in alternate embodiments, the methods of the present invention can include providing at least one angled member 144 on one side, two sides, three sides, four sides or any number of sides or surfaces of passive member 144.

FIG. 20 shows a perspective view of an alternate embodiment which is similar to the embodiment in FIG. 19, except that in FIG. 20, passive member 130 is positioned below sealing member 46 and arm 42 and is connected to arm 42 and, or sealing member 46 with linkage 96 and hinges 98. In this embodiment, passive member 130 is connected to conduit 22 with hinge 98; however, in alternate embodiments, passive member 130 can be connected to conduit 22 in any suitable manner, can be slidably supported against conduit 22 without a direct connection, may be slidably supported by any other structure connected to conduit 22, can be loosely suspended next to conduit 22 or any suitable structure connected to conduit 22 or may pivot freely below sealing member 46 in any suitable manner, or may be arranged and, or positioned in any suitable manner relative to sealing member 46.

FIG. 21 shows a perspective view of an alternate embodiment. In this example, conduit 22 is bent near opening 36 so that opening 36 is inclined along one side of conduit 22. In this example, opening 36 is substantially perpendicular to the alignment of conduit 22 near upper portion 34; however, in alternate embodiments, any suitable or desired angle of alignment of opening 36 relative to conduit 22 may be used. In this embodiment, arm 42 has a significant surface are so that it is also passive member 130. In FIG. 21, downward motion 132 of dry top 38 causes surface 52 of the water to have relative movement 134 toward passive member 130 so that surface 52 is seen to be just beginning to impact passive member 130 and create upward force 136 on passive member 130 and begin movement in closing direction 76. Closing direction 76 will continue during continued downward movement 132 below surface 52 to cause sealing member to quickly achieve closed position 68 (not shown) during such submersion. In this example, a stop member 146 is seen near hinge 48, which is arranged to limit the range of motion of arm 42 in a downward direction when dry top 38 is substantially out of the water and gravity causes arm 42 to achieve open position 50.

FIG. 22 shows a perspective view the embodiment shown in FIG. 21 with an alternative method of closing dry top 38 by use of centrifugal force. In this embodiment, active portion 72 is preferably arranged to have a density that is greater than water. It is also preferred that active portion 72 be arranged to have sufficient inertial mass to permit arm 42 to pivot in closing direction 76 from open position 50 to closed position 68 (not shown) as conduit 22 is rotated substantially along its length so that the longitudinal alignment of conduit 22 is substantially radial to the direction of rotation or pivoting. Arrows above dry top 38 show examples of predetermined pivotal diving motion 148 that can be used as a diver pivots his or her head forward, backward or sideways (usually forward) when ducking the head underwater to begin a subsurface dive. The methods of the present invention include providing active portion 72 with a density that is greater than water, providing predetermined pivotal motion 148, providing active portion 72 with a predetermined mass capable of creating a centrifugal force 150 sufficient to move sealing member 46 from opening position 50 to closed position 68 (not shown) prior to or substantially simultaneous to the submersion of opening 36, and arranging centrifugal force 150 to be sufficient to hold sealing member 46 in closed position 68 (not shown) as opening 36 submerges underwater. Preferably, centrifugal force 150 is sufficient to permit sealing member 46 to remain sealed against opening 36 sufficiently long enough during submersion to permit a suction force to form within internal passageway 37 that is capable to holding sealing member 46 against opening 36 in a sealed manner upon further submersion to increased depths.

This method of using a heavier than water, or non-floating, or only slightly floating active portion 72 for providing closure of sealing member 46 during submersion can allow the diver to select when to permit dry top 38 to seal out water or to not use dry top 38 by selecting the speed of descent or downward pivoting or movement of conduit 22 created by the downward movement or pivoting of the diver's head relative to the speed required by the predetermined arrangement of active portion 72. For example, the diver could select to seal out water from entering opening 36 by submersing his or her head in a relatively quicker manner or rotation, and could select to not seal out water by descending relatively slowly. In some embodiments, active portion 72 can be arranged to create sufficient centrifugal force 150 even with relatively moderate or even relative slow rotations or descending head motions during diving. This can be a significant benefit by permitting the diver to avoid unwanted, undesired or unintentional closing of dry top 38 if desired. This method of the present invention can also provide reduced cost of manufacture, reduced number of parts, reduced complexity, reduced assembly time and reduced overall product cost in embodiments which avoid the use of a float as none is required while using this novel method for closing opening 36 without using a float or an upward buoyant force and without even having such a float device attached to active portion 72 at all. This reduces product cost and assembly because a float must typically be molded from multiple pieces to form a hollow piece, cut or molded with closed cell foam, manufactured separately with additional material and assembled separately. The method of eliminating the use of a float while using centrifugal force 150 for closing the valve sufficiently to hold in a sealed position through the submersion process until a suction force can take over at further depth, can be used to provide an improved and novel method for avoiding a float or floatation force and achieve a sealed condition. Preferably, active portion 72 is made with significantly thick, heavy, dense or large parts to provide sufficient inertia to achieve and maintain a sealed condition during rapid submersion over and above drag forces exerted upon active portion 72 during such rapid submersion so as to permit continued water tight seal regardless of such drag forces. In preferred embodiments, a cover can be used to surround active portion 72 to reduce drag forces during submersion upon active portion 72.

It is preferred that the method of providing a upward impact force from impact with surface 52 of the water and, or upward drag forces from relative movement 134 as shown and described in FIGS. 15 to 21 and, or centrifugal force 150 as shown and described in FIG. 22 is arranged to occur in an amount sufficient to permit dry top 38 to achieve closed position 68 (not shown in FIGS. 15 and 17 to 22) when active portion 72 is arranged to be denser than water so that active portion 72 does not float, and instead sinks, when fully submerged in water in the absence of significant impact and, or drag and, or centrifugal forces.

FIG. 23 shows a perspective view of an alternate embodiment. In FIG. 23, sealing member 46 is attached to arm 42 with knob 56 which protrudes through arm 46, and knob 56 is connected to bias member 54 which is molded integrally with sealing member 46, preferably during injection molding. This permits bias member 54 to be formed at the same time and during the same phase of production as sealing member 46. This can reduce cycle times in the molds, reduce storage of parts, reduce the number of molds required and increase ease of production. This also increases the ease of assembly by eliminating a separate part and by permitting sealing member 46 and bias member 54 to be attached to dry top 38 during the same phase of assembly. In alternate embodiments, sealing member 46 and bias member 54 can be connected in any manner and attached to dry top 38 in any manner and with any form, type or configuration of mechanical and, or chemical bonds. While the embodiment in FIG. 23 includes passive portion 130 to further increase pivotal force in closing direction 76 during submersion and, or increased mass for improved centrifugal force during pivoting or rotation of conduit 22, the method of molding sealing member 46 integrally with bias member 54 can be used in any manner with any embodiment, variation or combination provided in this specification or with any other suitable variation of any of the methods provided in this specification.

FIG. 24 shows a perspective view of an alternate embodiment. In FIG. 24, bias member 54 is seen to be provided in the form of a coiled spring that is wrapped around hinge 48. In this embodiment, bias member 54 has a coiled spring portion 152 and elongated portions 154 for providing leverage to move sealing member 46 in closing direction 76 when active portion 72 is at least partially submerged. In some preferred embodiments, bias member 46 can be made with a metal wire spring such as stainless steel tempered for spring characteristics or any other corrosion resistant material such as suitable metals or thermoplastics. While this embodiment shows bias member 54 as a coiled spring, any suitable form of spring device may be used including leaf strips, helical springs, collar shaped springs, twisted springs, pre-bent springs, straight wire springs, planar springs, or any suitable shape, form, size, contour, configuration, arrangement, or combination of springs. While the embodiment in FIG. 24 includes passive portion 130 to further increase pivotal force in closing direction 76 during submersion and, or increased mass for improved centrifugal force during pivoting or rotation of conduit 22, the method of using a coiled spring or any other form of spring for bias member 54 can be used in any manner with any embodiment, variation or combination provided in this specification or with any other suitable variation of any of the methods provided in this specification.

FIG. 25 shows a perspective view of an alternate embodiment in which passive member 130 is elongated for increase vertical dimension, surface area and, or mass.

FIG. 26 shows a perspective view of an alternate embodiment that is similar to the embodiment in FIG. 25, except that in FIG. 26, passive member 130 is seen to be significantly thinner than shown in FIG. 25. The reduced thickness of passive member 130 in FIG. 26 can be used to provide reduced mass with increased surface area to permit faster response or "bounce" upon impact with the surface of the water or increased response to drag during submersion. This can cause passive member 130 to act similar to a leaf on the water and move quickly in closing direction 76 upon submersion and, or impact with the surface of the water (not shown).

FIG. 27 shows a perspective view of an alternate embodiment.

FIGS. 28*a*, 28*b* and 28*c* show cross section views taken along the line 28-28 in FIG. 27.

In FIG. 28*a*, passive member 130 is seen to be disposed within guided portion 92. In this embodiment, passive member 130 is arranged to act similar to a plunger within guided portion 92 that can move in response to the vertical movement of water within guided portion 92 as dry top 38 moves vertically during submersion or resurfacing. In FIG. 28*a*, sealing member 46 is in open position 50 as surface 52 of the water is below passive member 130 and the gravitational forces upon active portion 72 pulls sealing member 46 to open position 50.

In FIG. 28*b*, dry top 38 is experiencing downward movement 132 and surface 52 of the water is moving upward relative to dry top 38 to cause relative movement 134 of the water to flow upward into guided portion 92 through vent 84 at the lower portion of guided portion 92. This upward flow of water through guided portion 92 from relative movement 134 of the water creates drag and pressure against passive member 130 in the form of upward force 136. This causes passive member 130 to move from open position 50 (shown by broken lines) to closed position 68 along direction 100, which causes sealing member 46 to move from open position 50 (shown by broken lines) to closed position 68. As dry top 38 continues to submerge below surface 52 of the water, upward force 136 created by relative movement 134 is soon replaced by a relative suction force from within internal passageway 37, which can be used to continue to hold sealing member 46 in closed position 68 at depth and in many or even all underwater orientations. When active portion 72 is arranged to be denser than water or substantially equal to the density of water so as to not create a significant floatation force, then active portion 72 will not urge sealing member 46 away from closed position 68 during substantially inverted orientations underwater.

In FIG. 28*c*, dry top 38 is experiencing an upward movement 156 out of the water during resurfacing and surface 52 of the water is moving downward relative to dry top 38 and this causes relative movement 134 to cause water to flow downward and out of vent 84 at the lower end of guided portion 92. This downward flow of relative movement 134 can be arranged to create a downward drag force 158 on passive member 130 to pull active portion 72 along direction 100 from closed position 68 (shown by broken lines) to open position 50. Alternatively or additionally, the gravitational forces on active portion 72 can be used to pull active portion 72 to open position 50.

In the embodiment shown in FIGS. 27 to 28*c*, the methods of the present invention are seen to include creating drag forces and, or pressure differentials across passive member 130 within guided portion 92 as water flows substantially vertically up or down within guided portion 92 to move active portion 72 between open position 50 and closed position 68 during submersion or resurfacing. The methods of the present invention can permit no float or upward floatation force to be used during such automated closing and opening of sealing member 46. In alternate embodiments, a float and, or a bias member and, or a weighted member may be used in combination with passive member 130 or instead of passive member 130.

FIG. 29 shows a perspective view of an alternate embodiment.

FIGS. 30*a* and 30*b* show cross section views taken along the line 30-30 in FIG. 29.

In FIG. 30*a*, passive member 130 is seen to be in the form of a plunger or piston that has guiding side walls 160 and vents 162. The guiding side walls 160 near the upper end of passive member 130 are arranged to prevent excessive amounts of water from entering guided portion 92 through the upper end of guided portion 92 during submersion so that most of the water entering guided portion 92 comes upward through vent 84 at the lower end of guided portion 92 during submersion rather than flowing downward from the upper portion of guided portion 92 during submersion. This can be seen in FIG. 30*b* in which dry top 38 is experiencing downward movement 132 and relative movement 134 causes water to flow upward through vent 84 into the lower portion of guided portion 92. The upward flow from relative movement 134 pushes passive member 130 upward along direction 100 from open position 50 (shown by broken lines) to closed position 68. In FIG. 30*b*, guiding side walls 160 near the upper end of passive member 130 are seen to block excessive amounts of water from entering guided portion 92 from the upper portion of guided portion during submersion created by downward movement 132 so that water must flow upward within guided portion 92 with relative movement 134.

In the example in FIGS. 30*a* and 30*b*, vents 162 can be used, if desired, to permit air and, or water to flow into and out of guided portion 92 and, or passive member 130 and, or any portion of active portion 72 in a controlled manner. This can permit passive member 130 and, or guided portion 92 to drain and dry out when not in use and, or permits trapped air or bubbles within passive member 130 and, or guided portion 92 to escape if desired. If desired, air or bubbles may be trapped within passive member 130 and, or active portion 72 and, or guided portion 92, to exert increased upward force against active portion 72 even when active portion 72 is arranged to be denser than water and normally sink when submerged. If trapped air or bubbles are used to create an increased or sole upward force in various alternate embodiments, such bubbles will not urge active portion 72 away from closed position 68 when dry top 38 is oriented in substantially inverted positions during submersion as such bubble or bubbles would separate from active portion 72 in an upward direction while active portion remains downwardly positioned against opening 36 in closed position 68 during such inverted orientations.

When passive member 130 is used without a float or a bias member on active portion 72, it is preferred that the density of passive member 130 and, or active portion 72 is arrange to be sufficiently close to the density of water so that active portion 130 is relatively weightless when submerged and has a substantially negligible downward gravitational force when submerged. Preferably, passive member 130 and, or active portion 72 is arranged to create a drag force against the water during submersion and preferably the density of passive member 130 and, or active portion 72 is selected to create a gravitational force that is significantly less than such drag force so as to permit the drag force to control the movement of active portion 72 in closing direction 76 over and above the gravitational force exerted on active portion 72 during submersion. This method permits drag forces during submersion to exceed gravitational forces during submersion in an amount effective to permit sealing member 46 to move in closing direction 76 from open position 50 to closed position 68 during submersion, and without significant opposition from such gravitational forces during submersion.

Preferably, such drag forces during submersion can be arranged to be sufficiently greater than such gravitational forces during submersion to permit sealing member 46 to move to closed position 68 when downward movement 132 occurs at a relative slow pace, a relatively comfortable pace, a relatively typical pace or rate used during diving. Preferably, the minimum rate of downward movement 132 needed to close sealing member 46 against opening 36 is arranged to be exceeded during normal diving activity without awkward or excessive rates of downward movement 132 being required; however, in alternate embodiments, such minimum rate of downward movement 132 can be arranged to be faster than used during normal diving activity so that an intentionally fast rate of ducking the swimmer's head below the surface must be applied in order to close sealing member 46 against opening 36.

For example, some embodiments can be arranged to cause sealing member 46 to close when the rate of downward movement 132 exceeds 0.5 feet per second, 0.7 feet per second, 0.8 feet per second, 1 foot per second, or faster than 1 foot per second. In other embodiments, the minimum rate of downward movement 132 needed to close sealing member 46 against opening 36 can be less than 0.5 feet per second, 4 inches per second, 2 inches per second, 1 inch per second or less than 1 inch per second.

Any suitable material may be used to make passive member 130 and, or any portion of any version of active portion 72. Examples of possible materials include polyethylene, polypropylene, ABS, polycarbonate, HDPE, polystyrene, nylon, or any other suitable material including any suitable thermoplastic materials.

In alternate embodiments, methods for using passive member 130 with any shapes, orientations, surface features, contours, alignments, combinations, configurations, or arrangements, can be used in combination with or without any other method, methods and, or variations described in this specification.

Figure 31:
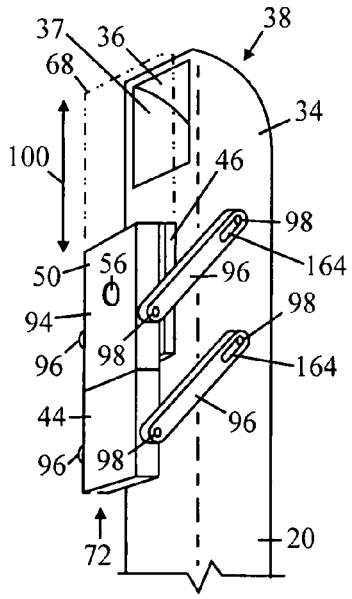

FIG. 31 shows a perspective side view of an alternate embodiment example. In this example, upper opening 36 is arranged to be a substantially lateral opening or bent opening in upper portion 34. In this example, opening 36 is oriented at approximately a 90 degree angle to upper portion 34; however, in alternate embodiments, opening 36 may be oriented at an obtuse angle, an acute angle, a 180 degree angle, a zero degree angle or any other angle relative to upper portion 34. In the embodiment shown in FIG. 31, active portion 72 is preferably arranged to move in a substantially linear manner along direction 100 between open position 50 and closed position 68 (shown by broken lines). In this example, active portion includes sealing member 46 connected to weighted member 94 and float 44 is seen to be used as well; however, float 44 may be avoided altogether, may be used alone without any significant weighted member 94, may be permanently connected to weighted member 94, or may be disconnected from weighted member 94 under any the various methods and alternate embodiment arrangements described in this specification. In this embodiment example, a plurality of linkage members 96 are connected between weighted member 94 (as well as float 44) and upper portion 34. In this example, four linkage members 96 are arranged to provide substantially linear movement along direction 100 with significantly reduced rotational movement for sealing member 46. In this embodiment, a slot 164 is used in at least one end of at least one linkage member 96 so as to permit such at least one end of at least one linkage member 96 to be able to slide along at least one pivoting connection 98. Any alternate method or feature can be used to allows linkage members 96 to be retractable so as to reduce arching or rotational motion to sealing member 46 along direction 100 between open position 50 and closed position 68.

Figure 32:
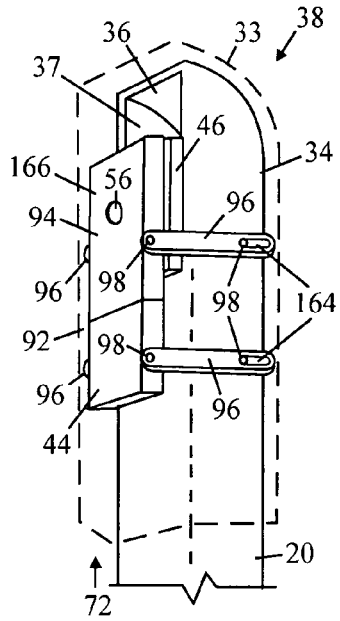

FIG. 32 shows the same embodiment shown in FIG. 31. In FIG. 32, cover member 33 is shown by dotted lines and active portion 72 has moved to an intermediate position 166 that is between open position 50 and closed position 68 shown in FIG. 31. In FIG. 32, guided portion 92 exists between cover member 33 and upper portion 34 so as to provide a guided pathway for active portion to move. Linkage members 96 are seen to have retracted backward as slot 164 has moved backward relative to pivoting connection 98 along upper portion 34. This retraction created by slot 164 permits the rotational motion of linkage members 96 to be converted into reduced rotational motion, significantly linear motion or even completely linear motion for sealing member 46 relative to upper portion for at least a significant portion of the overall movement path of sealing member 46. This creates a significant advantage by permitting cover member 33 to less arch shaped, more linear or even completely linear along a major portion of guided portion 92 so that cover member 33 is more streamlined in the water due to a slimmer profile for reduced drag. Prior art cover members are often highly bulbous in shape in order to accommodate a highly arched path of sealing member 46 and other connected parts, and such bulbous form creates increased drag during swimming which can cause snorkel 20 to flutter in water and increase jaw strain.

Figure 33:
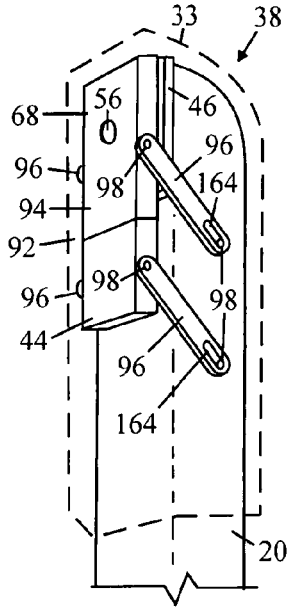

FIG. 33 shows the same embodiment as in FIGS. 31 and 32, except in FIG. 33 active portion 72 has moved to closed position 68. In this embodiment, slots 164 have extended forward about pivoting connections 98 along upper portion 34. Preferably, slots 164 are arranged to have sufficiently limited length to permit the back end of slot 164 to contact pivoting member 98 sealing member prior to sealing member 46 reaching closed position 68 so that linkage members 96 create at least a slightly arching path of movement for sealing member 46 as sealing member moves into closed position 68 so that linkage members 96 pull sealing member 46 in at least a slightly horizontal direction against opening 36 (not shown)

for an improved seal at least in the final portions of movement into closed position 68; however, in alternate embodiments any arrangement of movement of linear and/or arching movement can be created in any manner and at any portion of movement for sealing member 46 and/or active portion 72.

FIGS. 31, 32 and 33 together show a highly linear movement of active portion 72 while linkage members 96 provide a highly rotational movement. In preferred embodiments, this allows combined benefits of rotational motion for closing pressure with the streamlined, low drag benefits of linear movement for significantly reduced profile and drag from dry top 38 as an entire unit.

FIG. 33 shows a version of the embodiments of FIGS. 31 to 33 in which float 44 is disconnected from weighted member 94 as snorkel 20 in FIG. 33 is in an inverted orientation underwater. This disconnected arrangement permits float 44 to move to open position 50 and to not pull sealing member 46 in a direction that is substantially away from closed position 68. This permits the swimmer to purge the snorkel of internal water or saliva by exhaling with positive pressure while inverted underwater because weighted member 94 can move temporarily away from closed position 68 during such purging and then the weighted member 94 can move back downward to closed position 68 because the combination of weighted member 94 and linkage member 96 are arranged to be denser than water and sink back into closed position 68 rather than being pulled upward and away from closed position 68 by float 44 during or after such purging.

Figure 34:
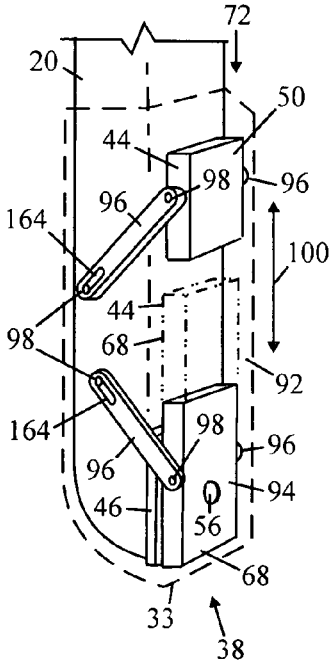
Figure 35:
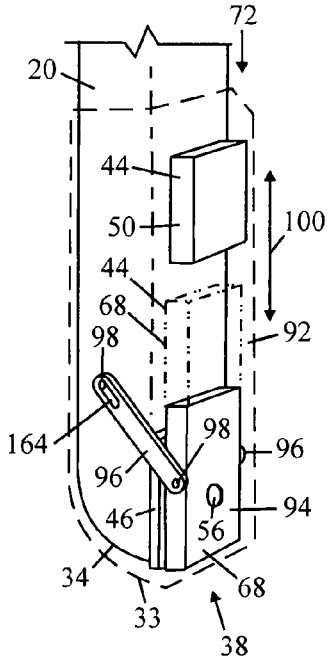

FIG. 35 shows an alternate embodiment of the embodiment shown in FIG. 34 as the embodiment in FIG. 35 shows float 44 freely moving within guided portion 92 without any linkage members and without any direct or immovable connection to either weighted member 94 or snorkel 20. Preferably, float 44 is either larger than any one of adjacent vents in cover member 33 or a suitable stopping device is used so that float 44 is retained within cover member 33 and does not fall out of any of such vents; however, any suitable method of restraining the movement of float 44 may be used with or without cover member 33 or independent from cover 33. In FIG. 35, dry top 38 is seen to be inverted, weighted member 94 and sealing member 46 are in closed position 68 and float 44 has moved from closed position 68 (shown by broken lines) to open position 50 in an area that is spaced from linkage member 96, weighted member 94 and sealing member 46.

Figure 36:
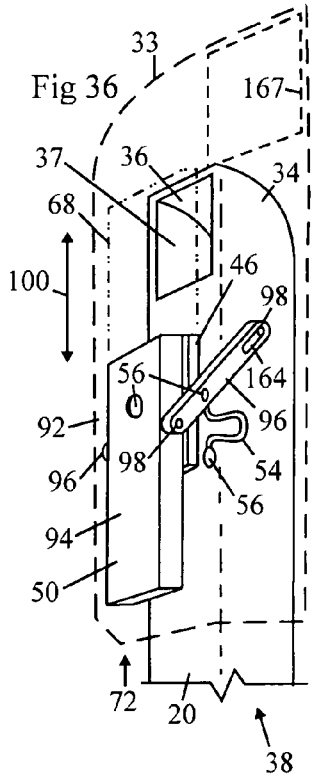

FIG. 36 shows an alternate embodiment in which no float is used, weighted member 94 is elongated for increased mass, and a suitable bias member 54 is arranged to apply a biasing force to encourage active portion 72 to move from open position 50 to closed position 68 (shown by broken lines) when at least a portion of weighted member 94 is submerged in water. In this example, 2 linkage members 96 are used along with slot 164 and linear movement is controlled by the linear space within guided portion 92 between upper portion 34 and cover member 33 (shown by dotted lines). While the lower portion of weighted member 94 could pivot outward away from upper portion 34 of snorkel 20 without the presence of cover member 33 and guided portion 92, cover member 33 and guided portion 92 are arranged to limit horizontal movement relative to upper portion 34 and to encourage linear movement. In alternate embodiments, more than two linkage members 96 can be used (such as the four shown in FIGS. 31 to 33) on the embodiment shown in FIG. 36 to control the movement of the lower portion of weighted member 94 and/or any portion of active portion 72 with or without restraint of movement arranged by cover member 33 or guided portion 92. While the embodiment in FIG. 36 shows bias member 54 to be a resilient member that is connected between linkage member 96 and upper portion 34 with knobs 56, any form of bias member 54 may be used with any type of connection to any part or parts of active portion 72 and/or snorkel 20. In other embodiments, any of the methods discussed in this description can be used with or without any bias member 54, with or without any float (not shown), or with or without any drag member (not shown).

In other embodiments, any form of cover member 33 may be used independently with or without any form of active portion 72, and vice versa.

In the embodiment example in FIG. 36, cover member 33 is seen to have an offset opening 167 (shown by dotted lines), which is oriented substantially offset to or out of alignment with opening 36 so that if splashes of water enter cover member 33 through offset opening 167, then preferably a reduced amount of such water will be able to enter internal passageway 37 through upper opening 36. In this example, offset opening 167 faces in a substantially opposite direction to opening 36 and is oriented near the rear portion of upper portion 34 relative to opening 36; however, in alternate embodiments any number of offset openings 167 may be used and may face in any desired direction and/or have any desired alignment or orientation relative to opening 36. These methods for cover member 33 are additionally exemplified and described further below in this specification in FIGS. 38 to 45, and may be used with or without any form of automatic closing device near opening 36.

FIGS. 37 to 45 show alternate examples of dry top 38 and cover member 33 that may be used with or without any closing device for opening 36, including with or without any method or form of active portion 72 described in this specification, and in any combination or variation.

FIG. 37 shows a front view of a snorkel 20 with a conduit 22 that has a lower portion 24, a lower end 26 and a purge valve 28. Purge valve 28 is preferably a one-way valve that permits water, saliva and, or air to be expelled from snorkel 20 through purge valve 28. Purge valve 28 may have any form and may include a well known form of resilient membrane that covers an exterior portion of an opening or vent within purge valve 28 so that the resilient membrane flexes open to permit water, saliva and, or air to be expelled through such opening or vents under the creation of relatively positive pressure where the internal air pressure exceeds ambient pressure outside of snorkel 20 by a predetermined amount, and then flexes back to a closed position when internal pressure no longer exceeds ambient pressure by such a predetermined amount so that external water cannot enter snorkel 20. A mouthpiece 30 is connected to conduit 22 with a breathing tube 32. Snorkel 20 has an upper portion 34 having an upper opening 36. Snorkel 20 has an internal passageway 37 that is in fluid communication between mouthpiece 30 and upper portion 34. A dry top member 38 is connected to upper portion 34, which may be any type of member that is arranged to reduce the chances of splashes of water from entering upper opening 36.

Preferably, dry top 38 includes an upper conduit portion 240 having a connection end 242 that connects with a mechanical and, or chemical bond to an upper end 244 of upper portion 34. In alternate embodiments, upper conduit portion 240 can be formed integrally with upper portion 34 without separate parts being used for these portions.

Preferably, upper conduit portion 240 has a predetermined longitudinal alignment and is arranged to orient upper opening 36 (shown by broken lines) at an angle to the longitudinal alignment of upper conduit portion 240. In this embodiment, upper opening 36 is oriented in a substantially outward lateral direction relative to the longitudinal alignment of upper conduit portion 240. In this example, conduit 22 has a mask connection member 246 which may be used and may have any suitable form for connecting to a diving mask or swimming goggle or to the head region of a swimmer (not shown). Conduit 22 has an intermediate conduit portion 248 near mask connection member and snorkel 20 has a predetermined substantially vertical alignment 250 near intermediate conduit portion 248. In this example, the longitudinal alignment of upper conduit portion 240 is inwardly angled relative to vertical alignment 250 of snorkel 20 so that the orientation of upper opening 36 faces in a substantially upward and, or outward direction relative to vertical alignment 250. In alternate embodiments, upper opening 36 may face in any suitable direction or angle relative to the longitudinal alignment of upper conduit portion 240.

In this embodiment, upper conduit portion 240 has a substantially lateral deflection member 252 that is arranged to deflect splashes of water in a substantially lateral direction so that substantially lateral directed water spray against lateral deflection member 252 does not directly enter opening 36 (shown by broken lines) or reduces entry of water splashing from a lateral direction into opening 36. In this example, lateral deflection member 252 is a curved lower and, or outer portion of upper conduit portion 240 near opening 36; however, deflection member 252 may have any suitable form, shape, number of parts, separation of parts relative to upper conduit portion 240, contour, orientation, arrangement, configuration, angle, positioning, size, or consistency.

In this embodiment, it is preferred that a cover member 33 is connected to upper conduit portion 240 in any suitable manner. Preferably, cover member 33 has an upper opening 256 near deflection member 252 that is in fluid communication with upper opening 36. In this example, cover member 33 is arranged to have a vertical deflection member 258 that is arranged to positioned sufficiently above opening 36 in a vertical direction so as to deflect downward vertical splashes of water away from opening 36 and reduce such downward splashes of water from entering upper opening 36. In this example, cover member 33 is also arranged to have a lateral deflection member 260 that is preferably laterally spaced from upper opening 36 so as to not excessively restrict the flow of air into and out of upper opening 36 and so as to not excessively restrict clearing the snorkel of water by the diver after resurfacing from submerged underwater diving. Preferably, lateral deflection member 260 is arranged to sufficiently cover upper opening 36 in a substantially lateral direction that laterally directed splashes of water are sufficiently deflected away from opening 36 to reduce the entry of such laterally directed splashes of water from entering upper opening 36.

In this example, it can be seen that upper conduit portion 240 has a substantially inward facing portion 262 and a substantially outward facing portion 264 relative to the head of the swimmer (not shown). In this embodiment, upper opening 36 positioned substantially along outward facing portion 264 and it is preferred that cover member 33 is arranged to cover a significant portion of outward facing portion 264. This arrangement may be used to provide inward facing portion 262 with a substantially smooth contour without significant appendages so as to reduce the chances of debris such as seaweed from hooking onto or catching along inward facing portion 262. It is also preferred that cover member 33 along outward facing portion be significantly smooth in contour so as to reduce the chances of debris entangling or catching on cover member 33. This preferred arrangement can also permit upper conduit member 240 and cover member 33 to have a significantly streamlined shape and profile for reducing drag during subsurface diving.

In this example, cover member 33 is seen to have a lower opening 266 that is positioned below upper opening 36 and is in fluid communication with opening 36. It is also preferred that cover member 33 have one or more lateral openings 268 that are in fluid communication with opening 36. In this example, lower opening 266 and lateral opening 268 are arranged provide increased inlet and outlet paths for upper opening 36 to reduce back pressure or flow resistance between upper opening 36 and cover 33 for breathing as well as increased water outlet while clearing water from snorkel 20 after subsurface diving. In addition, lower opening 266 and lateral opening 268 are preferably used to provide an outlet for splashes of water that are able to enter the interior of cover member 33.

FIG. 38 shows a close up perspective view of the dry top portion of the snorkel shown in FIG. 37. In FIG. 38, cover 33 is seen to have a vent 270 (shown by broken lines). Vent 270 can be used to provide increased flow capacity for opening 36 with an additional opening for facilitating air intake and outtake and, or for providing additional drainage of water between upper conduit portion 240 and cover 33.

FIGS. 39*a* to 39*c* show cross section views taken along the line 39-39 in FIG. 38. In FIG. 93*a*, deflector member 33 is seen to extend from inward facing portion 262 toward outward facing portion 264 and terminates at an internal end 272. From this view of this embodiment example, internal end 272 forms the upper end of upper opening 36 while a lower end 273 of opening 36 is seen to exist along outward facing portion 264 of upper conduit portion 240. Cover member 33 is seen to extend from lateral deflection member 260 near outward facing portion 264 toward opening 256 and terminates at an external end 274. Preferably, external end 274 of cover member 33 overlaps internal end 272 in a vertical manner such as relative to a vertical axis 275 (shown by dotted lines) so as to permit vertical deflection member 258 of cover member 33 to substantially deflect a downward water flow 276 (shown by arrows) and prevent or reduce such downward water flow 276 from entering upper opening 36 of upper conduit portion 240. It is also preferred that internal end 272 be sufficiently close to outward facing portion 264 of upper conduit portion 240 to substantially prevent or reduce a lateral water flow 278 (shown by arrows) from entering internal passageway 37 through upper opening 36. In this example, internal end 272 is arranged to cause lateral water flow 278 to form an external water flow 280 and, or an internal flow 282, depending on the volume, size, direction, concentration and speed of lateral flow 278.

It is preferred that internal end 272 of deflection member 252 extends inward within dry top 38 past a line of sight 279 (shown by dotted lines) that extends between lower end 273 of opening 36 to external end 274 of cover member 33. Line of sight 279 can mean that if an observer looks through opening 256 along line of sight 279, then opening 36 will not be visible (or at least not significantly visible) due to being obstructed by deflection member 252 and internal end 272 to show that water entering from this direction does not have a direct path into opening 36. This is preferred so that splashes of water entering opening 256 in the direction of line of sight 279 will be deflected by deflection member 252 and internal end 272 will be deflected in a similar manner as shown with lateral flow 278. Preferably, cover member 33 and deflection member 252 are arranged so that opening 36 is not visible from any varied three dimensional angle viewed through opening 256 and, or through any portion of cover member 33 to show that any variation in the angle or alignment of line of sight 279 will provide an obstruction of flow into opening 36.

Tests of embodiments using the methods of the present invention demonstrate significant reductions and in some cases virtual elimination of water entering opening 36 even when a focused stream of water such as from a hose is aimed in all possible directions and orientations into opening 256 or onto cover 33 or dry top 38. Even when tests include constant heavy flow streams of water flow that completely fill the entire width of opening 56, water is effectively deflected away from opening 36 and out of cover member 33 with significantly reduced amounts of water entering snorkel 20 rather than complete flooding. The preferred methods of providing high levels of flow capacity provided for drainage through lower opening 266, vent 270 and lateral opening 268 (not shown) in an area that is down stream of opening 36 permits such flow to efficiently escape dry top 38 without backing up and spilling back into opening 36. This is a significant advantage as the methods of the present invention can be arranged to permit lateral flow 278 to be created by a high flow garden hose directly focused into opening 256 without excessive amounts of water entering opening 36. Cover member 33 also successfully diverts high volume downward water flow 276 during tests with a powerful garden hose so that excessive amounts of water are prevented from entering opening 36. This permits dry top 38 to efficiently reduce or prevent excessive amounts of water from entering opening 36 from splashes of water created by other divers, whitecaps, crashing waves or spray from wind.

As seen in FIG. 39*a*, the portion of lateral water flow 278 that impacts against lateral deflection member 252 between internal end 272 and inward facing portion 262 is deflected downward along inward facing portion 262. In this embodiment, internal end 272 is arranged to be sufficiently close to outward facing portion 264 and, or vertical deflection member 258 and, or lateral deflection member 260 and, or cover 33, so as to cause lateral any portion of water flow 278 that flows above internal edge 272 to for internal flow 282 to impact against and adhere to the inner surface of cover 33. This can permit internal flow 282 to cling to the inner surface of cover 33 and flow out lower opening 266 and, or vent 270 to reduce or prevent internal flow 282 from entering internal passageway 37 through upper opening 36.

The cross section view in FIG. 39*a* shows that in this example, cover member 33 and upper conduit portion 240 are arranged in a substantially coaxial manner relative to a center axis 283 of dry top 38. This can provide increased streamlined external profile, reduced drag through the water and reduced snagging or catching of debris on or near dry top 38. In alternate embodiments, cover member 33 and upper conduit portion 240 can arranged to form two laterally offset conduit portions, if desired.

FIG. 39*b* shows the same cross section view shown if FIG. 39*a*, except that FIG. 39*b* shows an exhale flow path 284, which is seen to flow up through internal passageway 37, out of upper opening 36, and then flow out of upper opening 256, vent 270 and lower opening 260. Preferably, the numerous paths for flow leaving upper opening 36 and cover 33 is arranged to reduce back pressure and provides significant surface area, increased flow capacity for significantly unrestricted flow and low work of breathing for comfortable and efficient ventilation, even during high levels of exertion.

FIG. 39*c* shows the same cross section view shown if FIG. 39*b*, except that FIG. 39*c* shows an inhale flow path 286, which is seen to flow in through upper opening 256, vent 270 and lower opening 266 and then flow through upper opening 36 and downward into internal passageway 37. Preferably, the numerous paths for flow entering cover 33 are arranged to reduce back pressure and provides significant surface area, increased flow capacity for significantly unrestricted flow and low work of breathing for comfortable and efficient ventilation through upper opening 36, even during high levels of exertion.

FIG. 40 shows a cross section view taken along the line 40-40 in FIG. 38. In FIG. 40, cover member 33 is seen to be arranged to have a substantially coaxial positioning relative to upper conduit portion 240. In this view, cover member 33 is seen to have side deflectors 286 on either side of upper conduit portion 240 that are arranged to reduce or prevent splashes of water from entering upper opening 36 of upper conduit portion 240. In this embodiment, side deflectors 286 are seen to extend a significant distance along the sides of upper conduit portion 240 and extend significantly close to the position of inward facing portion 262 of upper conduit portion 240. Preferably, side deflectors 286 are arranged to sufficiently block splashes of water from entering upper opening 36 and may extend any desired distance along the sides of upper conduit portion 240, including a significantly short distance with a relatively small overlap, a relatively short distance with little or even no overlap with the sides of upper conduit portion 240, or significantly large amounts of such overlap.

It is preferred that side deflectors 286 are spaced from the nearby sides of upper conduit portion 240 to create a flow path 288, which can be used to facilitate additional flow for air intake and outtake during breathing and, or to increase the ability for splashes of water entering the interior of cover member 33 to drain out of cover member 33. In this example, flow paths 288 are in fluid communication with upper opening 256 of cover member 33. Preferably, deflector members 286 and flow paths 288 are arranged so that if splashes of water enter the interior of cover member 33, such splashes of water will adhere or cling to an inner surface portion 290 of cover member 33 and drain through flow paths 288 and flow out of opening 256 and, or out of lower opening 266 or lateral opening as shown in FIG. 38. In alternate embodiments, flow path 288 can be eliminated if desired and dry top 38 can still provide many advantages. In preferred embodiments, flow path 288 is provided in an amount sufficient to further improve drainage capacity and, or further increased air flow capacity for additional efficient and comfortable ventilation during breathing.

The lateral cross section view in FIG. 40 shows that upper conduit portion 240 at upper opening 36 substantially forms a concave half-shell shape that faces inward toward center axis 283 (shown by a dot due to the axis coming out of the page) of dry top 38. Similarly, cover member 33 forms an oppositely facing concave half-shell shape that faces inward toward center axis 283 and preferably overlaps and partially encapsulates the half-shell shape of upper conduit portion 240. This method of using a substantially overlapping configuration of opposing half shell shapes can be used to provide efficient ventilation for breathing, significantly improved protection from splashes of water entering internal passageway 37 through opening 36 and efficient control and drainage of water entering the interior of cover member 33 that is efficiently diverted away from opening 36 and eliminated through various openings in cover member 33 and dry top 38. Looking back at FIG. 39*a*, it can be seen that the vertical cross section view of dry top 38 in this embodiment also forms two vertically oriented overlapping convex half-shell shapes that face each other and are substantially coaxial. As stated previously, while a substantially coaxial configuration is preferred to reduce bulk and provide streamlined shape that creates less drag and reduced tendency to snag or catch on debris in the water, a substantially non-coaxial configuration can be used in alternate embodiments to create two laterally offset conduits having two offset longitudinal axis.

FIG. 41 shows a cross section view taken along the line 41-41 in FIG. 38. In FIG. 41, upper conduit portion 240 is an enclosed conduit and cover member 33 is seen to have vent 270, opening 256 and flow paths 288 for ventilation and drainage.

FIG. 42 shows a perspective view of an alternate embodiment of dry top 38. In this embodiment, cover member 33 surrounds upper conduit portion 240 in a substantially coaxial manner. In this view, it can be seen that flow path 288 between cover member 33 and inward facing portion 262 of upper conduit portion 240 (shown by dotted lines) inside of cover member 33, is smaller in this example than flow path 288 existing between cover member 33 and outward facing portion 264 of upper conduit portion 240 (shown by dotted lines) within cover 33. This shows that cover member 33 is arranged relative to upper conduit portion 240 in an offset coaxial manner. This can be used to provide increased flow capacity in certain portions of flow path 288 within dry top 38 where greater amounts of water flow are anticipated and to reduce the size of flow path 288 in areas where reduced amounts of water flow are anticipated so as to provide a further improved streamlined shape while providing additional flow in desired directions. In alternate embodiments, flow path 288 can be increased along forward and rearward facing portions of upper conduit portion 244 and cover member 33 relative to the direction of travel, and can be reduced in size along inward facing portion 262 and outward facing portion 264 to further increase the streamlined profile of dry top 38 relative to the direction of forward swimming.

The embodiment in FIG. 42 also includes an internal vent 292 (shown by dotted lines) within upper conduit portion 240 and inside of cover member 33. In this example, internal vent 292 is disposed within the side of upper conduit portion 240 that faces forward; however, in alternate embodiments any suitable positioning or arrangement of internal vent 292 may be used. Internal vent 292 can be used as an opening in upper conduit portion 240 that is in addition to opening 36 to further increase air intake and outtake during breathing. Preferably, internal vent 292 is protected from splashes of water by being inside cover member 33 so that cover member 33 deflects water and obstructs spray from entering internal vent 292.

The embodiment in FIG. 42 also includes additional vents 270 along cover member 33. While water can drain through lower opening 266 between cover member 33 and upper conduit portion 240, the large flow capacity through one or more significantly large vents 270 can greatly increase drainage capacity of water of out of dry top 38. This method of providing vents 270 along the lateral portions of cover member 33 can permit lower opening 266 to be significantly small or even eliminated so that the lateral dimension of cover member 33 can be made significantly small and streamlined. For example, if vents 270 were not used, the lateral width of lower opening 266 would need to be made much larger to provide increased flow capacity to compensate for the loss of vents 270 and this would require that cover member 33 be made much wider and be significantly larger than upper conduit portion 240. Similarly, the methods of the present invention for providing at least one significantly large vent 270 along a lateral portion of cover member 33 can permit significantly increased drainage and flow capacity so that lower opening 266 can be reduced, minimized or even eliminated if desired so that the lateral dimension of cover member 33 can be significantly reduced for increased streamlined profile and reduced tendency to create drag or snag debris during swimming. In addition, the method of using vents 270 along lateral portions of cover member 33 can greatly increase air intake and outtake ventilation capacity and efficiency during breathing. Furthermore, vents 270 can provide a source of air intake and outtake for breathing and supplying air to opening 36 (shown by broken lines) even when sprays of water are entering upper opening 256 of cover member 33 even if upper opening 256 is completely saturated or engulfed with incoming water such as from a whitecap or crashing wave. In alternate embodiments, additional and, or alternative vents 270 may be used along any portion of any form of cover member 33 and have any suitable alignment, size, shape, contour, protection by additional flow deflectors, positioning, orientation, configuration, arrangement, array, variation or combination. Similarly, any number of internal vents 292 may be used along any desired portion of upper conduit portion 240 with any suitable alignment, size, shape, contour, protection by additional flow deflectors, positioning, orientation, configuration, arrangement, array, variation or combination.

In FIG. 42, a standoff 294 is seen to hold cover member 33 at a distance from upper conduit portion 240; however, any suitable method of connecting cover member 33 to upper conduit portion may be used including any suitable form of mechanical connection, bond or structure as well any suitable chemical bond if desired.

FIG. 43 shows a cross section view taken along the line 43-43 in FIG. 42. In FIG. 43, cover member 33 is seen to completely encapsulate upper conduit portion 240 at upper opening 36 in a substantially coaxial manner. Flow paths 288 are seen to exist around all portions of upper conduit portion 240.

FIG. 44 shows a cross section view taken along the line 44-44 in FIG. 42. In FIG. 44, cover member 33 is seen to completely encapsulate upper conduit portion 240 in a substantially coaxial manner and internal vents 292 are seen within upper conduit portion 240 at this position along this particular embodiment example.

FIG. 45 shows a cross section view taken along the line 45-45 in FIG. 42. In FIG. 45, vents 270 are sent to exist around multiple sides of upper conduit portion 240 to provide increased ventilation capacity and increased drainage capacity.

Preferably, for any embodiment or alternate embodiment of dry top 38 and/or cover member 33, vents 270 and/or any other vent(s)/opening(s) are preferably arranged to provide sufficient flow rate and volume capacity for snorkel 20 to create significantly low work of breathing (inhale and/or exhale) in an amount efficient to permit comfortable ventilation during significantly high levels of exertion. Preferably, the total cross section volume of all external openings/vents within cover member 38 and/or dry top 38, shall equal or exceed the cross sectional volume of at least one portion of internal passageway 37 within snorkel 20. It is also preferred that if such openings/vents have significant deflections in the path of flow, that the total cross sectional volume of all such external openings/vents within cover member 38 and/or dry top 38, shall be at least 50%, 75%, 100%, 150%, 200%, 250% or 300% larger than the cross sectional volume of at least one portion of internal passageway 37 within snorkel 20.

SUMMARY, RAMIFICATIONS, AND SCOPE

Accordingly, the reader will see that the designs and methods of the present invention offer advantages in that they (a) provide methods and designs for dry tops for snorkels that can maintain a sealed condition in numerous underwater orientations;

(b) provide methods and designs for dry tops for snorkels that can regain a sealed position in numerous underwater orientations after the swimmer exhales or if the suction force within the snorkel at depth is reduced or eliminated;

(c) provide methods and designs for dry tops for snorkels that can have an improved sealing force for sealing the snorkel during at least one or more orientations underwater;

(d) provide methods and designs for dry tops for snorkels that can achieve, maintain or reestablish a sealed position in numerous underwater orientations after the swimmer exhales or if the suction force within the snorkel at depth is reduced or eliminated;

(e) provide methods and designs for snorkels splash protectors that can provide improved ability to prevent splashes of water from entering the air intake opening of a snorkel;

(f) provide methods and designs for splash protectors for snorkels that can provided significantly low levels of flow resistance or work of breathing;

(g) provide methods and designs for splash protectors for snorkels that can prevent splashes of water from entering the air intake of the snorkel from an increased number of directions;

(h) provide methods and designs for splash protectors for snorkels that can provide increased ventilation capacity and efficiency along with increased splash deflection and drainage capacity;

(i) provide methods and designs for splash protectors for snorkels with improved streamlined shape and, or reduced overall size and drag;

(j) provide methods and designs for splash protectors for snorkels that can provide improved performance;

(k) provide methods and designs for dry tops for snorkels that can provide improved performance; and, or (l) provide other advantages that are apparent from the drawings and description.

Although the description above contains many specificities, these should not be construed as limiting the scope of the invention but as merely providing illustrations of some of the presently preferred embodiments of this invention. For example, in alternate embodiments, any methods or devices for reducing and, or controlling internal volume, internal gas volume or the difference between ambient pressure and internal gas pressure within the snorkel may be used. Also, the methods of the present invention may include positioning within internal passageway 37 any portion of any embodiment or variation of active portion 72 and any or all of the potential or described parts of any version of active portion 72, as well as combinations of positioning such parts of inside and/or outside of internal passageway 37 in any manner whatsoever. Any of the parts may have any shape, form, arrangement, size, direction of movement, positioning, orientation, or combinations of such variations in any suitable manner whatsoever.

Also, while some of the preferred embodiments are seen to have the alignment of upper opening 36 oriented at any angle that is substantially between zero degrees and 90 degrees relative to the longitudinal alignment of upper portion 34, any angle may be used. While the flow path of air near opening 36 is preferably arranged to not exceed a change of direction that is substantially more than 90 degrees, alternate embodiments may be arranged to provide the alignment of opening 36 to be substantially between 90 degrees and 120 degrees, 90 degrees and 160 degrees, approximately 180 degrees or greater than 180 degrees. It is preferred that the alignment of opening 36 is less than 160 degrees relative to the alignment of upper portion 34, or that the flow path of air near opening 36 is arranged to preferably not exceed a change in direction that is substantially more than 160 degrees and is preferably between zero degrees and 90 degrees, zero degrees and 120 degrees, zero degrees and 145 degrees, or zero degrees and 160 degrees; however, any alignment or change in flow path direction whatsoever may be used if desired.

In addition, any of the embodiments, methods and individual variations discussed in the above description are intended to be interchanged and combined with one another in any desirable order, amount, arrangement, and configuration for alternate embodiments and may also be used alone without other features being present. Each of such embodiments, methods and individual variations is incorporated by reference to each and every other alternate embodiment, method and individual variation. Furthermore, any variation or combinations of variations are intended to be able to be used along any position, part, feature, extension, add-on feature or any portion or location of a snorkel or any of its parts.

Accordingly, the scope of the invention should not be determined not by the embodiments illustrated, but by the appended claims and their legal equivalents.

I claim:

1. A method for providing a snorkel comprising:

(a) providing a conduit having a first end and a second end, said first end having an opening, said conduit having a predetermined longitudinal axis near said opening;

(b) providing a mouthpiece joined to said second end of said conduit, said mouthpiece being in fluid communication with said opening;

(c) providing a predetermined deflection member for at least partially deflecting splashes of water away from said opening, said deflection member having an internal end near said opening;

(d) providing a cover member that is connected to said conduit above said opening, said cover member being arranged to cover said opening and being spaced from said opening so as to not excessively obstruct said opening, said cover member being spaced from the exterior of said conduit to create a flow path between said conduit, said cover member having an outer end region that is substantially above said opening when said first end is in a substantially upright orientation during use, said cover member having at least one vent in said cover member that is below said opening when said first end is in said substantially upright orientation;

(e) arranging said outer end region of said cover member and internal end of said deflection member to be spaced apart to permit fluid flow thereof;

(f) arranging said outer end region of said cover member to sufficiently overlap said internal end of said deflection member so as to block a line of sight between said outer end region of said cover member and said opening in an amount effective to reduce splashes of water from entering said opening;

(g) providing a movable member connected to a sealing member, said movable member being arranged to experience predetermined movement between an open position wherein said movable member and said sealing member are remote from said opening and a closed position wherein said sealing member closes said opening, said movable member is arranged to be significantly separated from direct fluid communication with said internal passageway by said sealing member when said sealing member is in said closed position, said movable member and said sealing member forming an active portion;

(h) arranging said active portion to move between said open position and said closed position in a transverse direction that is significantly transverse to said predetermined longitudinal axis of said conduit near said opening;

(i) providing a predetermined member that is arranged to exert a predetermined non-floatation force against said active portion during the act of submersion of said first end in surrounding water while said first end is in a substantially upright orientation, said predetermined non-floatation force being sufficient to move said sealing member from said open position to said closed position while said snorkel is in said substantially upright orientation during said act of submersion, said predetermined member being arranged to not urge said active portion away from said closed position and toward said open position when said first end is in a substantially inverted orientation while submerged under the surface of the water;

(j) providing at least one substantially independent float member that is arranged to experience disengagement from said movable member and said sealing member that is sufficient to not cause said independent float member to exert an opening force upon said movable member that is directed away from said closed position and toward said open position when said first end is in a substantially inverted orientation while submerged underwater, said substantially independent float member being arranged to move toward and engage said active portion during said act of submersion when said first end is in said substantially upright orientation, said independent float member also being arranged to move away from said active portion and disengage from said active portion when said independent float member is out of water and said first end is in said upright orientation, said disengagement being sufficient to not cause said independent float member to exert said opening force upon said active portion; and (k) arranging active portion to have a weighted portion that permits said active portion to have sufficient weight out of water to cause said active portion to automatically move from said closed position to said open position in said transverse direction when said first end and said independent float member are out of water in said upright orientation, said weighted portion being solid, said movable member and said sealing member being arranged to be sufficiently out of the way of said opening during said open position so as to not substantially interfere with the flow of air into and out of said opening when said sealing member is in said open position.

2. A method for providing a snorkel, comprising:

(a) providing a conduit member having a first end and a second end, said first end of said conduit member having a predetermined longitudinal axis;

(b) providing said first end with an opening arranged to permit air to enter said conduit member;

(c) providing a mouthpiece joined to said end of said conduit member, said snorkel having an internal passageway existing inside of said conduit member in an area between said opening and said mouthpiece that is arranged to permit said mouthpiece to be in fluid flow communication with said opening;

(d) providing a cover member connected to said first end, said cover member being sufficiently spaced from at least one external surface region of said first end of said conduit member to form a substantially enclosed cover member passageway between said cover member and said at least one external surface region of said conduit member, at least one portion of said substantially enclosed cover member passageway being in fluid communication with said internal passageway of said snorkel, said cover member having a plurality of openings that are in fluid communication with said substantially enclosed cover member passageway and said internal passageway of said conduit, said cover member and said first end together forming a snorkel top member;

(e) providing a movable member that is disposed within said substantially enclosed cover member passageway, said movable member being pivotally connected to at least one portion of said snorkel top member with at least one hinge member, said movable member being arranged to experience transverse pivotal motion across a transversely directed movable member range of motion between an open position wherein said movable member is transversely spaced from said opening and a closed position wherein said movable member closes said opening, said movable member range of motion occurring in a transverse movable member direction of movement that is significantly transverse to said predetermined longitudinal axis of said first end of said conduit;

(f) providing a relatively soft sealing member between said movable member and said opening when said movable member is in said closed position, said sealing member being arranged to provide a relatively water tight seal between said movable member and said opening while in said closed position;

(g) providing a substantially independent float member that is disposed within at least one portion of said cover member passageway and is arranged to move toward said movable member and said opening when said first end is substantially submerged in a substantially upright orientation so as to push up against said movable member and urge said movable member to experience said transverse pivotal motion from said open position to said closed position, said independent float member being arranged to experience disengagement from said movable member sufficient to permit said independent float member to separate and move away from said movable member and said opening so as to prevent said independent float member from exerting a transverse opening force upon said movable member that is directed away from said closed position and toward said open position along said transversely directed movable member range of motion when said first end is in a substantially inverted orientation while substantially submerged underwater, said independent float member also being arranged to experience said disengagement from said movable member when said first end is raised substantially above the surface of the water in said substantially upright orientation in a predetermined manner that prevents said independent float member from exerting said transverse opening force upon said movable member as said independent float member moves away from said opening under the force of gravity; and (h) arranging said movable member and said sealing member to be sufficiently out of the way of said opening during said open position so as to not substantially interfere with the flow of air into and out of said opening when said sealing member is in said open position, said movable member and said sealing member forming an active portion, arranging said movable member to quickly and efficiently move said sealing member transversely away from said opening in said transverse movable member direction when said first end is raised substantially above the surface of the water in said substantially upright orientation during use, without said independent float member exerting said transverse opening force upon said movable member as said independent float member experiences said disengagement and moves away from said opening.

3. The method of claim 2 wherein said first end is arranged to permit the flow of air through said opening to flow substantially parallel to the alignment of said predetermined longitudinal axis that exists below said cover member and said snorkel top member.

4. The method of claim 2 wherein said substantially independent float member is arranged to move in a predetermined float direction toward and away from said movable member, said sealing member is arranged to move in a predetermined closing direction between said open position and said closed position, said predetermined float direction being different than said predetermined closing direction of said sealing member.

5. The method of claim 2 wherein the flow path of air flowing out of said opening during use in said open position is arranged to not substantially exceed a right angle relative to said predetermined longitudinal axis.

6. The method of claim 2 wherein said predetermined longitudinal axis is taken at said opening and said predetermined longitudinal axis is substantially parallel to the direction of flow or air through said opening during use.

7. The method of claim 2 wherein said substantially independent float member is arranged to experience a float member range of movement during use that is arranged to occur in a float member direction of movement that is substantially transverse to said transverse movable member direction of movement.

8. The method of claim 7 wherein said substantially independent float member is loosely contained by said substantially enclosed cover member passageway and is arranged to experience significantly linear movement within said substantially enclosed cover member passageway.

9. The method of claim 8 wherein said substantially independent float member is free to move within said substantially enclosed cover member passageway within said a float member range of movement without having any other physical connection to said snorkel top.

10. The method of claim 2 wherein said independent float member comprises two independent float members that are arranged to move independently of one another, wherein at least one of said two independent float members is arranged to press against and move said movable member to said closed position when said first end is substantially submerged in water in said substantially upright orientation.

11. The method of claim 2 wherein said substantially enclosed cover member has at least two internal passageways, said independent float member comprises two independent float members that are arranged to move independently of one another, one of said two independent float members being disposed within one of said at least two internal passageways and the other of said two independent float members being disposed in the other of said at least two internal passageways, wherein at least one of said two independent float members is arranged to move said movable member to said closed position when said first end is substantially submerged in water in said substantially upright orientation.

12. The method of claim 2 wherein a weighted portion is disposed within at least one portion of said active portion, said weighted portion being a thickened region of substantially solid material.

13. The method of claim 2 wherein said movable member and said sealing member together having a collective predetermined density that is arranged to be less than the density of water.

14. The method of claim 2 wherein said movable member and said sealing member together having a collective predetermined density that is greater than the density of water.

15. The method of claim 2 wherein said movable member and said sealing member together forming a collective member that is arranged to have a collective predetermined displacement that collectively displaces a predetermined amount of water when submerged, said collective member being arranged to have a predetermined collective torsional weight exerted about said hinge when out of the water, said collective predetermined displacement combining with said collective predetermined weight to create a collective predetermined density, said collective predetermined weight being arranged to be sufficient to efficiently create a transverse torsional force during use, said collective predetermined density being arranged to not excessively oppose said independent float member from moving said collective member to said closed position when said first end is substantially submerged under water in said substantially upright orientation.

16. The method of claim 2 wherein said active portion has at least one weighted portion that is arranged to provide said active portion with sufficient collective torsional weight exerted at a predetermined transverse distance from said hinge member when out of water to create a predetermined transverse torsional force upon said movable member that is sufficient to quickly and efficiently move said movable member and said sealing member transversely away from said opening in said transverse movable member direction when said first end is raised substantially above the surface of the water in said substantially upright orientation during use.

17. A method for providing a snorkel comprising:

(a) providing a conduit having a first end and a second end, said first end having an opening, said conduit having a predetermined longitudinal axis near said opening, said opening being arranged to be directed at an angle to said predetermined longitudinal axis of said conduit near said first end;

(b) providing a mouthpiece joined to said second end of said conduit, said mouthpiece being in fluid communication with said opening;

(c) providing a predetermined deflection member for at least partially deflecting splashes of water away from said opening, said deflection member having an internal end near said opening, said predetermined deflection member having a deflection member opening region arranged to permit a significant amount of air to move in and out of said deflection member during use in a first transverse direction that is substantially transverse to said longitudinal axis;

(d) providing a substantially cup-shaped cover member that is connected to said conduit above said opening, said substantially cup-shaped cover member being arranged to cover said opening and being spaced from said opening so as to not excessively obstruct said opening, said substantially cup-shaped cover member being spaced from the exterior of said conduit to create a flow path between said conduit and said substantially cup-shaped cover member, said substantially cup-shaped cover member having an outer end region that is substantially above said opening when said first end is in a substantially upright orientation during use, said substantially cup-shaped cover member having at least one vent in said cover member that is below said opening when said first end is in said substantially upright orientation, said substantially cup-shaped member having a substantially concave inner surface that is arranged to substantially wrap around the outside of said deflection member in a substantially coaxial manner in an amount sufficient to substantially enclose said deflection member opening, said substantially cup-shaped member having a member opening that is arranged to direct air to flow in a substantially different direction than said first transverse direction of said deflection member;

(e) arranging said outer end region of said substantially cup-shaped cover member and internal end of said deflection member to be spaced apart to permit fluid flow thereof; and (f) arranging said outer end region of said substantially cup-shaped cover member to sufficiently overlap said internal end of said deflection member so as to block a line of sight between said outer end region of said substantially cup-shaped cover member and said opening in an amount effective to reduce splashes of water from entering said opening.

18. The method of claim 17 wherein said substantially cup-shaped cover member at least partially encapsulates both said conduit and said deflection member in a substantially coaxial manner.

19. The method of claim 17 wherein said cup-shaped cover member, said deflection member, and said first end of said conduit all being substantially coaxial with each other both above water and below water during use.

20. The method of claim 17 wherein at least one portion of said substantially cup-shaped cover member has a plurality of openings having a collective total cross sectional volume sufficient to provide significantly comfortable levels of work of breathing during significantly high ventilation rates such as occurring during significantly high levels of exertion.

21. The method of claim 17 wherein at least a portion of said outer end region of said substantially cup-shaped cover member is arranged to have a substantially concave down contour while said first end is in said substantially upright orientation.

22. A method for providing a snorkel, comprising:

(a) providing a conduit member having a first end and a second end, said first end of said conduit member having a predetermined longitudinal axis;

(b) providing said first end with an opening arranged to permit air to enter said conduit member;

(c) providing a mouthpiece joined to said end of said conduit member, said snorkel having an internal passageway existing inside of said conduit member in an area between said opening and said mouthpiece that is arranged to permit said mouthpiece to be in fluid flow communication with said opening;

(d) providing a cover member connected to said first end, at least one portion of said cover member being sufficiently spaced from said first end of said conduit member to form a cover member passageway between said cover member and said conduit member, said cover member and said first end together forming a snorkel top member;

(e) providing a movable member that is pivotally connected to at least one portion of said snorkel top member with at least one hinge member, said movable member being arranged to experience transverse pivotal motion across a transversely directed movable member range of motion between an open position wherein said movable member is transversely spaced from said opening and a closed position wherein said movable member closes said opening, said movable member range of motion occurring in a transverse movable member direction of movement that is significantly transverse to said predetermined longitudinal axis of said first end of said conduit;

(f) providing a relatively soft sealing member between said movable member and said opening when said movable member is in said closed position, said sealing member being arranged to provide a relatively water tight seal between said movable member and said opening while in said closed position;

(g) providing at least one substantially independent float member that is disposed within at least one portion predetermined passageway along said snorkel and is arranged to move toward said movable member and said opening when said first end is substantially submerged in a substantially upright orientation so as to push up against said movable member and urge said movable member to experience said transverse pivotal motion from said open position to said closed position, said independent float member being arranged to experience disengagement from said movable member sufficient to permit said independent float member to separate and move away from said movable member and said opening so as to prevent said independent float member from exerting a transverse opening force upon said movable member that is directed away from said closed position and toward said open position along said transversely directed movable member range of motion when said first end is in a substantially inverted orientation while substantially submerged underwater, said independent float member also being arranged to experience said disengagement from said movable member when said first end is raised substantially above the surface of the water in said substantially upright orientation in a predetermined manner that prevents said independent float member from exerting said transverse opening force upon said movable member as said independent float member moves away from said opening under the force of gravity; and (h) arranging said movable member and said sealing member to be sufficiently out of the way of said opening during said open position so as to not substantially interfere with the flow of air into and out of said opening when said sealing member is in said open position, said movable member and said sealing member forming an active portion, arranging said movable member to quickly and efficiently move said sealing member transversely away from said opening in said transverse movable member direction when said first end is raised substantially above the surface of the water in said substantially upright orientation during use, without said independent float member exerting said transverse opening force upon said movable member as said independent float member experiences said disengagement and moves away from said opening.

23. The method of claim 22 wherein at least one portion of said moveable member is arranged to have a density that is less than water.

24. The method of claim 22 wherein at least one portion of said moveable member is arranged to have a density that is greater than water.

* * * * *